US008623580B2

(12) United States Patent
Nakajima et al.

(10) Patent No.: US 8,623,580 B2
(45) Date of Patent: Jan. 7, 2014

(54) TONER, DEVELOPER, IMAGE FORMING METHOD AND IMAGE FORMING APPARATUS

(75) Inventors: Yukiko Nakajima, Shizuoka (JP); Akihiro Kotsugai, Shizuoka (JP); Ryota Inoue, Osaka (JP); Akiyoshi Sabu, Kanagawa (JP); Shingo Sakashita, Shizuoka (JP); Keiko Osaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 471 days.

(21) Appl. No.: 12/849,392

(22) Filed: Aug. 3, 2010

(65) Prior Publication Data

US 2011/0104608 A1 May 5, 2011

(30) Foreign Application Priority Data

Aug. 3, 2009 (JP) ..... 2009-180383
Jul. 21, 2010 (JP) ..... 2010-163613

(51) Int. Cl.
*G03G 9/087* (2006.01)

(52) U.S. Cl.
USPC ..... 430/109.4; 430/109.3; 430/105; 430/109.31; 430/124.1

(58) Field of Classification Search
USPC ..... 430/97–111.41
See application file for complete search history.

(56) References Cited

U.S. PATENT DOCUMENTS 5,387,665 A * 2/1995 Misawa et al. ..... 528/81
2007/0015077 A1* 1/2007 Yamashita et al. ..... 430/109.4
2007/0160782 A1* 7/2007 Yatsuzuka et al. ..... 428/34.2
2007/0281235 A1* 12/2007 Ono et al. ..... 430/111.4
2008/0227018 A1* 9/2008 Awamura et al. ..... 430/110.4
2009/0003885 A1 1/2009 Sabu et al.
2010/0104965 A1 4/2010 Inoue et al.
2010/0183967 A1 7/2010 Sabu et al.
2010/0221655 A1* 9/2010 Mukai et al. ..... 430/110.2

FOREIGN PATENT DOCUMENTS

JP 58-205161 11/1983
JP 58-205163 11/1983
JP 58-205164 11/1983
JP 59-96123 6/1984
JP 60-186851 9/1985
JP 60-186852 9/1985
JP 60-186854 9/1985
JP 1-51186 11/1989
JP 2-3172 1/1990

(Continued)

OTHER PUBLICATIONS

Foreign application of WO 2007015516 A1, Feb. 2007, WIPO, Mukai et al.*

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

To provide a toner including: a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton.

15 Claims, 3 Drawing Sheets

(56) References Cited

FOREIGN PATENT DOCUMENTS

| | | |
|---|---|---|
| JP | 2-51175 | 2/1990 |
| JP | 2-51176 | 2/1990 |
| JP | 2-60179 | 2/1990 |
| JP | 2-52930 | 11/1990 |
| JP | 4-9299 | 2/1992 |
| JP | 7-33861 | 2/1995 |
| JP | 8-262783 | 10/1996 |
| JP | 9-274335 | 10/1997 |
| JP | 9-319144 | 12/1997 |
| JP | 2909873 | 4/1999 |
| JP | 2001-166537 | 6/2001 |
| JP | 3289598 | 3/2002 |
| JP | 3344214 | 8/2002 |
| JP | 3347406 | 9/2002 |
| JP | 2002-284881 | 10/2002 |
| JP | 3455523 | 7/2003 |
| JP | 3640918 | 1/2005 |
| JP | 2005-55534 | 3/2005 |
| JP | 2005-77603 | 3/2005 |
| JP | 3785011 | 3/2006 |
| JP | 3789522 | 4/2006 |
| JP | 2007-93809 | 4/2007 |
| JP | 4076716 | 2/2008 |
| JP | 4085942 | 2/2008 |
| JP | 2008-262179 | 10/2008 |
| WO | WO 2007015516 A1 * | 2/2007 |

OTHER PUBLICATIONS

U.S. Appl. No. 12/713,833, filed Feb. 26, 2010, Akihiro Kotsugai, et al.

* cited by examiner

TONER, DEVELOPER, IMAGE FORMING METHOD AND IMAGE FORMING APPARATUS

BACKGROUND OF THE INVENTION

1. Field of the Invention

The present invention relates to a toner used for electrophotographic image formation, for example image formation with a copier, a printer, a facsimile, etc., electrostatic printing, or electrostatic recording.

2. Description of the Related Art

Conventionally, in an electrophotographic image forming apparatus, an electrostatic recording apparatus, etc., an electric or magnetic latent image is visualized using toner. For example, in an electrophotographic method, an electrostatic image (latent image) is formed on a photoconductor, then the latent image is developed using toner, and a toner image is thus formed. Then the toner image is generally transferred onto a recording medium such as paper and fixed by means of a process such as heating.

A toner used for developing an electrostatic image is generally in the form of colored particles including a binder resin which contains a colorant, a charge controlling agent, etc. Methods for producing the toner are broadly classified into the pulverization method and the polymerization method.

In the pulverization method, a toner composition obtained by melt-mixing and uniformly dispersing a colorant, a charge controlling agent, an offset preventing agent, etc. into a thermoplastic resin is pulverized and classified so as to produce a toner. The pulverization method makes it possible to produce a toner with properties which are favorable to some extent. However, selection of materials is limited. For instance, a toner composition obtained by melt mixing should be able to be pulverized and classified with apparatuses which can be economically used. This requires the toner composition obtained by melt-mixing to be sufficiently brittle. When such a toner composition is pulverized, particles with a wide particle size distribution are likely to be formed. In this situation, if a copied image with favorable resolution and tone properties is to be obtained, it is necessary to remove fine powder of 5 μm or less in particle diameter and coarse powder of 20 μm or greater in particle diameter by classification. Hence there is a problem in that the yield is very low. Also in the pulverization method, it is difficult to disperse the colorant, the charge controlling agent, etc. uniformly into the thermoplastic resin, and thus there is a problem in that the obtained toner is adversely affected in terms of fluidity, developing capability, durability, image quality and so forth.

Accordingly, a dissolved resin suspension method has been proposed in which a resin solution that dissolves a resin previously synthesized by polymerization reaction is dispersed into an aqueous medium in the presence of a dispersion (auxiliary) agent such as a water-soluble resin or a surfactant and a dispersion stabilizer such as fine inorganic particles or fine resin particles, the solvent is removed by heating, pressure reduction, etc., and a toner is thus obtained (refer to Japanese Patent Application Laid-Open (JP-A) Nos. 09-319144 and 2002-284881). According to the dissolved resin suspension method in these proposals, a toner with uniform toner particles can be obtained without carrying out classification.

Regarding an electrophotographic image forming apparatus, separability of toner from a heating member (hereinafter referred to also as "offset resistance") is required in a fixing step by a contact heating method performed using a heating member such as a heat roller. The offset resistance is achieved by using a modified polyester resin in the dissolved resin suspension method (refer to Japanese Patent No. 3640918).

Now, binder resins, which occupy 70% or more of the compositions of toners, contain oil resources as raw materials in most cases, so that there are concerns over depletion of oil resources, and global warming caused by consuming large quantities of oil resources and discharging carbon dioxide into the air. Accordingly, if resins derived from plants which grow by taking in carbon dioxide in the air are used for the binder resins, carbon dioxide is generated and consumed repeatedly within an environment, which means that there is a possibility that the global warming and the depletion of oil resources may be able to be solved at the same time. Accordingly, a variety of toners containing such plant-derived resins as binder resins have been proposed. For example, Japanese Patent No. 2909873 proposes use of polylactic acid as a binder resin. However, when polylactic acid is used without any change to it, the actions of a thermoplastic resin are lessened at the time of fixation because the polylactic acid has a higher concentration of ester bonds than a polyester resin. Also, the toner hardens to a great extent, which presents problems in that there is a lack of toner pulverization capability and a decrease in productivity.

JP-A No. 09-274335 proposes a toner for development of electrostatic images, which includes a colorant, and a polyester resin obtained by dehydration polycondensation between lactic acid and a composition containing a trifunctional or higher oxycarboxylic acid. In this proposal, however, the polyester resin (obtained by the dehydration polycondensation between the hydroxyl group of the lactic acid and the carboxyl group of the trifunctional or higher oxycarboxylic acid) is in a branched or network form and thus is less soluble in solvent than straight-chain polyester resins. Moreover, inferior in sharp melting capability, the toner is problematic in terms of its poor low-temperature fixation properties.

In an attempt to improve thermal properties of a toner, there has been proposed an electrophotographic toner including a polylactic acid-based biodegradable resin and a terpene phenol copolymer (refer to JP-A No. 2001-166537). However, this proposal does not satisfy favorable low-temperature fixation properties and hot offset resistance at the same time.

Since the toners described in these prior art documents are all obtained by pulverization, there are problems of toner loss (caused by classification) and resultant toner disposal. Also, since the amount of energy required for the pulverization is relatively large, further reduction in environmental load is required.

Polylactic acid, which is a general-purpose, easily-available plant-derived resin, is synthesized by dehydration condensation of lactic acid or ring-opening polymerization of a cyclic lactide (refer to JP-A Nos. 07-33861 and 59-96123). Therefore, when a toner is produced using polylactic acid, any of the dissolved resin suspension methods described in JP-A Nos. 09-319144 and 2002-284881 and Japanese Patent No. 3640918 may be used. However, regarding polylactic acid, when poly-L-lactic acid or poly-D-lactic acid is used alone, it has such high crystallinity that it is hardly soluble in organic solvent, which makes the use of a dissolved resin suspension method difficult. Meanwhile, JP-A No. 2008-262179 discloses that poly-L-lactic acid and poly-D-lactic acid are mixed together so as to decrease crystallinity and improve their solubility in organic solvent.

However, polylactic acid contains a large number of polar groups per unit molecule, so that in the case where a toner is produced using polylactic acid(s) with reduced crystallinity, the toner is affected by moisture to a greater extent than in the case of polylactic acid(s) with high crystallinity. This leads to degradation of the heat-resistant storage stability of the toner, variation in the fluidity of the toner (caused by moisture absorption) and difficulty in controlling the charge amount. It is particularly difficult to reduce variation in charge amount under a condition which can belong to anywhere between a low-temperature, low-humidity condition and a high-temperature, high-humidity condition, and thus there are problems of unstable charge amount and image density.

To solve problems related to a toner's heat-resistant storage stability and charge amount variation, there is a known method of covering a toner's binder resin surface with fine powder of a styrene-acrylic copolymer.

For example, developers have been proposed in which the surfaces of particles of a styrene-acrylic resin as a binder resin of toner are covered with fine powder of an acrylic polymer or fine powder of a styrene-acrylic copolymer (refer to JP-A Nos. 60-186851, 60-186852 and 60-186854, and Japanese Patent Nos. 3789522 and 3289598).

Also, developers have been proposed in which the surfaces of particles of a polyester resin as a binder resin of toner are covered with fine powder of an acrylic polymer or fine powder of a styrene-acrylic copolymer (refer to JP-A Nos. 58-205161, 58-205163 and 58-205164, 2005-77603 and 2007-93809).

However, although the developers in these proposals are superior in heat-resistant storage stability, the surface of the binder resin of the toner is covered with fine resin particles, and thus sufficient low-temperature fixation properties may not be obtained. Also, there is a problem in that the fine resin particles on the surface may peel off owing to long-term agitation in a developing unit and thus the charge amount of the toner may change with time.

As described above, since there is generally a paradoxical relationship between low-temperature fixation properties and heat-resistant storage stability, it is difficult to achieve a favorable balance between them. Accordingly, for example, developers have been proposed in which surfaces of toner particles are covered with fine powder of two different types of acrylic polymers or fine powder of two different types of styrene-acrylic copolymers so as to divide functions, and thus a favorable balance between low-temperature fixation properties and heat-resistant storage stability is achieved (refer to Japanese Patent Nos. 4076716 and 4085942, and JP-A Nos. 08-262783 and 2005-55534).

Nowadays, energy saving in relation to electrophotographic copiers and printers is attracting much interest, and superior low-temperature fixation properties are being demanded. In the cases of Japanese Patent Nos. 4076716 and 4085942 and JP-A Nos. 08-262783 and 2005-55534, however, petroleum resins that are conventionally used in the field of toners, such as styrene-acrylic resins or polyester resins, are used as binder resins, and thus it is difficult to obtain sufficient low-temperature fixation properties.

As just described, in reality, a toner which is superior in low-temperature fixation properties, heat-resistant storage stability, hot offset resistance, fluidity, image density and haze value, and high in charge stability against changes of use conditions such as temperature and humidity, and which includes polylactic acid, and techniques related to the toner have not been obtained, and so further improvement and development are being demanded.

BRIEF SUMMARY OF THE INVENTION

The present invention provides a toner which (even when polylactic acid is used in the toner) secures hot offset resistance and heat-resistant storage stability and is superior in low-temperature fixation properties, fluidity, image density, haze value, and charge stability against changes of use conditions such as temperature and humidity. The present invention also provides a developer, an image forming method and an image forming apparatus, each including the toner.

As a result of carrying out a series of earnest examinations in an attempt to solve the above-mentioned problems, the present inventors have found that the problems can be effectively solved by a toner including two resins which contain predetermined polymers and have mutually different glass transition temperatures, and also including a resin which has a polyhydroxycarboxylic acid skeleton, wherein the two resins are attached to a surface of the resin having the polyhydroxycarboxylic acid skeleton, and wherein the predetermined polymers are based upon styrene monomer(s) and/or acrylic monomer(s).

The present invention is based upon the findings of the present inventors, and means for solving the problems are as follows.

<1> A toner including: a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton.

<2> The toner according to <1>, wherein the first resin (a1) and the second resin (a2) each contain any one selected from a styrene-acrylic resin, a polyester resin and a urethane-acrylic resin.

<3> The toner according to <1>, wherein the third resin (b) has a polyhydroxycarboxylic acid skeleton formed of an optically-active monomer, and wherein the third resin (b) has an optical purity X (%), represented by Equation (1) below, of 80% or less, $$\text{Optical purity } X(\%) = |X(L\text{-form}) - X(D\text{-form})| \qquad \text{Equation (1)}$$

where X (L-form) denotes the proportion (mol %) of an L-form contained in the third resin (b), expressed as an optically-active monomer equivalent, and X (D-form) denotes the proportion (mol %) of a D-form contained in the third resin (b), expressed as an optically-active monomer equivalent.

<4> The toner according to <1>, wherein the polyhydroxycarboxylic acid skeleton of the third resin (b) is a skeleton of a copolymer of C3-C6 hydroxycarboxylic acids.

<5> The toner according to <1>, wherein the third resin (b) contains a polyester diol (b11) having a polyhydroxycarboxylic acid skeleton.

<6> The toner according to <1>, wherein the third resin (b) contains a straight-chain polyester resin (b1) obtained by reacting together a polyester diol (b11) having a polyhydroxycarboxylic acid skeleton, and a polyester diol (b12) other than the polyester diol (b11), along with an elongation agent.

<7> The toner according to <6>, wherein the mass ratio of the polyester diol (b11) having the polyhydroxycarboxylic acid skeleton to the polyester diol (b12) other than the polyester diol (b11), represented by b11:b12, is in the range of 31:69 to 90:10.

<8> The toner according to <1>, wherein the third resin (b) contains a straight-chain polyester resin (b1), and a resin (b2) obtained by reacting a precursor (b0).

<9> The toner according to <1>, wherein the first resin (a1) has a volume average particle diameter Dv (a1) of 5 nm to 1,000 nm, and the second resin (a2) has a volume average particle diameter Dv (a2) of 5 nm to 1,000 nm.

<10> The toner according to <1>, wherein a volume average particle diameter Dv (a1) of the first resin (a1) and a volume average particle diameter Dv (a2) of the second resin (a2) satisfy the relationship Dv (a 1)<Dv (a2).

<11> The toner according to <1>, wherein the second resin (a2) has a glass transition temperature Tg (a2) of 55° C. to 100° C.

<12> The toner according to <1>, wherein the first resin (a1) has a weight average molecular weight Mw (a1) of 9,000 to 200,000, and the second resin (a2) has a weight average molecular weight Mw (a2) of 9,000 to 200,000.

<13> A developer including: a toner which includes a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton.

<14> The developer according to <13>, further including a carrier.

<15> An image forming method including: forming a latent electrostatic image on a latent electrostatic image bearing member; developing the latent electrostatic image using a toner so as to form a visible image; transferring the visible image to a recording medium; and fixing the transferred image to the recording medium, wherein the toner includes a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton.

<16> An image forming apparatus including: a latent electrostatic image bearing member; a latent electrostatic image forming unit configured to form a latent electrostatic image on the latent electrostatic image bearing member; a developing unit configured to develop the latent electrostatic image using a toner so as to form a visible image; a transfer unit configured to transfer the visible image to a recording medium; and a fixing unit configured to fix the transferred image to the recording medium, wherein the toner includes a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton.

<17> The toner according to <1>, wherein the first resin (a1) and the second resin (a2) cover a total of 5% or more of a surface of the resin particle (C).

<18> The toner according to <1>, wherein the total amount of the first resin (a1) and the second resin (a2), contained in the resin particle (C), is in the range of 0.01% by mass to 60% by mass, and the amount of the resin particle (B) which contains the third resin (b), contained in the resin particle (C), is in the range of 40% by mass to 99.99% by mass.

<19> The toner according to <6>, wherein the straight-chain polyester resin (O)) contained in the third resin (b) occupies 40% by mass to 100% by mass of the third resin (b).

<20> The toner according to <8>, wherein the precursor (b0) is a combination of a prepolymer (α) which contains a reactive group, and a curing agent (β).

<21> The toner according to <8>, wherein the resin (b2) obtained by reacting the precursor (b0) is formed in a step of forming the resin particle (C).

The present invention makes it possible to solve the problems in related art and provide: a toner which (even when polylactic acid is used in the toner) secures hot offset resistance and heat-resistant storage stability and is superior in low-temperature fixation properties, fluidity, image density, haze value, and charge stability against changes of use conditions such as temperature and humidity; a developer, an image forming method and an image forming apparatus, each including the toner.

DETAILED DESCRIPTION OF THE INVENTION

Toner

Figure 1:
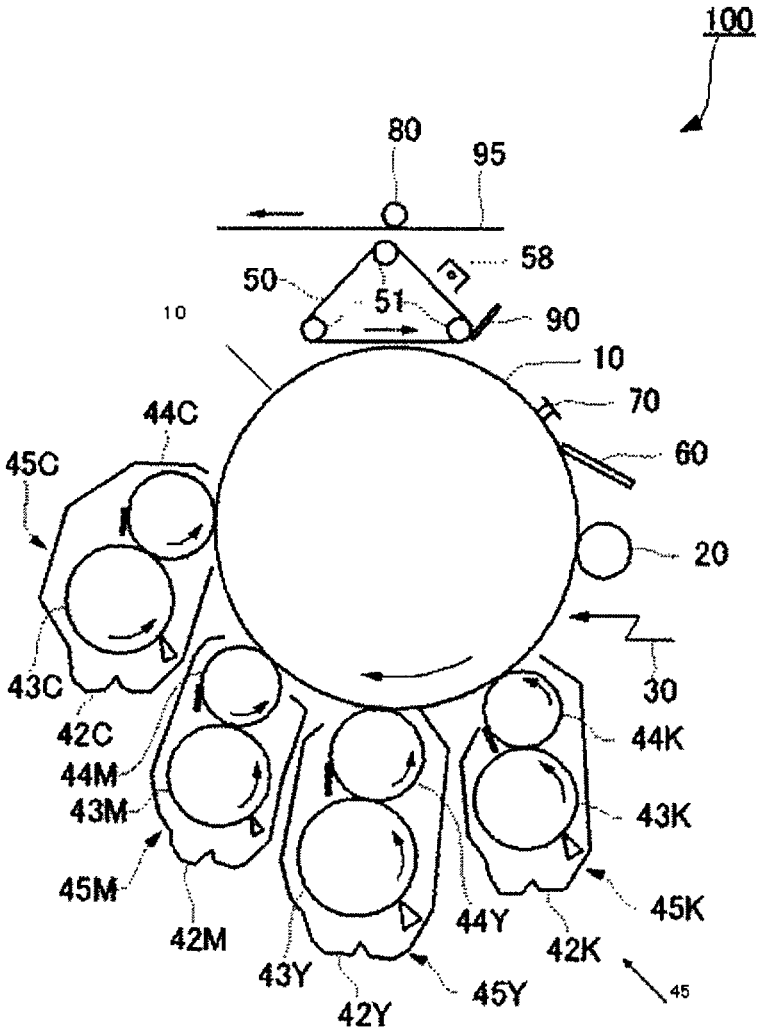
FIG. 1 is a schematic explanatory drawing showing an example of an image forming apparatus used in an image forming method of the present invention.

A toner of the present invention includes a resin particle (C) which contains a first resin (a1), a second resin (a2), and a resin particle (B), wherein the first resin (a1) and the second resin (a2) have mutually different glass transition temperatures, and the resin particle (B) contains a third resin (b). If necessary, the toner may further include other component(s).

In the present invention, each type of specific resin particle is mostly written in the singular for simplicity of explanation; note that each type of specific resin particle in the singular may refer to one particle or a plurality of particles. For example, "a resin particle (B)" may refer to one resin particle (B) or a plurality of resin particles (B).

<Resin Particle (B) and Third Resin (b)>

The resin particle (B) contains a resin (b) as a third resin, and may, if necessary, contain other component(s).

The shape, structure and size of the resin particle (B) are not particularly limited as long as the resin particle (B) contains the third resin (b) and is in the form of a particle. The resin particle (B) preferably has a volume average particle diameter Dv of 0.1 μm to 15 μm, more preferably 0.5 μm to 10 μm, even more preferably 1 μm to 8 μm, since the intended ratio of the volume average particle diameter Dv of the aftermentioned resin particles (A1) and (A2) to the volume average particle diameter Dv of the resin particle (B) can be easily obtained.

—Third Resin (b)—

The third resin (b) is not particularly limited as long as it has a polyhydroxycarboxylic acid skeleton. Examples of the third resin (b) include a resin obtained by polymerizing a hydroxycarboxylic acid in accordance with a method selected from a variety of methods, and a resin obtained by polymerizing a cyclic ester (as a starting material) capable of forming a resin having a polyhydroxycarboxylic acid skeleton.

—Hydroxycarboxylic Acid and Cyclic Ester—

Examples of the hydroxycarboxylic acid include aliphatic hydroxycarboxylic acids (such as glycolic acid, lactic acid and hydroxybutyric acid), aromatic hydroxycarboxylic acids (such as salicylic acid, creosotic acid, mandelic acid, vanillic acid and syringic acid), and mixtures thereof.

The cyclic ester capable of forming a resin having a polyhydroxycarboxylic acid skeleton is not particularly limited as long as it can produce a polyhydroxycarboxylic acid skeleton by means of ring-opening polymerization, and the cyclic ester may be suitably selected according to the intended purpose. Examples thereof include L-lactide, D-lactide, DL-lactide, racemic lactide, glycolide, γ-butyrolactone, δ-valerolactone, 6-valerolactone and ϵ-caprolactone. These may be used individually or in combination.

In terms of the transparency and thermal properties of the resin particle (C), preferable among these (as monomers which are each capable of forming a polyhydroxycarboxylic acid skeleton) are aliphatic hydroxycarboxylic acids, more preferably C3-C6 hydroxycarboxylic acids, even more preferably glycolic acid, lactic acid, glycolide and lactide, particularly glycolic acid, lactic acid and lactide. When the number of carbon atoms contained in a hydroxycarboxylic acid is less than three, it may be impossible for the obtained polyhydroxycarboxylic acid skeleton to have optical activity. When one or fewer carbon atom is contained in a hydroxycarboxylic acid, formation of a polyhydroxycarboxylic acid skeleton is virtually impossible. When the number of carbon atoms contained in a hydroxycarboxylic acid is more than six, there are many methylene chains contained therein, so that its glass transition temperature (Tg) lowers and thus use of the hydroxycarboxylic acid for a toner may possibly be difficult.

The method for synthesizing the third resin (b) is not particularly limited as long as a resin having a polyhydroxycarboxylic acid skeleton can be obtained from the starting material, and the method may be suitably selected according to the intended purpose. Examples thereof include a method of directly subjecting a hydroxycarboxylic acid to dehydration condensation, and a method of subjecting a relevant cyclic ester to ring-opening polymerization. Among these polymerization methods, a method of subjecting a cyclic ester to ring-opening polymerization is preferable in that the molecular weight of the polyhydroxycarboxylic acid obtained by polymerization can be increased. In the case where the third resin (b) is synthesized by subjecting a cyclic ester of a hydroxycarboxylic acid (as a starting material) to ring-opening polymerization, the polyhydroxycarboxylic acid skeleton of the resin (b) is a skeleton of a polymerized product of the hydroxycarboxylic acid constituting the cyclic ester. For example, the polyhydroxycarboxylic acid skeleton of the resin (b) obtained using lactide is a skeleton of polymerized lactic acid. Additionally, by also using appropriate amounts of an L-monomer and a D-monomer, an amorphous resin of a racemic mixture can be obtained. In the case where lactide is used, L-lactide and D-lactide may be mixed together; alternatively, meso-lactide may be subjected to ring-opening polymerization or mixed with either L-lactide or D-lactide.

The monomer forming the polyhydroxycarboxylic acid skeleton contained in the third resin (b) has optical activity. The resin (b) preferably has an optical purity X (%), represented by Equation (1) below, of 80% or less, more preferably 60% or less. When the optical purity X (%) is in this range, the solubility of the resin in solvent and the transparency of the resin improve.

$$\text{Optical purity } X(\%)=|X(L\text{-form})-X(D\text{-form})| \qquad \text{Equation (1)}$$

In Equation (1), X (L-form) denotes the proportion (mol %) of an L-form contained in the third resin (b), expressed as an optically-active monomer equivalent, and X (D-form) denotes the proportion (mol %) of a ID-form contained in the third resin (b), expressed as an optically-active monomer equivalent.

In the case where the monomer forming the polyhydroxycarboxylic acid skeleton is an optically-active monomer such as lactic acid, especially in the case where only the after-mentioned polyester resin (b1) is used as the resin (b), the optical purity X (%) is preferably 80% or less, more preferably 60% or less. When the optical purity X (%) is in this range, the solubility of the resin in solvent improves, and the after-mentioned Production Method (I), a preferred production method, can be suitably employed.

The method of measuring the optical purity X is not particularly limited and may be suitably selected according to the intended purpose. Nevertheless, the method is preferably as follows. First of all, a measurement target (e.g. a toner or a polymer which has a polyester skeleton) is added to a mixed solvent of purified water, 1 N sodium hydroxide and isopropyl alcohol, then heating and stirring are carried out at 70° C., and hydrolysis is carried out. Subsequently, the solution is filtered so as to remove the solid content present in the solution, then sulfuric acid is added for neutralization, and an aqueous solution containing L-lactic acid and/or D-lactic acid, into which a polyester resin has been decomposed, is thus obtained. Regarding this aqueous solution, the peak area S (L) corresponding to L-lactic acid and the peak area S (D) corresponding to the D-lactic acid were measured by means of a high-speed liquid chromatograph using the chiral ligand exchange column SUMICHIRAL OA-5000 (manufactured by Sumika Chemical Analysis Service, Ltd.). Based upon these peak areas, the optical purity X can be calculated as follows.

$$X(L\text{-form})(\%)=100\times S(L)/(S(L)+S(D))$$

$$X(D\text{-form})(\%)=100\times S(D)/(S(L)+S(D))$$

$$\text{Optical purity } X(\%)=|X(L\text{-form})-X(D\text{-form})|$$

When the third resin (b) is used, dispersion of a pigment and a wax into the resin can be easily made uniform. Also, because of the high transparency of the third resin (b), a favorable image density and a favorable haze value can be obtained when it is used for a toner which encases a pigment and a wax.

—Polyester Resin (b1)—

A polyester resin (b1) which may be contained in the third resin (b) is not particularly limited as long a it is a polyester resin having a polyhydroxycarboxylic acid skeleton, and the polyester resin (b1) may be suitably selected according to the intended purpose. For example, it may be a straight-chain polyester resin or a polyester resin with a branched chain. It is particularly preferably a straight-chain polyester resin (b1). The straight-chain polyester resin (b1) is superior in sharp melting capability and advantageous in terms of low-temperature fixation. Also, in comparison with a polyester resin with a branched chain, the straight-chain polyester resin is favorably soluble in solvent, low in viscosity when dissolved in the solvent, and thus favorable in handleability.

The method for producing the straight-chain polyester resin (b1) is not particularly limited as long as a polyester resin having a polyhydroxycarboxylic acid skeleton can be obtained. Nevertheless, it is preferably obtained by reacting together a polyester diol (b11) having a polyhydroxycarboxylic acid skeleton, and a polyester diol (b12) other than the polyester diol (b11), along with an elongation agent. By doing so, properties of the toner can be freely controlled. In particular, the solubility of the resin in solvent and the storage stability of the resin can be improved, and the fixation width can be increased.

—Polyester Diol (b11)—

The polyester diol (b11) having the polyhydroxycarboxylic acid skeleton is not particularly limited as long as it is a polyester having a polyhydroxycarboxylic acid skeleton and a diol in the molecule. For example, the polyester diol (b11) may be prepared by a copolymerization using a diol (11) together with the hydroxycarboxylic acid or the cyclic ester used for the polymerization of the resin (b).

The diol (11) is not particularly limited as long as it has two hydroxyl groups in the molecule, and it may be suitably selected according to the intended purpose. Examples thereof include 1,3-propanediol, 1,2-propylene glycol, 1,3-propylene glycol, 1,4-butanediol, 1,6-hexanediol, alkylene oxide (hereinafter, alkylene oxide is referred to also as "AO", or more specifically, ethylene oxide is referred to also as "EO", propylene oxide is referred to also as "PO", and butylene oxide is referred to also as "BO") adducts (number of moles of AO attached: 2 to 30) of bisphenols (bisphenol A, bisphenol F, bisphenol S, etc.), and combinations thereof. Among these, 1,2-propylene glycol, 1,3-propylene glycol, 1,3-propanediol, 1,4-butanediol and AO-adducts of bisphenol are preferable, particularly 1,3-propylene glycol and 1,3-propanediol.

—Polyester Diol (b12)—

The polyester diol (b12) other than the polyester diol (b11) is not particularly limited as long as it is a polyester diol which is different from the polyester diol (loll), and it may be suitably selected according to the intended purpose. For example, a reaction product of the diol (11) and a dicarboxylic acid (13), or any product similar to the reaction product may be used. Specifically, the polyester diol (b12) can be obtained by adjusting the mixture ratio of the diol to the dicarboxylic acid at the time of polymerization so as to make the amount of hydroxyl groups large. Preferred examples of the polyester diol (b12) include 1,2-propylene glycol, 1,3-propylene glycol, 1,4-butanediol, 1,6-hexanediol, AO (EO, PO, BO, etc.) adducts (number of moles of AO attached: 2 to 30) of bisphenols (bisphenol A, bisphenol F, bisphenol S, etc.), combinations thereof, and reaction products which are each composed of at least one of the foregoing and at least one of terephthalic acid, isophthalic acid, adipic acid, succinic acid and combinations thereof.

In view of adjustment of properties (e.g. solubility and glass transition temperature) of the polyester resin (b1), the polyester diol (b11) and the polyester diol (b12) each preferably have a number average molecular weight (hereinafter referred to also as "Mn") of 500 to 30,000, more preferably 1,000 to 20,000, even more preferably 2,000 to 5,000.

The elongation agent used for elongation of the polyester diol (b11) and the polyester diol (b12) is not particularly limited as long as it contains at least two functional groups which can react with hydroxyl groups contained in the polyester diols (b11) and (b12). Examples thereof include difunctional substances selected from the dicarboxylic acid (13), anhydrides thereof, polyisocyanate (15) and polyepoxide (19). Among these, diisocyanate compounds and dicarboxylic acid compounds are preferable, particularly diisocyanate compounds, in view of the compatibility between polyester diol (b11) and the polyester diol (b12). Specific examples thereof include succinic acid, adipic acid, maleic acid (and anhydrides thereof), fumaric acid (and anhydrides thereof), phthalic acid, isophthalic acid, terephthalic acid, 1,3-phenylene diisocyanate, 1,4-phenylene diisocyanate, 2,4-tolylene diisocyanate (TDI), 2,6-tolylene diisocyanate (T DI), 2,4'-diphenylmethane diisocyanate (MDI), 4,4'-diphenylmethane diisocyanate (MDI), hexamethylene diisocyanate (HDI), dicyclohexylmethane-4,4'-diisocyanate (water-added MDI), isophorone diisocyanate (IPDI) and bisphenol A diglycidyl ether. Preferable among these are succinic acid, adipic acid, isophthalic acid, terephthalic acid, maleic acid (and anhydrides thereof), fumaric acid (and anhydrides thereof), HDI and IPDI, particularly maleic acid (and anhydrides thereof), fumaric acid (and anhydrides thereof) and IPDI.

In view of transparency and thermal properties, the elongation agent contained in the polyester resin (b1) preferably occupies 0.1% by mass to 30% by mass, more preferably 1% by mass to 20% by mass, of the polyester resin (b1).

The amount of the straight-chain polyester resin (b1) contained in the resin (b) may be suitably adjusted according to the intended use. Nevertheless, in view of the transparency and thermal properties of the resin particle (C), the polyester resin (b1) preferably occupies 40% by mass to 100% by mass, more preferably 60% by mass to 90% by mass, of the resin (b). When the polyester resin (b1) occupies less than 40% by mass, the toner may not function properly because of the low resin content. When the polyester resin (b1) occupies less than 60% by mass, the low resin content may cause inferiority in terms of fixation properties, pigment dispersion capability and release agent dispersion capability. When the polyester resin (b1) occupies more than 90% by mass, it may be impossible for the toner to include adequate amounts of components other than the resins, such as a pigment, a release agent and a charge controlling agent, so that inferiority may be caused in terms of coloring capability, releasing capability and chargeability.

When the hydroxycarboxylic acid, a component of the polyester resin (b1), has an optical purity X (%), expressed as a hydroxycarboxylic acid monomer equivalent, of 80% or less, it is preferred in view of solvent solubility that the amount of the polyester resin (b1) (which contains an optically-active monomer) in the resin (b) be equal or nearly equal to the above-mentioned amount. When the hydroxycarboxylic acid has an optical purity X (%), expressed as a monomer equivalent, of more than 80%, it is preferred in view of solvent solubility that the amount (Y(%)) of the polyester resin (b1) in the resin (b) satisfy the relationship $Y \leq -1.5X + 220$. When this relationship is not satisfied, the solubility of the polyester resin (b1) in solvent decreases noticeably.

Regarding the polyester diol (b11) having the polyhydroxycarboxylic acid skeleton, and the polyester diol (b12) other than the polyester diol (b11), which constitute the straight-chain polyester resin (b1), the mass ratio of the polyester diol (b11) to the polyester diol (b12) is preferably in the range of 31:69 to 90:10. In view of the transparency and thermal properties of the resin particle (C), the mass ratio is more preferably in the range of 40:60 to 80:20. When the mass of the polyester diol (b11) is smaller than in the mass ratio 31:69, there may be a disadvantage in terms of low-temperature fixation properties. When the mass of the polyester diol (b11) is greater than in the mass ratio 90:10, there may be a disadvantage in terms of storage stability and environmental stability.

Component(s) other than the polyester resin (b1), contained in the resin (b), is/are not particularly limited and may be suitably selected according to the intended purpose. Examples of the component(s) include resins, which may be used in combination.

—Resin Other than Polyester Resin (b1), Contained in Resin (b)—

The resin other than the polyester resin (b1), also contained in the resin (b), may be any resin known in the art except the polyester resin (b1). The resin used in addition to the polyester resin (b1) may be suitably selected according to the intended use and purpose. Also, a resin thusly used in addition may be a resin (b2) obtained by reacting the after-mentioned precursor (b0) in the after-mentioned resin particle forming step. In view of facilitation of particle formation, inclusion of an additional resin with the use of the precursor (b0) is preferable. The precursor (b0) and a reaction method for obtaining the resin (b2) from the precursor (b0) may be as described later.

Preferred examples of resins used besides the polyester resin (b1) include vinyl resins, polyester resins, polyurethane resins, epoxy resins, and combinations thereof. Particularly preferable among these are polyurethane resins and polyester resins, more particularly polyester resins and polyurethane resins each containing 1,2-propylene glycol as a structural unit.

The amount of the resin other than the polyester resin (b1) may be suitably adjusted according to the intended use. Nevertheless, in view of the transparency and thermal properties of the resin particle (C), the resin preferably occupies 0% by mass to 60% by mass, more preferably 10% by mass to 40% by mass, of the resin (b).

—Precursor (A)—

The precursor (b0) is not particularly limited as long as it makes it possible to obtain the resin (b2). For example, the precursor (b0) may be a combination of a prepolymer (α) which contains a reactive groups (hereinafter referred to as "reactive group-containing prepolymer (α)") and a curing agent (β). Here, "reactive group" means a group which can react with the curing agent (β). In this case, examples of methods for forming the resin particle (B) which contains the resin (b2) obtained by reacting the precursor (b0) in a step of forming the resin particle (C) are as follows: a method of dispersing an oil phase which contains a reactive group-containing prepolymer (α) and a curing agent (β) and, if necessary, contains an organic solvent (u) into an aqueous dispersion liquid (W1) of a resin particle (A1), and reacting together the reactive group-containing prepolymer (α) and the curing agent (β) by heating so as to form a resin particle (B) which contains a resin (b2); a method of dispersing a reactive group-containing prepolymer (α), an organic solvent solution thereof or a dispersion liquid thereof into an aqueous dispersion liquid (W1) of a resin particle (A1), adding a water-soluble curing agent (β) to the obtained dispersion liquid and thus effecting reaction so as to form a resin (B) which contains a resin (b2); (in the case where a reactive group-containing prepolymer (α) reacts with water and thereby hardens) a method of dispersing a reactive group-containing prepolymer (a), an organic solvent solution thereof or a dispersion liquid thereof into an aqueous dispersion liquid (W1) of a resin particle (A1) so as to react with water, thereby forming a resin particle (B) which contains a resin (b2).

Examples of the combination of the reactive group contained in the reactive group-containing prepolymer (α), and the curing agent (β) include the combinations denoted by [1] and [2] below.

[1] A combination in which the reactive group, contained in the reactive group-containing prepolymer (α), is a functional group (α1) capable of reacting with an active hydrogen compound, and the curing agent (β) is an active hydrogen group-containing compound (β).

[2] A combination in which the reactive group, contained in the reactive group-containing prepolymer (α), is an active hydrogen-containing group (α2), and the curing agent (β) is a compound (β2) capable of reacting with an active hydrogen-containing group.

—Reactive Group-Containing Prepolymer (α) and Curing Agent (β)—

Regarding these combinations, the combination denoted by [1] is preferable in view of its reaction rate in water. Regarding the combination denoted by [1], examples of the functional group (α1) capable of reacting with the active hydrogen compound include isocyanate group (α1a), blocked isocyanate group (α1b), epoxy group (α1c), acid anhydride group (α1d) and acid halide group (α1e). Among these, isocyanate group (α1a), blocked isocyanate group (α1b) and epoxy group (α1c) are preferable, particularly isocyanate group (α1a) and blocked isocyanate group (α1b).

The blocked isocyanate group (α1b) is an isocyanate group blocked with a blocking agent. Examples of the blocking agent include oximes such as acetoxime, methyl isobutyl ketoxime, diethyl ketoxime, cyclopentanone oxime, cyclohexanone oxime and methyl ethyl ketoxime; lactams such as γ-butyrolactam, ε-caprolactam and γ-valerolactam; C1-C20 aliphatic alcohols such as ethanol, methanol and octanol; phenols such as phenol, cresol, xylenol and nonylphenol; active methylene compounds such as acetyl acetone, ethyl malonate and ethyl acetoacetate; basic nitrogen-containing compounds such as N,N-diethylhydroxyamine, 2-hydroxypyridine, pyridine-N-oxide and 2-mercaptopyridine; and mixtures which are each composed of two or more of these. Among these, preference is given to oximes, particularly methyl ethyl ketoxime.

Examples of the material for the skeleton of the reactive group-containing prepolymer (α) include polyethers (αw), polyesters (αx), epoxy resins (αy) and polyurethanes (αz). Among these, polyesters (αx), epoxy resins (αy) and polyurethanes (αz) are preferable, particularly polyesters (αx) and polyurethanes (αz).

Examples of the polyethers (αw) include polyethylene oxide, polypropylene oxide, polybutylene oxide and polytetramethylene oxide. Examples of the polyesters (αx) include polycondensates of the diol (10 and the dicarboxylic acid (13), and polylactones (ring-opening polymerization products of ε-caprolactone). Examples of the epoxy resins (αy) include addition condensation products of bisphenols bisphenol A, bisphenol F, bisphenol S, etc.) and epichlorohydrin. Examples of the polyurethanes (αz) include polyaddition products of the diol (11) and the polyisocyanate (15), and polyaddition products of the polyesters (αx) and the polyisocyanate (15).

Examples of methods of allowing the polyesters (αx), the epoxy resins (αy), the polyurethanes (αz), etc. to contain reactive groups include the methods denoted by [1] and [2] below.

[1] A method in which one of two or more components is excessively used so as to allow a functional group of the component to remain at a terminal.

[2] A method in which one of two or more components is excessively used so as to allow a functional group of the component to remain at a terminal, and the remaining functional group is reacted with a compound containing a reactive group and a functional group capable of reacting with the remaining functional group.

In the method denoted by [1] above, a hydroxyl group-containing polyester prepolymer, a carboxyl group-containing polyester prepolymer, an acid halide group-containing polyester prepolymer, a hydroxyl group-containing epoxy resin prepolymer, an epoxy group-containing epoxy resin prepolymer, a hydroxyl group-containing polyurethane prepolymer, isocyanate group-containing polyurethane prepolymer, or the like is obtained. As for the constitutional ratio, for example in the case of a hydroxyl group-containing polyester prepolymer, the ratio of a polyol (1) to a polycarboxylic acid (2), expressed as the equivalence ratio [OH]/[COOH] of the hydroxyl group [OH] to the carboxyl group [COOH] is preferably in the range of 2/1 to 1/1, more preferably 1.5/1 to 1/1, even more preferably 1.3/1 to 1.02/1. In cases of prepolymers with other skeletons and/or terminal groups, constituents are different but the ratio is close to the above-mentioned ratio.

In the method denoted by [2] above, an isocyanate group-containing prepolymer, a blocked isocyanate group-containing prepolymer, an epoxy group-containing prepolymer and an acid anhydride group-containing prepolymer are obtained by reacting the prepolymer obtained in [1] with a polyisocyanate, a blocked polyisocyanate, a polyepoxide and a polyacid anhydride respectively. As for the amount of the compound containing the reactive group and the functional group, in the case where, for example, an isocyanate group-containing polyester prepolymer is obtained by reacting a hydroxyl group-containing polyester with a polyisocyanate, the ratio of the polyisocyanate in the prepolymer, expressed as the equivalence ratio [NCO]/[OH] of the isocyanate group [NCO] to the hydroxyl group [OH] contained in the hydroxyl group-containing polyester, is preferably in the range of 5/1 to 1/1, more preferably 4/1 to 1.2/1, even more preferably 2.5/1 to 1.5/1. In cases of prepolymers with other skeletons and/or terminal groups, constituents are different but the ratio is close to the above-mentioned ratio.

The number of reactive groups contained in the reactive group-containing prepolymer (α) per molecule is preferably 1 or more, more preferably in the range of 1.5 to 3 on average, even more preferably 1.8 to 2.5 on average. When the number is in the above-mentioned range, a cured product obtained by reacting the prepolymer (α) with the curing agent (0 can have a high molecular weight, which is favorable in terms of offset resistance.

The number average molecular weight (Mn) of the reactive group-containing prepolymer (α) is not particularly limited and may be suitably selected according to the intended purpose. Nevertheless, it is preferably in the range of 500 to 30,000, more preferably 1,000 to 20,000, even more preferably 2,000 to 10,000. When the Mn is less than 500, the resin (b2) does not have a sufficient molecular weight and thus may lack hot offset resistance. When the Mn is greater than 30,000, the softening temperature of the resin (b2) increases, which may cause a disadvantage in terms of low-temperature fixation properties.

The weight average molecular weight (Mw) of the reactive group-containing prepolymer (α) is not particularly limited and may be suitably selected according to the intended purpose. Nevertheless, it is preferably in the range of 1,000 to 50,000, more preferably 2,000 to 40,000, even more preferably 4,000 to 20,000. When the Mn is less than 1,000, the resin (b2) does not have a sufficient molecular weight and thus may lack hot offset resistance. When the Mn is greater than 50,000, the softening temperature of the resin (b2) increases, which may cause a disadvantage in terms of low-temperature fixation properties.

The viscosity of the reactive group-containing prepolymer (α) is not particularly limited and may be suitably selected according to the intended purpose. Nevertheless, it is preferably 2,000 poises or less, more preferably 1,000 poises or less, at 100° C. When the viscosity is 2,000 poises or less at 100° C., it is preferable because the resin particle (C) with a sharp particle size distribution can be obtained with a small amount of organic solvent.

In the present invention, the curing agent (β) is not particularly limited as long as it reacts with the reactive group-containing prepolymer (α) and thereby yields the resin (b2). As mentioned above, examples of the curing agent (β) include the active hydrogen group-containing compound (β1), and the compound (β2) capable of reacting with a active hydrogen-containing group.

Examples of the active hydrogen group-containing compound (β1) include polyamines (β1a) which may be blocked with desorbable compounds, polyols (β1b), polymercaptans (β1c) and water (β1d). Among these, polyamines (β1a), polyols (β1b) and water (β1d) are preferable, particularly polyamines (β1a) and water (β1d), more particularly blocked polyamines and water (β1d).

Examples of the polyamines (β1a) include aliphatic polyamines (C2 to C18) such as [1] aliphatic polyamines {C2-C6 alkylenediamines (ethylenediamine, propylenediamine, trimethylenediamine, tetramethylenediamine, hexamethylenediamine, etc.), polyalkylene (C2-C6) polyamines [diethylenetriamine, iminobispropylamine, bighexamethylenehriamine, triethylenetetramine, tetraethylenepentamine, pentaethylenehexamine, etc.]}; [2] alkyl (C1-C4) or hydroxyalkyl (C2-C4) substitution products of the above aliphatic polyamines [dialkyl(C1-C3) aminopropylamines, trimethylhexamethylenediamine, aminoethylethanolamine, 2,5-dimethyl-2,5-hexamethylenediamine, methyliminobispropylamine, etc.]; [3] alicyclic or heterocyclic ring-containing aliphatic polyamines[3,9-bis(3-aminopropyl)-2,4,8,10-tetraoxaspiro[5,5] undecane, etc.]; [4] aromatic ring-containing aliphatic amines (C8-C15) (xylylenediamine, tetrachloro-p-xylylenediamine, etc.), alicyclic polyamines (C4-C15) such as 1,3-diaminocyclohexane, isophoronediamine, menthenediamine, 4,4'-methylenedicyclohexanediamine (hydrogenated methylenedianiline), etc., and heterocyclic polyamines (C4-C15) such as piperazine, N-aminoethylpiperazine, 1,4-diaminoethylpiperazine and 1,4-bis(2-amino-2-methylpropyl)piperazine. Examples of the polyamines (β1a) also include aromatic polyamines (C6-C20) such as [1] unsubstituted aromatic polyamines [1,2-phenylenediamine, 1,3-phenylenediamine, 1,4-phenylenediamine, 2,4'-diphenylmethanediamine, 4,4'-diphenylmethanediamine, crude diphenylmethanediamine (polyphenylpolymethylenepolyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, naphthylenediamine, etc.]; [2] aromatic polyamines containing nuclear-substituted alkyl groups [C1-C4 alkyl group such as methyl group, ethyl group, n-propyl group and i-propyl group], such as 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3,5,5-tetramethylbenzidine, 3,3,5,5-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4-diamino-3,3'-dimethyldiphenylmethane, 3,3,5,5-tetraethyl-4,4-diaminobenzophenone, 3,3,5,5-tetraethyl-4,4'-diaminodiphenylether, 3,3,5,5-tetraisopropyl-4,4'-diaminodiphenylsulfone, etc.], and mixtures of various proportions of isomers of these aromatic polyamines; [3] aromatic polyamines containing nuclear-substituted electron-withdrawing groups (halogen groups such as Cl group, Br group, I group and F group; alkoxy groups such as methoxy group and ethoxy group; nitro group; etc.), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3-dichlorobenzidine, 3,3-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4-methylenebis(2-iodoaniline), 4,4-methylenebis(2-bromoaniline), 4,4-methylenebis(2-fluoroaniline), 4-aminophenyl-2-chloroaniline, etc.; and [4] secondary amino group-containing aromatic polyamines [polyamines obtained by replacing some or all of —$NH_2$ groups in the aromatic polyamines of to [3] with —NH—R' groups (R' denotes a lower alkyl group such as methyl group or ethyl group)], such as 4,4'-di(methylamino)diphenylmethane, 1-methyl-2-methylamino-4-aminobenzene), etc., polyamide polyamines such as low-molecular-weight polyamide polyamines obtained by condensation between dicarboxylic acids (e.g. dimer acids) and excess amounts (2 moles or more per mole of acid) of polyamines (e.g., the above-mentioned alkylenediamines and polyalkylenepolyamines), and hydrogenated products of cyanoethylated products of polyether polyols (e.g. polyalkyleneglycols). Preferable among these examples of the polyamines (β1a) are 4,4'-diaminodiphenyl methane, xylylenediamine, isophoronediamine, ethylenediamine, diethylene triamine, diethylenetriamine, triethylenetetramine, and mixtures thereof.

Examples of the polyamines (β1a), in the case where the polyamines (β1a) are blocked with desorbable compounds, include ketimine compounds obtained from the above-mentioned polyamines and C3-C8 ketones (e.g. acetone, methyl ethyl ketone and methyl isobutyl ketone), aldimine compounds obtained from the above-mentioned polyamines and C2-C8 aldehyde compounds (e.g. formaldehyde and acetaldehyde), enamine compounds and oxazolidine compounds.

Examples of the polyols (β1b) include diols and polyols. Examples of the diols include C2-C36 alkylene glycols (e.g. ethylene glycol, 1,2-propylene glycol, 1,3-propylene glycol, 1,4-butanediol, 1,6-hexanediol, octanediol, decanediol, dodecanediol, tetradecanediol, neopentyl glycol and 2,2-diethyl-1,3-propanediol); C4-C36 alkylene ether glycols (e.g. diethylene glycol, triethylene glycol, dipropylene glycol, polyethylene glycol, polypropylene glycol and polytetramethylene ether glycol); C4-C36 alicyclic diols (e.g., 1,4-cyclohexanedimethanol and hydrogenated bisphenol A); AO (EO, PO, BO, etc.) adducts (number of moles of AO attached: 1 to 120) of the alkylene glycols or the alicyclic diols; AO (EO, PO, BO, etc.) adducts (number of moles of AO attached: 2 to 30) of bisphenols (e.g. bisphenol A, bisphenol F and bisphenol S); polylactone diols (e.g. poly ε-caprolactone diol); and polybutadiene diols. Examples of the polyols include C3-C36 trihydric to octahydric or higher aliphatic alcohols (alkane polyols, and intramolecular or intermolecular dehydration products thereof, such as glycerin, trimethylolethane, trimethylolpropane, pentaerythritol, sorbitol, sorbitan and polyglycerin; sugars and derivatives thereof, such as sucrose and methylglucoside); AO adducts (number of moles of AO attached: 2 to 120) of polyhydric aliphatic alcohols; AO adducts (number of moles of AO attached: 2 to 30) of trisphenols (e.g. trisphenol PA); AO adducts (number of moles of AO attached: 2 to 30) of novolac resins (e.g. phenol novolac, and cresol novolac); and acrylic polyols [e.g. copolymers of hydroxyethyl(meth)acrylate and other vinyl monomers]. Among these, use of any of the diols alone, or a mixture of any of the diols and a small amount of any of the polyols is preferable.

Examples of the polymercaptan (β1c) include ethylene diol, 1,4-butanedithiol and 1,6-hexanedithiol.

If necessary, a reaction terminator (βs) may be used together with the active hydrogen group-containing compound (β1). By also using the reaction terminator (βs) such that the ratio of the reaction terminator (βs) to the compound (β1) is kept constant, the molecular weight of the resin (b2) can be adjusted to a predetermined molecular weight. Examples of the reaction terminator (βs) include monoamines (such as diethylamine, dibutylamine, butylamine, laurylamine, monoethanolamine and diethanolamine); blocked monoamines (such as ketimine compounds); monools (such as methanol, ethanol, isopropanol, butanol and phenol); monomercaptans (such as butylmercaptan and laurylmercaptan); monoisocyanates (such as lauryl isocyanate and phenyl isocyanate); and monoepoxides (such as butyl glycidyl ether).

Regarding the combination denoted by [2] above, examples of the active hydrogen-containing group (α2), contained in the reactive group-containing prepolymer (α), include amino group (α2a), hydroxyl groups (alcoholic hydroxyl group and phenolic hydroxyl group) (α2b), mercapto group (α2c), carboxyl group (α2d), and organic groups (α2e) obtained by blocking these groups with desorbable compounds. Preferable among these are amino group (α2a), hydroxyl groups (alcoholic hydroxyl group and phenolic hydroxyl group) (α2b), and organic groups (a2e) obtained by blocking amino groups with desorbable compounds, particularly hydroxyl groups (alcoholic hydroxyl group and phenolic hydroxyl group) (α2b). Examples of the organic groups obtained by blocking amino groups with desorbable compounds are similar to those explained in relation to the polyamines (β1a).

Examples of the compound (β2) capable of reacting with the active hydrogen-containing group include polyisocyanates (β2a), polyepoxides (β2b), polycarboxylic acids (β2c), polycarboxylic acid anhydrides (β2d) and polyacid halides (β2e). Preferable among these are polyisocyanates (β2a) and polyepoxides (β2b), particularly polyisocyanates (β2a).

Examples of the polyisocyanates (β2a) include C6-C20 aromatic polyisocyanates (the carbon atom in the NCO group is not included in the number of carbon atoms shown; this applies in the following instances as well), C2-C18 aliphatic polyisocyanates, C4-C15 alicyclic polyisocyanates, C8-C15 aromatic-aliphatic polyisocyanates, and modified products (e.g. urethane group-containing, carbodiimide group-containing, allophanate group-containing, urea group-containing, biuret group-containing, urethdione group-containing, urethimine group-containing, isocyanurate group-containing, oxazolidone group-containing, etc. modified products) of these polyisocyanates, and mixtures which are each composed of two or more of these. Preferable among these are C6-C15 aromatic polyisocyanates, C4-C12 aliphatic polyisocyanates and C4-C15 alicyclic polyisocyanates.

Examples of the polyepoxides (β2b) include aromatic polyepoxy compounds, heterocyclic polyepoxy compounds, alicyclic polyepoxy compounds and aliphatic polyepoxy compounds. Preferable among these are aromatic polyepoxy compounds and aliphatic polyepoxy compounds.

Examples of the polycarboxylic acids (β2c) include dicarboxylic acids (β2c-1) and trivalent or higher polycarboxylic acids (β2c-2). Use of any of the dicarboxylic acids (β2c-1) alone, and use of a mixture of any of the dicarboxylic acids (β2c-1) and a small amount of any of the trivalent or higher polycarboxylic acids (β2c-2) are preferable. Examples of the dicarboxylic acids (β2c-1) include C4-C36 alkane dicarboxylic acids (e.g. succinic acid, adipic acid, sebacic acid, azelaic acid, dodecanedicarboxylic acid, octadecanedicarboxylic acid and decylsuccinic acid) and alkenylsuccinic acids (e.g. dodecenylsuccinic acid, pentadecenylsuccinic acid and octadecenylsuccinic acid); C6-C40 alicyclic dicarboxylic acids [dimer acids (dimerized linoleic acid), etc.]; C4-C36 alkenedicarboxylic acids (e.g. maleic acid, fumaric acid and citraconic acid); C8-C36 aromatic dicarboxylic acids (e.g. phthalic acid, isophthalic acid, terephthalic acid and naphthalenedicarboxylic acid). Preferable among these are C4-C20 alkenedicarboxylic acids and C8-C20 aromaticdicarboxylic acids. Examples of the polycarboxylic acids (β2c-2) include C9-C20 aromatic polycarboxylic acids (e.g. trimellitic acid and pyromellitic acid).

Examples of the polycarboxylic acid anhydrides (β2d) include pyromellitic acid; anhydride. Examples of the polyacid halides (β2e) include acid halides (e.g. acid chlorides, acid bromides and acid iodides) of the (β2c). If necessary, the reaction terminator (βs) may be used together with the compound (β2) capable of reacting with an active hydrogen-containing group.

Regarding the combinations denoted by [1] and [2] above, as for the ratio of the reactive group-containing prepolymer (α) to the curing agent (β), the ratio ([α]/[β]) of the equivalent amount [α] of reactive groups contained in the reactive group-containing prepolymer (α) to the equivalent amount [β] of active hydrogen-containing groups contained in the curing agent (β) is preferably in the range of 1/2 to 2/1, more preferably 1.5/1 to 1/1.5, even more preferably 1.2/1 to 1/1.2. When the curing agent (β) is the water (β1d), the water is regarded as a divalent active hydrogen compound.

The resin (b2) obtained by reacting the precursor (b0), which contains the reactive group-containing prepolymer (α) and the curing agent (β), in an aqueous medium is a component of the resin particles (B) and (C). The weight average molecular weight (Mw) of the resin (b2) obtained by reacting together the reactive group-containing prepolymer (α) and the curing agent (β) is not particularly limited. Nevertheless, in view of low-temperature fixation properties and hot offset resistance, it is preferably 3,000 or greater, more preferably in the range of 3,000 to 10,000,000, even more preferably 5,000 to 1,000,000. When the Mw is less than 3,000, sufficient hot offset resistance may not be obtained. When the Mw is greater than 1,000,000, there may be a disadvantage in terms of low-temperature fixation properties.

Also, by inclusion of a so-called "dead polymer" (polymer which reacts with neither the reactive group-containing prepolymer (α) such as the straight-chain polyester resin (b1) nor the curing agent (β) in the system when the reactive group-containing prepolymer (α) and the curing agent (β) are reacted together in the aqueous medium, the resin (b) becomes a mixture of the resin (b2) obtained by reacting the reactive group-containing prepolymer (α) and the curing agent (β) in the aqueous medium, and an unreacted resin such as the straight-chain polyester resin (b1).

The amount of the aqueous dispersion liquid (W1) used per 100 parts by mass of the resin (b) is preferably in the range of 50 parts by mass to 2,000 parts by mass, more preferably 100 parts by mass to 1,000 parts by mass. When the amount is 50 parts by mass or greater, the dispersed state of the (b) is favorable. When the amount is 2,000 parts by mass or less, it is economical.

The properties of the resin (b) are not particularly limited and may be suitably selected according to the intended use. Examples of the properties include the number average molecular weight (Mn) (measured by means of gel permeation chromatography), the weight average molecular weight (Mw) (hereinafter referred to also as "Mw"), the melting point (measured by means of a differential scanning calorimeter (DSC)), the glass transition temperature (hereinafter referred to also as "Tg"), and the solubility parameter value (hereinafter referred to as "sp value") (the sp value is calculated in accordance with Polymer Engineering and Science, Feburuary, 1974, Vol. 14, No. 2 P. 147 to 154).

In particular, the Mn of the resin (b) is preferably in the range of 1,000 to 5,000,000, more preferably 2,000 to 500,000. The Mw of the resin (b) is preferably in the range of 3,000 to 7,000,000, more preferably 5,000 to 600,000. The melting point of the resin is preferably in the range of 20° C. to 300° C., more preferably 80° C. to 250° C. Tg of the resin (b) is preferably in the range of 20° C. to 200° C., more preferably 40° C. to 200° C. The sp value of the resin (b) is preferably in the range of 8 to 16, more preferably 9 to 14.

In the present invention, the number average molecular weight (Mn) and the weight average molecular weight (Mw) of resins such as polyester resins, other than polyurethane resins, are measured by means of gel permeation chromatography (GPC) under the following conditions, with respect to the resins soluble in tetrahydrofuran (THF).

Apparatus (example): HLC-8120, manufactured by TOSOH CORPORATION
Column (example): TSKgel GMHXL (two columns)
TSKgel Multipore HXL-M (one column)
Sample solution: 0.25% THF solution
Amount of solution injected: 100 μL
Flow amount: 1 mL/min
Measurement temperature: 40° C.
Detection apparatus: refractive index detector
Reference substance: 12 standard polystyrenes, manufactured by TOSOH CORPORATION (TSK STANDARD POLYSTYRENE) (molecular weight: 500, 1,050, 2,800, 5,970, 9,100, 18,100, 37,900, 96,400, 190,000, 355,000, 1,090,000 and 2,890,000)

The Mn and Mw of polyurethane resins can be measured by means of GPC under the following conditions.

Apparatus (example): HLC-8220 GPC, manufactured by TOSOH CORPORATION
Column (example): GUARD COLUMN α TSK GEL α-M
Sample solution: 0.125% dimethyl formamide solution
Amount of solution injected: 100 μL
Flow amount: 1 mL/min
Measurement temperature: 40° C.
Detection apparatus: refractive index detector
Reference substance: 12 standard polystyrenes, manufactured by TOSOH CORPORATION (TSK STANDARD POLYSTYRENE) (molecular weight: 500, 1,050, 2,800, 5,970, 9,100, 18,100, 37,900, 96,400, 190,000, 355,000, 1,090,000 and 2,890,000)

In the present invention, the melting point and the Tg are calculated from DSC measurement, or measurement with a flow tester (in the case where DSC measurement is impossible).

In the case of DSC measurement, the melting point and the Tg are measured by the method (DSC method) prescribed in ASTM D3418-82, using DSC 20 and SSC/580, manufactured by Seiko Instruments & Electronics Ltd.

In the case of measurement with a flow tester, the elevated flow tester CFT 500, manufactured by SHIMADZU CORPORATION. The conditions under which the flow tester is used are as follows. The after-mentioned measurements with the flow tester are all carried out under the conditions below.

[Conditions for Measurement with Flow Tester]
Load: 30 kg/cm$^2$
Temperature increase rate: 3.0° C./min
Die diameter: 0.50 mm
Die length: 10.0 mm <Resin (a1) and Resin (a2)>

The toner of the present invention includes the first resin (a1) and the second resin (a2) which have mutually different glass transition temperatures. The resin (a1) and the resin (a2) are attached to a surface of the resin particle (B). The shapes, structures and sizes of the resin (a1) and the resin (a2) are not particularly limited and may be suitably selected according to the intended purpose. For the purpose of securing a favorable balance between heat-resistant storage stability and low-temperature fixation properties, the two different types of resin particles (A1) and (A2) are used, at least one of which gives heat-resistant storage stability to the toner, and at least one of which gives low-temperature fixation properties to the toner. It is preferred that the resin particles (A1) and (A2) be present on the surface of the resin particle (B), or the resin particles (A1) and (A2) be formed into coating films (P1) and (P2) respectively and present on the surface of the resin particle (B). In the case where the resins (a1) and (a2) are present as the resin particles (A1) and (A2) respectively on the surface of the resin particle (B), the resins (a1) and (a2) are satisfactory as long as they are in the form of particles. In the case where the resins (a1) and (a2) are present as the coating films (P1) and (P2) respectively on the surface of the resin particle (B), the resins (a1) and (a2) are satisfactory as long as they are in the form of films. Regarding the toner of the present invention, as described later, whether the reins (a1) and (a2) are present as the resin particles (A1) and (A2) respectively or present as the coating films (P1) and (P2) respectively depends upon the Tg and volume average particle diameters of the resins (a1) and (a2), and production conditions (e.g. temperature for solvent removal) of the resin particle (C).

—Resin Particle (A1) and Resin Particle (A2)—

It is preferred, in view of thermal properties suitable for the toner, that the resin (a1) and the resin (a2) attached to the surface of the resin particle (B) each contain any one selected from a styrene-acrylic resin, a polyester resin and a urethane-acrylic resin. The resins (a1) and (a2) can be formed by a polymerization method known in the art and are preferably obtained as the resin particles (A1) and (A2) respectively. This is because when obtained as the resin particles, the resins (a1) and (a2) can be easily attached to the surface of the resin particle (B).

It is inferred that when an organic solvent or an active hydrogen-containing compound (an amine) is dispersed in an aqueous medium and a fine organic dispersion particle is formed, the resin particle (A1) bonds to a surface portion of the fine organic dispersion particle, and thus the resin particle is present primarily at a surface portion of an obtained toner particle. The resin particle (A2) is bonded to a surface portion of a toner particle in a subsequent step, i.e. a constricting step.

The particle diameters of the resin particles (A1) and (A2) are generally smaller than the particle diameter of the formed resin particle (B). In view of particle diameter uniformity, the particle diameter ratio, expressed as [Volume average particle diameter (Dv) of resin particle (A1) or resin particle (A2)]/[Volume average particle diameter (Dv) of resin particle (B)], is preferably in the range of 0.001 to 0.3. The lower limit of the particle diameter ratio is preferably 0.003, and the upper limit of the particle diameter ratio is preferably 0.25. When the particle diameter ratio is greater than 0.3, the resin particles (A1) and (A2) does not efficiently adsorb to the surface of the resin particle (B), so that it is possible that the particle size distribution of the obtained resin particle (C) may widen and the heat-resistant storage stability of the toner may degrade.

The volume average particle diameters (Dv) of the resin particles (A1) and (A2) may be suitably adjusted with the above-mentioned range of the particle diameter ratio maintained, such that their particle diameters are suitable for obtaining the resin particle (C) having the after-mentioned desired particle diameter. The volume average particle diameter (Dv (A1)) of the resin particle (A1) and the volume average particle diameter (Dv (A2)) of the resin particle (A2) preferably satisfy Relationship (2) below. When the volume average particle diameter (Dv (A1)) of the resin particle (A1) is larger than the volume average particle diameter (Dv (A2)) of the resin particle (A2), a surface of the resin particle (A1) is densely covered by the resin particle (A2), and thus low-temperature fixation properties may degrade.

$$Dv(A1)<Dv(A2) \qquad \text{Relationship (2)}$$

In general, the volume average particle diameters (Dv) of the resin particle (A1) and the resin particle (A2) are preferably in the range of 0.005 μm to 1 μm. The upper limit of the volume average particle diameters (Dv) is more preferably 0.75 μm, particularly preferably 0.6 μm. The lower limit of the volume average particle diameters (Dv) is more preferably 0.01 μm, particularly preferably 0.02 μm, even more preferably 0.04 μm. In the case where the resin particle (C) with a volume average particle diameter of 1 μm is to be obtained, the volume average particle diameters (Dv) of the resin particles (A1) and (A2) are preferably in the range of 0.005 μm to 0.30 μm, more preferably 0.01 μm to 0.2 μm. In the case where the resin particle (C) with a volume average particle diameter of 10 μm is to be obtained, the volume average particle diameters (Dv) of the resin particles (A1) and (A2) are preferably in the range of 0.05 μm to 0.8 μm, more preferably 0.1 μm to 1 μm. Parenthetically, the volume average particle diameters can, for example, be measured by the laser particle size distribution measuring apparatus LA-920 (manufactured by HORIBA, Ltd.), MULTISIZER III (manufactured by Coulter Corporation), and ELS-800 (manufactured by Otsuka Electronics Co., Ltd.) which employs a laser Doppler method for an optical system. In case there are differences between these measuring apparatuses in terms of obtained measurement values of particle diameters, the measurement value obtained using ELS-800 is employed.

The resins (a1) and (a2) can be formed using a polymerization method known in the art. It is preferred that they be obtained as aqueous dispersion liquids of the resin particles (A1) and (A2) respectively. This is because since the toner of the present invention can be produced using a dissolution suspension method, the resin particles (A1) and (A2) in the form of aqueous dispersion liquids can uniformly disperse into an aqueous phase or emulsion even when directly added, and can be uniformly adsorbed to the surface of the resin particle (B) with ease. Examples of the method of preparing the aqueous dispersion liquids of the resin particles include the methods denoted by (i) to (vi) below.

(i) A method in which a vinyl monomer as a starting material is subjected to a polymerization reaction which is any one of suspension polymerization, emulsion polymerization, sheet polymerization and dispersion polymerization, and an aqueous dispersion liquid of a resin particle thus directly prepared.

(ii) A method in which a resin synthesized beforehand by a polymerization reaction (e.g. addition polymerization, ring-opening polymerization, polyaddition, addition condensation, condensation polymerization, etc.) is pulverized using a finely pulverizing machine such as a mechanical rotary pulverizer or jet pulverizer and classified so as to obtain a resin particle, then the resin particle is dispersed in water in the presence of a certain dispersant, and an aqueous dispersion liquid of the resin particle is thus prepared.

(iii) A method in which a resin synthesized beforehand by a polymerization reaction (e.g. addition polymerization, ring-opening polymerization, polyaddition, addition condensation, condensation polymerization, etc.) is dissolved in a solvent so as to obtain a resin solution, the resin solution is sprayed in the form of mist so as to form a resin particle, then the resin particle is dispersed in water in the presence of a certain dispersant, and an aqueous dispersion liquid of the resin particle is thus prepared.

(iv) A method in which a resin synthesized beforehand by a polymerization reaction (e.g. addition polymerization, ring-opening polymerization, polyaddition, addition condensation, condensation polymerization, etc.) is dissolved in a solvent so as to obtain a resin solution, and a poor solvent is added to the resin solution so as to precipitate a resin particle; alternatively, a resin solution obtained beforehand by dissolving a resin in a solvent with heating is cooled so as to precipitate a resin particle; subsequently, the solvent is removed so as to form a resin particle, then the resin particle is dispersed in water in the presence of a certain dispersant, and an aqueous dispersion liquid of the resin particle is thus prepared.

(v) A method in which a resin synthesized beforehand by a polymerization reaction (e.g. addition polymerization, ring-opening polymerization, polyaddition, addition condensation, condensation polymerization, etc.) is dissolved in a solvent so as to obtain a resin solution, the resin solution is dispersed in an aqueous medium in the presence of a certain dispersant, then the solvent is removed by heating, pressure reduction, etc., and an aqueous dispersion liquid of a resin particle is thus prepared.

(vi) A method in which a resin synthesized beforehand by a polymerization reaction (e.g. addition polymerization, ring-opening polymerization, polyaddition, addition condensation, condensation polymerization, etc.) is dissolved in a solvent so as to obtain a resin solution, a certain emulsifier is dissolved in the resin solution, then water is added so as to effect phase-Inversion emulsification, and an aqueous dispersion liquid of a resin particle is thus prepared.

In the present invention, the resins (a1) and (a2) are not particularly limited as long as they each contain any one selected from a styrene-acrylic resin, a polyester resin and a urethane-acrylic resin, and the resins (a1) and (a2) may be suitably selected according to the intended purpose.

The styrene-acrylic resin (which may refer to any of styrene-acrylic resin, styrene resin and acrylic resin) is not particularly limited as long as it contains a styrene monomer and/or an acrylic monomer. Examples of the styrene monomer include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene. Examples of the acrylic monomer include α-methyl fatty acid monocarboxylic acid esters and the like, such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methacrylic acid, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate.

The polyester resin is not particularly limited as long as it contains a polybasic acid and a polyhydric alcohol, and the polyester resin may be suitably selected according to the intended purpose.

Examples of the polybasic acid, as aromatic dicarboxylic acids, include terephthalic acid, isophthalic acid, orthophthalic acid, naphthalenedicarboxylic acid and biphenyldicarboxylic acid. If necessary, a small amount of sodium 5-sulfoisophthalic acid or 5-hydroxyisophthalic acid may be used in addition, provided that water resistance is not impaired. Examples of aliphatic dicarboxylic acids include saturated dicarboxylic acids such as oxalic acid, succinic acid, succinic anhydride, adipic acid, azelaic acid, sebacic acid, dodecanedioic acid and hydrogenated dimer acid; and unsaturated dicarboxylic acids such as fumaric acid, maleic acid, maleic anhydride, itaconic acid, itaconic acid anhydride, citraconic acid, citraconic anhydride and dimer acid. Examples of alicyclic dicarboxylic acids include 1,4-cyclohexanedicarboxylic acid, 1,3-cyclohexanedicarboxylic acid, 1,2-cyclohexanedicarboxylic acid, 2,5-norbornenedicarboxylic acid (anhydride) and tetrahydrophthalic acid (anhydride).

Examples of the polyhydric alcohol, as glycols, include C2-C10 aliphatic glycols, C6-C12 alicyclic glycols, and ether bond-containing glycols.

Examples of the C2-C10 aliphatic glycols include ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol and 2-ethyl-2-butylpropanediol.

Examples of the C6-C12 alicyclic glycols include 1,4-cyclohexanedimethanol.

Examples of the ether bond-containing glycols include diethylene glycol, triethylene glycol, dipropylene glycol, and glycols which are each obtained by adding one to several moles of ethylene oxide or propylene oxide to the two phenolic hydroxyl groups of a bisphenol, such as 2,2-bis(4-hydroxyethoxyphenyl)propane. If necessary, polyethylene glycol, polypropylene glycol or polytetramethylene glycol may also be used; it should, however, be noted that it preferably occupies 10% or less, more preferably 5% or less, of the total polyhydric alcohol content, since an ether structure degrades the water resistance and weatherability of a polyester resin coating.

The polyester resin may be synthesized, if necessary through copolymerization with a trifunctional or higher polybasic acid and/or a trifunctional or higher polyhydric alcohol.

Examples of the trifunctional or higher polybasic acid include trimellitic acid, trimellitic anhydride, pyromellitic acid, pyromellitic anhydride, benzophenonetetracarboxylic acid, benzophenonetetracarboxylic anhydride, trimesic acid, ethylene glycol bis(anhydro trimellitate), glycerol tris(anhydro trimellitate) and 1,2,3,4-butanetetracarboxylic acid.

Examples of the trifunctional or higher polyhydric alcohol include glycerin, trimethylolethane, trimethylolpropane and pentaerythritol.

The trifunctional or higher polybasic acid and/or the trifunctional or higher polyhydric alcohol are/is copolymerized such that its amount occupies 10 mol % or less, preferably 5 mol % or less, of all acid/alcohol components. When they/it occupy/occupies more than 10 mol %, high processability, which is an advantage of a polyester resin, cannot be fully exhibited.

Further, if necessary, any of the following may also be used: fatty acids such as lauric acid, myristic acid, palmitic acid, stearic acid, oleic acid, linoleic acid and linolenic acid, and ester-forming derivatives thereof, high-boiling-point monocarboxylic acids such as benzoic acid, p-tert butylbenzoic acid, cyclohexane acid and 4-hydroxyphenyl stearic acid; high-boiling-point monoalcohols such as stearyl alcohol and 2-phenoxyethanol; and ϵ-caprolactone, lactic acid, β-hydroxybutyric acid and p-hydroxybenzoic acid, and ester-forming derivatives thereof.

The urethane-acrylic resin is produced by polymerizing an aqueous polyurethane resin and then polymerizing an acrylic monomer in the presence of the aqueous resin.

The method for producing the aqueous polyurethane resin is as follows.

First of all, a prepolymer is prepared by subjecting a diisocyanate compound, a diol compound, a carboxyl group-containing diol compound and a polymerizable unsaturated group-containing hydroxyl compound to urethane-forming reaction in organic solvent. Thereafter, the obtained NCO-terminated prepolymer is neutralized with a neutralizer such as a tertiary amine. Subsequently, the neutralized prepolymer is converted to an aqueous polyurethane resin with the group —$CONHNH_2$ at its terminal, by (1) reacting together a polyfunctional carboxylic acid polyhydrazide compound and the NCO terminal group of the prepolymer or by (2) performing chain elongation and then reacting together a polyfunctional carboxylic acid polyhydrazide and the residual NCO terminal group. Thus, a polyurethane aqueous dispersion liquid is obtained.

Examples of the diisocyanate compound include various diisocyanates known in the art, such as aromatic diisocyanates, aliphatic diisocyanates and alicyclic diisocyanates.

Specific examples of the diisocyanate compound include aromatic diisocyanates such as 2,4-tolylene diisocyanate, 2,6-tolylene diisocyanate, 1,5-naphthylene diisocyanate, 4,4'-diphenylmethane diisocyanate, m-phenylene diisocyanate, xylylene diisocyanate, 4,4'-diphenyldimethylmethane diisocyanate and 4,4'-dibenzyl isocyanate; aliphatic or alicyclic diisocyanates such as tetramethylene diisocyanate, hexamethylene diisocyanate, 1,4-dicyclohexylene diisocyanate, 1,4-cyclohexylene diisocyanate, 4,4'-dicyclohexylmethane diisocyanate and isophorone diisocyanate.

Specific examples of the diol compound include (a) polyethers such as polyethylene glycol, polypropylene glycol and tetramethylene glycol, (b) polyesters obtained by dehydration condensation reaction between polyhydric alcohols (e.g. ethylene glycol, propanediol, butanediol, pentanediol, hexanediol, neopentyl glycol and cyclohexanedimethanol) and polyvalent carboxylic acids (e.g. maleic acid, succinic acid, pentanedioic acid, adipic acid, sebacic acid, dodecanedionic acid, terephthalic acid, isophthalic acid and naphthalenedicarboxylic acid) or obtained by subjecting cyclic esters to ring-opening polymerization reaction, (c) polydiols such as polycarbonate, and (d) low-molecular-weight glycols such as ethylene glycol, diethylene glycol, triethylene glycol, 1,2-propylene glycol, 1,3-propanediol, 1,3-butylene glycol, 1,4-butanediol, 1,6-hexanediol, hydrogenated bisphenol A, ethylene oxide adducts or propylene oxide adducts of bisphenol A, and ethylene oxide adducts of bisphenol S.

Specific examples of acid group-containing glycols as water solubility providing compounds include diols having carboxyl groups in the molecules, such as 2,2-dimethylolpropionic acid, 2,2-dimethylolbutyric acid and 2,2-dimethylolvaleric acid. Examples of hydroxyl compounds containing polymerizable unsaturated groups include β-hydroxyethyl methacrylate (HEMA), β-hydroxyethyl acrylate, γ-hydroxypropyl methacrylate, γ-hydroxypropyl acrylate and glycerin monoallyl ether. These diols may be used individually or in combination.

The aqueous polyurethane resin preferably has an aromatic ring derived from a polyol component, or a nuclear-substituted aromatic ring unit. This makes it possible to improve the heat-resistant storage stability of the resin and adhesion to a binder resin of the toner.

To introduce the aromatic ring or the nuclear-substituted aromatic ring unit into the polyurethane polymer, a copolymer polyester composed of ethylene glycol (EG), neopentyl glycol (NPG), terephthalic acid (TPA) and isophthalic acid (IPA) may be used.

As a terminal-blocking agent to react with the residual NCO terminal group, a polyfunctional carboxylic acid polyhydrazide can be used.

Examples of the polyfunctional carboxylic acid polyhydrazide include oxalic acid dihydrazide, malonic acid dihydrazide, glutaric acid dihydrazide, adipic acid dihydrazide (ADH), sebacic acid dihydrazide, dodecanedionic acid dihydrazide, maleic acid dihydrazide, fumaric acid dihydrazide, itaconic acid dihydrazide, isophthalic acid dihydrazide, terephthalic acid dihydrazide, 4,4'-oxybisbenzenesulfonylhydrazide, trimesic acid trihydrazide, 1,3-bis(hydrazinocarboethyl)-5-isopropylhydantoin (VDH), icosanedioic acid dihydrazide, 7,11-octadecadiene-1,18-dicarbohydrazide, polyacrylic acid hydrazide, and acrylamide-acrylic acid hydrazide copolymer. Among these, adipic acid dihydrazide, isophthalic acid dihydrazide and 1,3-bis(hydrazinocarboethyl)-5-isopropylhydantoin (VDH) are particularly preferable.

Subsequently, an aqueous dispersion liquid of an urethane-acrylic resin is produced by polymerizing an acrylic monomer in the presence of the polyurethane aqueous dispersion liquid produced by the above-mentioned method.

Examples of the acrylic monomer include acrylic acid esters such as methyl acrylate, ethyl acrylate, butyl acrylate, hexyl acrylate and 2-ethylhexyl acrylate; methacrylic acid esters such as methyl methacrylate, ethyl methacrylate, butyl methacrylate, hexyl methacrylate and glycidyl methacrylate; monomer mixtures containing styrene and the like as main components, aldehyde group-containing or ketone group-containing polymerizable unsaturated monomers.

Examples of the aldehyde group-containing or ketone group-containing polymerizable unsaturated monomers include acrolein, diacetoneacrylamide (DAAM), acetoacetoxyethyl methacrylate, p-formylstyrene, vinyl methyl ketone, vinyl ethyl ketone, vinyl butyl ketone, vinylacetophenone and vinylbenzophenone. Among these, diacetoneacrylamide, acrolein and vinyl methyl ketone are particularly preferable.

The properties of the resin particle (A1) and the resin particle (A2) are not particularly limited as long as the above-mentioned purpose can be achieved, and the properties may be suitably selected according to the intended purpose. It is preferred that the molecular weights, sp values (the sp values are calculated in accordance with Polymer Engineering and Science, February, 1974, VoL14, No. 2P, 147 to 154), crystallinity, molecular weights between cross-linking points, etc. of the resins (a1) and (a2) be appropriately adjusted to reduce the swelling and dissolution of the resin particle (A1) and the resin particle (A2) in a solvent (used at the time of dispersion) and water.

The glass transition temperatures (Tg) of the resins (a1) and (a2) are not particularly limited. Nevertheless, the glass transition temperature (Tg (a1)) of the resin (a1) is preferably in the range of 30° C. to 70° C., more preferably 40° C. to 60°

C. When the Tg (a1) is lower than 30° C., the storage stability of the toner may degrade, blocking may be generated at the time of storage and in a developing device, and the charge stability of the toner against changes of use conditions such as temperature and humidity may degrade. When the Tg (a1) is higher than 70° C., the resin particle which contains the resin (a1) may hinder adhesion of the toner to toner-fixing paper, and the fixation lower limit temperature may increase.

Also, the glass transition temperature (Tg (a2)) of the resin (a2) is preferably in the range of 55° C. to 100° C., more preferably 58° C. to 75° C. When the Tg (a2) is lower than 55° C., the storage stability of the toner may degrade, blocking may be generated at the time of storage and in a developing device, and the charge stability of the toner against changes of use conditions such as temperature and humidity may degrade. When the Tg (a2) is higher than 100° C., the resin particle which contains the resin (a2) may hinder adhesion of the toner to toner-fixing paper, and the fixation lower limit temperature may increase. Since the purpose of the provision of the resin particle (A1) is to give low-temperature fixation properties to the toner while the purpose of the provision of the resin particle (A2) is to give heat-resistant storage stability to the toner, the relationship Tg (a1)<Tg (a2) is preferably satisfied. Also, when the Tg of the resin (a1) and the Tg of the resin (a2) are lower than the temperature at which the aqueous resin dispersion is produced, unification and division among the resin particle (C) may not be effectively prevented, the uniformity of the particle diameter may not be effectively enhanced, and the heat-resistant storage stability of the toner may degrade. Parenthetically, as described above, the Tg is calculated from DSC measurement, or measurement with a flow tester (in the case where DSC measurement is impossible).

The weight average molecular weights of the resins (a1) and (a2) are not particularly limited and may be suitably selected according to the intended purpose. Nevertheless, they are preferably in the range of 9,000 to 200,000. When the weight average molecular weights are less than 9,000, the storage stability of the toner may degrade, and blocking may be generated at the time of storage and in a developing device. When the weight average molecular weights are greater than 200,000, the resin particle containing the resins (a1) and (a2) may hinder adhesion of the toner to toner-fixing paper, and the fixation lower limit temperature may increase.

Adjustment of the glass transition temperatures (Tg) of the resins (a1) and (a2) can be facilitated by changing the molecular weight of the resin and/or changing the composition of the monomer(s) constituting the resin. The molecular weights (the higher the molecular weights are, the higher the temperatures of the resins are) of the resins (a1) and (a2) may be adjusted by a method known in the art. In the case where the resins are polymerized by consecutive reaction, for example, their molecular weights may be adjusted by adjusting the mixture ratio of monomer(s).

<Resin Particle (C)>

The method for producing the resin particle (C) is not particularly limited as long as the first resin (a1) and the second resin (a2) which have mutually different glass transition temperatures are attached to the surface of the resin particle (B) which contains the third resin (b), and the method may be suitably selected according to the intended purpose.

The resin particle (C) may be produced by any method and any process, provided that the above conditions are satisfied. Examples of the method include Production Methods (I) and (II) below.

(I) A method of mixing an aqueous dispersion liquid (W1) of the resin particle (A1) which contains the resin (a1) with [the resin (b), or a organic solvent solution or dispersion liquid thereof] (hereinafter referred to as (O1)) or with [the precursor (b0) of the resin (b), or a organic solvent solution or dispersion liquid thereof] (hereinafter referred to as (O2)), dispersing the (O1) or the (O2) in the aqueous dispersion liquid (W1), thereby (in the case of the precursor (b0)) reacting the precursor (b0) so as to form the resin (b2), and thus forming the resin particle (B) which contains the resin (b) in the aqueous dispersion liquid (W1). The resin (a1) (for example, the resin particle (A1) or the coating film (P1)) is attached to the surface of the resin (B) simultaneously with the formation of the resin particle (B). Further, an aqueous dispersion liquid (W2) of the resin particle (A2) which contains the resin (a2) is dispersed in a subsequent step, i.e. a constricting step, and attached to the surface of the resin particle (B) so as to form an aqueous dispersion (X) of the resin particle (C), then an aqueous medium is removed from this aqueous dispersion (X), and the resin particle (C) is thus produced.

(II) A method in which the resin particle (B) which contains the previously produced resin (b) is coated with a coating agent (W') which contains the resins (a1) and (a2) so as to produce the resin particle (C). In this case, the coating agent (W') may be in liquid form, solid form, etc. The resin particle (B) which contains the previously produced resin (b) may be coated with a precursor (al') of the resin (a1) and a precursor (a2') of the resin (a2), and then these precursors may be reacted to yield the resins (a1) and (a2). Also, the resin particle (B) may be produced by any method and may, for example, be a resin particle produced by means of emulsion polymerization aggregation, etc. or a resin particle produced by means of pulverization. The method of the coating using the coating agent (W') is not particularly limited, and examples thereof include a method of dispersing the resin particle (B) or a dispersion of the resin particle (B), which has been previously produced, in an aqueous dispersion liquid (W) of the resin particles (A1) and (A2) which contain the resins (a1) and (a2), and a method of applying a solution of the resins (a1) and (a2) as a coating agent over the resin particle (B). Production Method (I) is particularly preferable in that the resin particles (A1) and (A2) can be attached to the surface of the resin particle (B) even more firmly. Also, in Production Method (I), by adsorbing the resin particle (A1) to the surface of the resin particle (B), unification among the resin particle (C) can be prevented, and the resin particle (C) can be made less dividable under high shearing conditions. This makes it possible to narrow the particle size distribution of the resin particle (C) and enhance the particle diameter uniformity, and thus to perform a function of forming uniform particles.

Examples of preferred properties of the resin particles (A1) and (A2) include the following (i) to (iii): (i) that the resin particles (A1) and (A2) have strength to such an extent that they are not broken by shearing at the temperature at which dispersion takes place; (ii) that the resin particles (A1) and (A2) do not easily swell or dissolve in water; and (iii) that the resin particles (A1) and (A2) do not easily dissolve in the resin (b), or an organic solvent solution thereof or a dispersion liquid thereof, or in the resin (b) and the precursor (b0), or an organic solvent solution thereof or a dispersion liquid thereof.

The after-mentioned other components optionally included in the toner, such as a charge controlling agent, a deforming agent, a colorant, etc., may be encapsulated in the resin particle (B). Accordingly, before the aqueous dispersion liquid (W1) is mixed with the (O) (O1 or O2), the charge controlling agent, the deforming agent, the colorant, etc. may be dispersed in the solution of (O). The charge controlling agent may be encapsulated in or externally added to the resin particle (B). In the case were the charge controlling agent is encapsulated in the resin particle (B), it is advisable to disperse the charge controlling agent in the solution of (O) along with the colorant, etc. In the case where the charge controlling agent is externally added to the resin particle (B), the charge controlling agent may be externally added after the formation of the resin (C).

In the method for producing the resin particle (C), besides water, an organic solvent (acetone, methyl ethyl ketone, etc.) which is miscible with water, among any of the after-mentioned examples of the organic solvent (u), may be contained in the aqueous dispersion liquids (W1) and (W2) of the resin particles (A1) and (A2). The organic solvent with the miscibility is not particularly limited as long as it does not cause aggregation of the resin particles (A1) and (A2), it does not dissolve the resin particles (A1) and (A2), or it does not hinder formation of the resin (C). The amount of the organic solvent with the miscibility is not particularly limited either, as long as the foregoing requirements are satisfied. Use of such an organic solvent which occupies 40% by mass or less of the total amount of water and the organic solvent and which does not remain in the dried resin particle (C) is preferable.

—Organic Solvent (u)—

In the preparation of the resin particle (C), an organic solvent (u) may be used for the purpose of dissolving/dispersing the components of the resin particle (C). The organic solvent (u) may if necessary be added into an aqueous medium or an emulsified dispersion [an oil phase (O1) which contains the resin (b), or an oil phase (O2) which contains the resin (b) and the precursor (b0)] at the time of emulsification dispersion. Specific examples of the organic solvent (u) include the following.

Aromatic hydrocarbon solvents such as toluene, xylene, ethyl benzene and tetralin.

Aliphatic or alicyclic hydrocarbon solvents such as n-hexane, n-heptane, mineral spirits and cyclohexane.

Halogen solvents such as methyl chloride, methyl bromide, methyl iodide, methylene dichloride, carbon tetrachloride, trichloroethylene and perchloroethylene.

Ester or ester ether solvents such as ethyl acetate, butyl acetate, methoxybutyl acetate, methyl cellosolve acetate and ethyl cellosolve acetate.

Ether solvents such as diethyl ether, tetrahydrofuran dioxane, ethyl cellosolve, butyl cellosolve and propylene glycol monomethyl ether.

Ketone solvents such as acetone, methyl ethyl ketone, methyl isobutyl ketone, di-n-butyl ketone and cyclohexanone.

Alcohol solvents such as methanol, ethanol, n-propanol, isopropanol, n-butanol, isobutanol, t-butanol, 2-ethylhexyl alcohol and benzyl alcohol.

Amide solvents such as dimethylformamide and dimethylacetamide.

Sulfoxide solvents such as dimethyl sulfoxide.

Heterocyclic compound solvents such as N-methylpyrrolidone.

Mixed solvents which are each composed of two or more of these solvents.

—Plasticizer (v)—

In the preparation of the resin particle (C), a plasticizer (v) may be used for the purpose of plasticizing the resin(s) so as to lower the fixation lower limit temperature, or improving the solubility of the resin to the solvent. The plasticizer (v) may if necessary be added into the aqueous medium or the emulsified dispersion [the oil phase (O1) which contains the resin (b), or the oil phase (O2) which contains the resin (b) and the precursor (b0)] at the time of emulsification dispersion. The plasticizer (v) is not particularly limited as long as the above-mentioned purpose can be achieved. Specific examples of the plasticizer include the following.

(v1) Phthalic acid esters (such as dibutyl phthalate, dioctyl phthalate, butyl benzyl phthalate and diisodecyl phthalate)

(v2) Aliphatic dibasic acid esters (such as di-2-ethylhexyl adipate and 2-ethylhexyl sebacate)

(v3) Trimellitic acid esters (such as tri-2-ethylhexyl trimellitate and trioctyl trimellitate)

(v4) Phosphoric acid esters (such as triethyl phosphate, tri-2-ethylhexyl phosphate and tricresol phosphate)

(v5) Fatty acid esters (such as butyl oleate)

(v6) Mixtures which are each composed of two or more of the above-mentioned compounds —Emulsifier or Dispersant—

In the preparation of the resin particle (C), an emulsifier or a dispersant may be used for the purpose of emulsifying/dispersing the components of the resin particle (C). A surfactant (s), a water-soluble polymer (t), etc. known in the art may be used as the emulsifier or the dispersant. Also, the organic solvent (u), the plasticizer (v), etc. may be used in addition as auxiliary agents for emulsification or dispersion.

—Surfactant (s)—

In the preparation of the resin particle (C), a surfactant (s) may be used for the purpose of emulsifying/dispersing the components of the resin particle (C). The surfactant (s) is not particularly limited. For example, an anionic surfactant (s-1), a cationic surfactant (s-2), an amphoteric surfactant (s-3), a nonionic surfactant (s-4) or the like may be used as the surfactant (s). The surfactant (s) may be composed of a single surfactant or of two or more surfactants. Specific examples of the surfactant (s) include the compounds and the like mentioned below, and those mentioned in 2002-284881.

—Anionic Surfactant (s-1)—

A carboxylic acid or a salt thereof, a sulfate salt, a salt of a carboxymethylated material, a sulfonic acid salt, a phosphate salt, or the like is used as the anionic surfactant (s-1).

Examples of the anionic surfactant (s-1) as the carboxylic acid or the salt thereof include C8-C22 saturated or unsaturated fatty acids or salts thereof, such as capric acid, lauric acid, myristic acid, palmitic acid, stearic acid, arachidic acid, behenic acid, oleic acid, linoleic acid, ricinoleic acid, and mixtures of higher fatty acids obtained by saponifying coconut oil, palm oil, rice bran oil, beef fat, etc. Examples of salts thereof include sodium salts, potassium salts, amine salts, ammonium salts, quaternary ammonium salts and alkanolamine salts (monoethanolamine salts, diethanol amine salts, triethanol amine salts, etc.) thereof.

Examples of the anionic surfactant (s-1) as the sulfate salt include higher alcohol sulfate salts (sulfate salts of C8-C18 aliphatic alcohols), higher alkyl ether sulfate salts (sulfate salts of EO or PO (1 mol to 10 mol) adducts of C8-C18 aliphatic alcohols), sulfated oils (obtained by directly sulfating C12-C50 natural unsaturated fats or unsaturated waxes, and thereby neutralizing these), sulfated fatty acid esters (obtained by sulfating lower alcohol (C1-C8) esters of unsaturated fatty acids (C6-C40) and thereby neutralizing these), and sulfated olefins (obtained by sulfating C12-C18 olefins and thereby neutralizing these). Examples of salts of the sulfate salts include sodium salts, potassium salts, amine salts, ammonium salts, quaternary ammonium salts, and alkanolamine salts (e.g. monoethanolamine salts, diethanol amine salts and triethanol amine salts). Examples of the higher alcohol sulfate salts include octyl alcohol sulfate salt, decyl alcohol sulfate salt, lauryl alcohol sulfate salt, stearyl alcohol sulfate salt, sulfate salts of alcohols (e.g. ALFOL 1214 (product name), manufactured by CONDEA) synthesized using a Ziegler catalyst, and sulfate salts of alcohols (e.g. DOBANOL 23, 25 and 45 and DIADOL 115, 115H and 135 (product name), manufactured by Mitsubishi Chemical Corporation; TRIDECANOL (product name), manufactured by Kyowa Hakko Co., Ltd.; and OXOCOL 1213, 1215 and 1415 (product name), manufactured by Nissan Chemical Industries, Ltd.) synthesized by the oxo method. Examples of the higher alkyl ether sulfate salts include sulfate salts of EO (2 mol) adducts of lauryl alcohol, and sulfate salts of EO (3 mol) adducts of octyl alcohol. Examples of the sulfated oils include salts of sulfated materials such as castor oil, peanut oil, olive oil, canola oil, beef fat and sheep fat. Examples of the sulfated fatty acid esters include salts of sulfated materials such as butyl oleate and butyl ricinolate. Examples of the sulfated olefins include TEEPOL (product name), manufactured by Shell Chemicals.

Examples of the salt of the carboxymethylated material include salts of carboxymethylated materials of C8-C16 aliphatic alcohols, and salts of carboxymethylated materials of EO or PO (1 mol to 10 mol) adducts of C8-C16 aliphatic alcohols. Examples of the salts of the carboxymethylated materials of the aliphatic alcohols include octyl alcohol carboxymethylated sodium salt, lauryl alcohol carboxymethylated sodium salt, carboxymethylated sodium salt of DOBANOL 23, and tridecanol carboxymethylated sodium salt. Examples of the salts of the carboxymethylated materials of the EO or PO (1 mol to 10 mol) adducts of the aliphatic alcohols include octyl alcohol EO or PO (3 mol) adduct carboxymethylated sodium salt, lauryl alcohol EO or PO (4 mol) adduct carboxymethylated sodium salt, and tridecanol EO or PO (5 mol) adduct carboxymethylated sodium salt.

Examples of the sulfonic acid salt include alkyl benzene sulfonates, alkyl naphthalene sulfonates, sulfosuccinic acid diester salts, Igepon T, and sulfonic acid salts of aromatic ring-containing compounds. Examples of the alkyl benzene sulfonates include dodecyl benzene sulfonic acid sodium salt. Examples of the alkyl naphthalene sulfonates include dodecyl naphthalene sulfonic acid sodium salt. Examples of the sulfosuccinic acid diester salts include sulfosuccinic acid di-2-ethylhexyl ester sodium salt. Examples of the sulfonic acid salts of the aromatic ring-containing compounds include monosulfonic or disulfonic acid salts of alkylated diphenyl ethers, and styrenated phenol sulfonates.

Examples of the phosphate salt include higher alcohol phosphate salts and higher alcohol EO adduct phosphate salts. Examples of the higher alcohol phosphate salts include lauryl alcohol phosphoric acid monoester disodium salt and lauryl alcohol phosphoric acid diester sodium salt. Examples of the higher alcohol EO adduct phosphate salts include oleyl alcohol EO (5 mol) adduct phosphoric acid monoester disodium salt.

—Cationic Surfactant (s-2)—

Examples of the cationic surfactant (s-2) include quaternary ammonium salt surfactants and amine salt surfactants.

The quaternary ammonium salt surfactants can be obtained, for example, by reacting C3-C40 tertiary amines and quaternizing agents (e.g. alkylating agents such as methyl chloride, methyl bromide, ethyl chloride, benzyl chloride and dimethylsulfuric acid, and EO). Examples thereof include lauryltrimethylammonium chloride, didecyldimethylammonium chloride, dioctyldimethylammonium bromide, stearyltrimethylammonium bromide, lauryldimethylbenzylammonium chloride (benzalkonium chloride), cetylpyridinium chloride, polyoxyethylenetrimethylammonium chloride and stearamideethyldiethylmethylammonium methosulfate.

The amine salt surfactants can be obtained by neutralizing primary to tertiary amines with inorganic acids (e.g. hydrochloric acid, acid, sulfuric acid, hydroiodic acid, phosphoric acid, phosphoric acid and perchloric acid) or organic acids (acetic acid, formic acid, oxalic acid, lactic acid, gluconic acid, adipic acid, C2-C24 alkyl phosphoric acid, malic acid and citric acid). Examples of primary amine salt surfactants include inorganic acid salts or organic acid salts of C8-C40 aliphatic higher amines (e.g. higher amines such as laurylamine, stearylamine, cetylamine, cured beef fat amine and rosin amine), and higher fatty acids (C8-C40, exemplified by stearic acid and oleic acid) of lower amines (C2-C6). Examples of secondary amine salt surfactants include inorganic acid salts or organic acid salts of EO ad duct of C4-C40 aliphatic amines. Examples of tertiary amine salt surfactants include C4-C40 aliphatic amines (e.g. triethylamine, ethyldimethylamine and N,N,N',N'-tetramethylethylenediamine), EO (2 or more moles) adducts of aliphatic amines (C2-C40), C6-C40 alicyclic amines (e.g. N-methylpyrrolidine, N-methylpiperidine, N-methylhexamethyleneimine, N-methylmorpholine and 1,8-diazabicyclo(5,4,0)-7-undecene), inorganic acid salts or organic acid salts of C5-C30 nitrogen-containing hetero ring aromatic amines (e.g. 4-dimethylaminopyridine, N-methylimidazol and 4,4'-dipyridyl), and inorganic acid salts or organic acid salts of tertiary amines such as triethanolamine monostearate and stearamideethyldiethylmethylethanolamine.

—Amphoteric Surfactant (s-3)—

Examples of the amphoteric surfactant (s-3) include carboxylate amphoteric surfactants, sulfate amphoteric surfactants, sulfonate amphoteric surfactants and phosphate amphoteric surfactants.

Examples of the carboxylate amphoteric surfactants include amino acid amphoteric surfactants, betaine amphoteric surfactants and imidazoline amphoteric surfactants.

The amino acid amphoteric surfactants are amphoteric surfactants having amino groups and carboxyl groups in the molecules. Examples thereof include compounds represented by General Formula (A) below.

$$[R—NH—(CH_2)n—COO]mM \qquad \text{General Formula (A)}$$

In General Formula (A), R denotes a monovalent hydrocarbon group, n denotes 1 or 2, m denotes 1 or 2, M denotes a hydrogen ion, an alkali metal ion, an alkaline earth metal ion, an ammonium cation, an amine cation, an alkanolamine cation or the like.

Examples of amphoteric surfactants represented by General Formula (A) include alkyl(C6-C40) aminopropionic acid amphoteric surfactants (such as sodium stearylaminopropionate and sodium laurylaminopropionate); alkyl(C4-C24) aminoacetic acid amphoteric surfactants (such as sodium laurylaminoacetate).

The betaine amphoteric surfactants are amphoteric surfactants having quaternary ammonium salt-based cations and carboxylic acid-based anions in the molecules. Examples thereof include alkyl (C6-C40) dimethyl betaines (such as betaine stearyldimethylaminoacetate and betaine lauryldimethylaminoacetate), C6-C40 amide betaines (such as coconut oil fatty acid amide propyl betaine), alkyl(C6-C40) dihydroxyalkyl (C6-C40) betaines (such as lauryldihydroxyethyl betaine).

The imidazoline amphoteric surfactants are amphoteric surfactants having imidazoline ring-containing cations and carboxylic acid-based anions. Examples thereof include 2-undecyl-N-carboxymethyl-N-hydroxyethylimidazolinium betaine.

Examples of other amphoteric surfactants include glycine amphoteric surfactants such as sodium lauroyl glycine, sodium lauryl diaminoethyl glycine, lauryl diaminoethyl glycine hydrochloride and dioctyl diaminoethyl glycine hydrochloride, sulfobetaine amphoteric surfactants such as pentadecylsulfotaurine, sulfonate amphoteric surfactants, and phosphate amphoteric surfactants.

—Nonionic Surfactant (s-4)—

Examples of the nonionic surfactant (s-4) include AO-attached nonionic surfactants and polyhydric alcohol nonionic surfactants.

The AO-attached nonionic surfactants can be obtained by directly attaching C2-C20 AO to C8-C40 higher alcohols, C8-C40 higher fatty acids, C8-C40 alkylamines, etc. or reacting polyalkylene glycols (obtained by attaching AO to glycols) with higher fatty acids, etc. or attaching AO to esterified materials (obtained by reacting polyhydric alcohols with higher fatty acids) or attaching AO to higher fatty acid amides.

Examples of the AO include EO, PO and BO. Preferable among these are EO and combinations of EO and PO (randomly or in the form of blocks). The number of moles of AO attached is preferably in the range of 10 to 50, and it is preferred that EO occupy 50% to 100% of the AO.

Examples of the AO-attached nonionic surfactants include oxyalkylene alkyl ethers (alkylene C2-C24, alkyl: C8-C40) (such as octyl alcohol EO adduct (20 mol), lauryl alcohol EO adduct (20 mol), stearyl alcohol EO adduct (10 mol), oleyl alcohol EO adduct (5 mol), and lauryl alcohol EO adduct (10 mol) PO (20 mol) block addition product); polyoxyalkylene higher fatty acid esters (alkylene: C2-C24, higher fatty acid: C8-C40) (such as EO adduct (10 mol) of stearic acid, and EO adduct (10 mol) of lauric acid); polyoxyalkylene polyhydric alcohol higher fatty acid esters (alkylene: C2-C24, polyhydric alcohol: C8-C40, higher fatty acid: C8-C40) (such as lauric acid diester of polyethylene glycol (polymerization degree: 20), and oleic acid diester of polyethylene glycol (polymerization degree: 20)); polyoxyalkylene alkyl phenyl ethers (alkylene: C2-C24, alkyl: C8-C40) (such as nonylphenol EO (4 mol) adduct, nonylphenol EO (8 mol) PO (20 mol) block addition product, octylphenol EO (10 mol) adduct, bisphenol A EO (10 mol) adduct and styrenated phenol EO (20 mol) adduct); polyoxyalkylene alkyl amino ethers (alkylene: C2-C24, alkyl: C8-C40) (such as laurylamine EO (10 mol) adduct and stearylamine EO (10 mol) adduct); and polyoxyalkylene alkanolamides (alkylene: C2-C24, amide(acyl): C8-C24) (such as EO (10 mol) adduct of hydroxyethyl lauric acid amide, and EO (20 mol) adduct of hydroxy propyl oleic acid amide).

Examples of the polyhydric alcohol nonionic surfactants include polyhydric alcohol fatty acid esters, polyhydric alcohol fatty acid ester AO adducts, polyhydric alcohol alkyl ethers, and polyhydric alcohol alkyl ether AO adducts. The number of carbon atoms contained in each polyhydric alcohol is 3 to 24, the number of carbon atoms contained in each fatty acid is 8 to 40, and the number of carbon atoms contained in each AO is 2 to 24.

Examples of the polyhydric alcohol fatty acid esters include pentaerythritol monolaurate, pentaerythritol monooleate, sorbitan monolaurate, sorbitan monostearate, sorbitan dilaurate, sorbitan dioleate and sucrose monostearate.

Examples of the polyhydric alcohol fatty acid ester AO adducts include ethylene glycol monooleate EO (10 mol) adduct, ethylene glycol monostearate EO (20 mol) adduct, trimethylolpropane monostearate EO (20 mol) PO (10 mol) random addition product, sorbitan monolaurate EO (10 mol) adduct, sorbitan distearate EO (20 mol) adduct, and sorbitan dilaurate EO (12 mol) PO (24 mol) random addition product.

Examples of the polyhydric alcohol alkyl ethers include pentaerythritol monobutyl ether, pentaerythritol monolauryl ether, sorbitan monomethyl ether, sorbitan monostearyl ether, methyl glycoside and lauryl glycoside.

Examples of the polyhydric alcohol alkyl ether AO adducts include sorbitan monostearyl ether EO (10 mol) adduct, methyl glycoside EO (20 mol) PO (10 mol) random addition product, lauryl glycoside EO (10 mol) addition product, and stearyl glycoside EO (20 mol) PO (20 mol) random addition product.

—Water-Soluble Polymer (t)—

Examples of the water-soluble polymer (t) include cellulose compounds (such as methyl cellulose, ethyl cellulose, hydroxyethyl cellulose, ethylhydroxyethyl cellulose, carboxymethyl cellulose, hydroxypropyl cellulose, and saponified products thereof), gelatin, starch, dextrin, gum arabic, chitin, chitosan, polyvinyl alcohol, polyvinylpyrrolidine, polyethylene glycol, polyethylene imine, polyacrylamide, polymers each containing an acrylic acid (salt) (such as sodium polyacrylate, potassium polyacrylate, ammonium polyacrylate, sodium hydroxide partially neutralized product of polyacrylic acid, and sodium acrylate-acrylic acid ester copolymer), sodium hydroxide partially neutralized product of styrene-maleic anhydride copolymer, water-soluble polyurethanes (such as reaction products of polyethylene glycol, polycaprolactone diol, etc. and polyisocyanates).

As to how to control the shape of the resin particle (C) obtained by Production Method (I), it is possible to control the particle shape and the particle surface properties by controlling the differences in sp value between the resins (a1), (a2) and (b), and/or the molecular weights of the resins (a1) and (a2). When the differences in sp value are small, a particle with a distorted shape and a smooth surface tends to be obtained. When the differences in sp value are large, a spherical particle with a rough surface tends to be obtained. When the molecular weights of the resins (a1) and (a2) are large, a particle with a rough surface tends to be obtained. When the molecular weights of the resins (a1) and (a2) are small, a particle with a smooth surface tends to be obtained. It should, however, be noted that when the differences in sp value between the resins (a1), (a2) and (b) is too small or too large, particle formation becomes difficult. Also, when the molecular weights of the resins (a1) and (a2) are too small, particle formation becomes difficult as well. Thus, the differences in sp value between the resins (a1), (a2) and (b) are preferably in the range of 0.01 to 5.0, more preferably 0.1 to 3.0, even more preferably 0.2 to 2.0.

In Production Method (II), the shape of the resin particle (C) is greatly affected by the shape of the previously prepared resin particle (B), and the resin particle (C) has much the same shape as the resin particle (B). It should, however, be noted that when the resin particle (B) has a distorted shape, use of a large amount of the coating agent (W') in Production Method (II) enables the resin particle to have a spherical shape.

In the present invention, in view of the particle diameter uniformity and storage stability of the resin particle (C), it is preferred that the total amount of the resins (a1) and (a2), contained in the resin particle (C), be in the range of 0.01% by mass to 60% by mass, and the amount of the resin particle (B) which contains the third resin (b), contained in the resin particle (C), be in the range of 40% by mass to 99.99% by mass. It is more preferred that the total amount of the resins (a1) and (a2) be in the range of 0.1% by mass to 50% by mass, and the amount of the resin particle (B) be in the range of 50% by mass to 99.9% by mass. It is particularly preferred that the total amount of the resins (a1) and (a2) be in the range of 1% by mass to 45% by mass, and the amount of the resin particle (B) be in the range of 55% by mass to 99% by mass. When the total amount of the resins (a1) and (a2) is 0.01% by mass or greater, favorable blocking resistance can be obtained. When the total amount of the resins (a1) and (a2) is 60% by mass or less, favorable fixation properties, especially low-temperature fixation properties, can be obtained. When the amount of the resin particle (B) which contains the third resin (b) is 40% by mass or greater, favorable fixation properties, especially low-temperature fixation properties, can be obtained. When the amount of the resin particle (B) which contains the third resin (b) is 99.99% by mass or less, favorable blocking resistance can be obtained.

In view of the particle diameter uniformity, powder fluidity, storage stability, etc. of the resin particle (C), it is preferred that the resins (a1) and (a2) (for example, the resin particles (A1) and (A2), or the coating films (P1) and (P2)) cover a total of 5% or greater, more preferably 30% or greater, even more preferably 50% or greater, particularly preferably 80% or greater, of the surface of the resin particle (B) contained in the resin particle (C). The surface coverage of the resin particle (C) can be calculated based upon the following equation, analyzing an image obtained with a scanning electron microscope (SEM).

Surface coverage(%)=[Area of part covered with resins(*a*1)and(*a*2)/(Area of part covered with resins (*a*1)and(*a*2)+Area of part where resin particle(*B*) is exposed)]×100

In view of the particle diameter uniformity of the resin particle (C), the variation coefficient of the volume distribution of the resin particle (C) is preferably 30% or less, more preferably in the range of 0.1% to 15%. In view of the particle diameter uniformity of the resin particle (C), the value of [Volume average particle diameter (Dv)/Number average particle diameter (Dn)] is in the range of 1.0 to 1.4, more preferably 1.0 to 1.3. The volume average particle diameter (Dv) of the resin particle (C) varies according to the use. Nevertheless, in general, the Dv is preferably in the range of 0.1 μm to 16 μm. The upper limit is preferably 11 μm, particularly preferably 9 μm, and the lower limit is preferably 0.5 μm, particularly preferably 1 μm. Here, the volume average particle diameter (Dv) and the number average particle diameter (Dn) can be measured at the same time, using MULTISIZER II (manufactured by Coulter Corporation).

The surface of the resin particle (C) can be provided with depressions and protrusions in a desirable manner by changing the particle diameters of the resin particles (A1), (A2) and (B) and the coverage of the surface of the resin particle (B) covered with the coating films (P1) and (P2) containing the resins (a1) and (a2) respectively. In view of improvement in powder fluidity, the BET specific surface area of the resin particle (C) is preferably in the range of 0.5 $m^2/g$ to 5.0 $m^2/g$. In the present invention, the BET specific surface area is measured (measurement gas: He/Kr=99.1/0.1 vol. %, measurement gas: nitrogen) using a surface area measuring apparatus, for example QUANTASORB (manufactured by YUASA-IONICS COMPANY, LIMITED). Also in view of improvement in powder fluidity, the surface average center line roughness Ra of the resin particle (C) is preferably 0.01 μm to 0.8 μm. Ra denotes a value obtained by arithmetically averaging the absolute value of the deviation between a roughness curve and its center line. For instance, Ra can be measured using a scanning probe microscope system (manufactured by TOYO Corporation).

The resin particle (C) is preferably shaped like a sphere in view of its powder fluidity, melt leveling properties, etc. In that case, the resin particle (B) is preferably shaped like a sphere as well. The resin particle (C) preferably has an average circularity of 0.95 to 1.0, more preferably 0.96 to 1.0, even more preferably 0.97 to 1.0. The average circularity is a value obtained by optically detecting particles, and dividing the circumferential length of the optically detected particles by the circumferential length of a circle having an equal projected area. Specifically, the average circularity is measured using a flow particle image analyzer (FPIA-2000, manufactured by Sysmex Corporation). In a predetermined container, 100 mL to 150 mL of water from which impure solid matter has been removed is placed, 0.1 mL to 0.5 mL of a surfactant (DRIWEL, manufactured by FUJIFILM Corporation) is added as a dispersant, and further, approximately 0.1 g to 9.5 g of a measurement sample is added. The suspension in which the sample is dispersed is subjected to dispersion treatment for approximately 1 minute to approximately 3 minutes using an ultrasonic dispersing device (Ultrasonic Cleaner Model VS-150, manufactured by VELVO-CLEAR), the resin particle dispersion concentration is adjusted to the range of 3,000 (number)/μL to 10,000 (number)/and the shapes and distribution of the resin particles are measured.

<Other Components>

As described above, the toner of the present invention includes the resin particle (C) containing the first resin (a1) and the second resin (a2) which have mutually different glass transition temperatures, and also containing the resin particle (B) which contains the third resin (b); if necessary, the toner may further include other component(s). Examples of the other component(s) include a charge controlling agent, a deforming agent, a colorant, a release agent, an fine inorganic particle, a fluidity improver, a cleanability improver, a magnetic material, etc.

<<Charge Controlling Agent>>

The toner of the present invention may include a charge controlling agent for the purpose of controlling its chargeability. The charge controlling agent is not particularly limited, and examples thereof include the following materials.

Examples of the charge controlling agent include C2-C16 alkyl group-containing azine dyes (Japanese Patent Application Publication (JP-B) No. 42-1627), basic dyes such as C.I. Basic Yellow 2 (C.I. 41000), C. I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C. I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000), lake pigments of these basic dyes, C.I. Solvent Black 8 (C.I. 26150), quaternary ammonium salts such as benzoylmethylhexadecylammonium chloride and decyltrimethyl chloride, dialkyl (e.g. dibutyl, dioctyl, etc.) tin compounds, dialkyltin borate compounds, guanidine derivatives, polyamine resins such as amino group-containing vinyl polymers and amino group-containing condensation polymers, the metal complex salts of the monoazo dyes mentioned in JP-B Nos. 41-20153, 43-27596, 44-6397 and 45-26478, the metal (e.g. Zn, Al, Co, Cr, Fe, etc.) complexes of salicylic acid, dialkylsalicylic acids, naphthoic acid and dicarboxylic acids mentioned in JP-B Nos. 55-42752 and 59-7385, sulfonated copper phthalocyanine pigments, organic boron salts, fluorine-containing quaternary ammonium salts, and calixarene compounds. Regarding color toners, not black toners, it goes without saying that use of a charge controlling agent which impairs the intended colors should be avoided and, for example, metal salts such as salicylic acid derivatives, which are white in color, can be suitably used.

The amount of the charge controlling agent is preferably in the range of 0.01 parts by mass to 2 parts by mass, more preferably 0.02 parts by mass to 1 part by mass, with respect to 100 parts by mass of the binder resin (resin contained in the resin particle (B)). When the amount is 0.01 parts by mass or greater, charge controlling capability can be obtained. When the amount is 2 parts by mass or less, the chargeability of the toner does not become too great, effects of a main charge controlling agent are not attenuated, and decrease in fluidity and image density (which is due to increase in electrostatic suction between the toner and a developing roller) is not caused.

<<Deforming Agent>>

The toner of the present invention may include a deforming agent for the purpose of deforming any color toner. The deforming agent may be suitably selected according to the intended purpose as long as the purpose can be achieved. Nevertheless, the deforming agent preferably contains a layered inorganic mineral in which at least some of interlayer ions have been modified with organic ions. In the present invention, the layered inorganic mineral in which at least some of interlayer ions have been modified with organic ions, which is usable as the deforming agent in the present invention, is not particularly limited and may be suitably selected according to the intended purpose. Nevertheless, preference is given to a layered inorganic mineral having a smectite-based crystalline structure, modified with organic cations. Additionally, by replacing part of a divalent metal of the layered inorganic mineral with a trivalent metal, metal anions can be introduced. It should, however, be noted that the introduction of metal anions causes an increase in hydrophilicity, and so preference is given to a layered inorganic compound in which at least some of metal anions have been modified with organic anions.

The organic cation modifier for use with the layered inorganic mineral in which at least some of ions are modified with organic ions is not particularly limited as long as it can induce the modification as mentioned above. Examples thereof include quaternary alkyl ammonium salts, phosphonium salts and imidazolium salts. Among these, quaternary alkyl ammonium salts are preferable. Examples of quaternary alkyl ammoniums therefor include trimethylstearylammonium, dimethylstearylbenzylammonium and oleylbis(2-hydroxyethyl)methylammonium.

The organic anion modifier for use with the layered inorganic mineral in which at least some of ions are modified with organic ions is not particularly limited as long as it can induce the modification as mentioned above. Examples thereof include sulfates, sulfonates, carboxylates or phosphates, which contain branched, unbranched or cyclic alkyls (C1-C44), alkenyls (C1-C22), alkoxys (C8-C32), hydroxyalkyls (C2-C22), ethylene oxide, propylene oxide, etc. Preference is given to carboxylic acid having ethylene oxide skeletons.

By modifying some of ions of the layered inorganic mineral with organic ions, appropriate hydrophobicity can be yielded, the oil phases (O1) and (O2) including a toner composition has a non-Newtonian viscosity, and the toner can be deformed. Here, the layered inorganic mineral partially modified with organic ions preferably occupies 0.05% by mass to 10% by mass, more preferably 0.05% by mass to 5% by mass, of the materials for the toner.

The layered inorganic mineral partially modified with organic ions may be suitably selected, and examples thereof include montmorillonite, bentonite, hectorite, attapulgite, sepiolite, and mixtures thereof. Among these, organically modified montmorillonite or bentonite is preferable in that toner properties are not adversely affected, viscosity adjustment can be facilitated, and the amount thereof can be small.

Examples of the layered inorganic mineral partially modified with organic ions, as commercially available products, include quaternium-18 bentonite, or more specifically, BENTONE 3, BENTONE 38 AND BENTONE 38V (manufactured by Rheox, Inc.), TIXOGEL VP (manufactured by United Catalyst Corporation), and CLAYTONE 34, CLAYTONE 40 and CLAYTONE XL (manufactured by Southern Clay Products, Inc.); stearalkonium bentonite, or more specifically, BENTONE 27 (manufactured by Rheox, Inc.), TIXOGEL LG (manufactured by United Catalyst Corporation) and CLAYTONE AF and CLAYTONE APA (manufactured by Southern Clay Products, Inc.); quaternium-18/benzalkonium bentonite, or more specifically, CLAYTONE HT and CLAYTONE PS (manufactured by Southern Clay Products, Inc.). Preferable among these are CLAYTONE AF and CLAYTONE APA. Also, DHT-4A (manufactured by Kyowa Chemical Industry Co., Ltd.) modified with organic anions represented by General Formula (B) below is particularly preferable as the layered inorganic mineral partially modified with organic ions. Examples of organic anions represented by General Formula (B) below include HITENOL 330T (manufactured by DAI-ICHI KOGYO SEIYAKU CO., LTD.).

$$R_1(OR_2)nOSO_3M \qquad \text{General Formula (B)}$$

In General Formula (B), $R_1$ denotes a C13 alkyl group, $R_2$ denotes a C2-C6 alkylene group, n denotes an integer of 2 to 10, and M denotes a monovalent metal element.

<<Colorant>>

The colorant is not particularly limited and may be suitably selected according to the intended purpose. Examples thereof include carbon blacks, nigrosine dyes, iron black, Naphthol Yellow S, Hansa Yellow (10G, 5G, G), cadmium yellow, yellow iron oxide, yellow ocher, yellow lead, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, isoindolinone yellow, red ocher, red lead, lead vermilion, cadmium red, cadmium mercury red, antimony vermilion, Permanent Red 4R, Para Red, Fire Red, p-chlor-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosin Lake, Rhodamine Lake B, Rhodamine Lake Y, Alizarine Lake, Thioindigo Red B, Thioindigo Maroon, oil red, quinacridone red, pyrazolone red, polyazo red, chrome vermilion, benzidine orange, perynone orange, oil orange, cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxane violet, anthraquinone violet, chrome green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone. These may be used individually or in combination.

The color of the colorant of the toner is not particularly limited and may be suitably selected according to the purpose. The colorant may be at least one selected from a colorant of a black toner, a colorant of a cyan toner, a colorant of a magenta toner and a colorant of a yellow toner, and toners of each color can be obtained by appropriately selecting each type of colorant. It is preferred that the colorant be a colorant of a color toner.

Examples of black colorants include carbon blacks (C.I. Pigment Black 7) such as furnace black, lamp black, acetylene black and channel black; metals such as copper, iron (C.I. Pigment Black 11) and titanium oxide; and organic pigments such as aniline black (C.I. Pigment Black 1).

Examples of color pigments for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Vat Red 1, 2, 10, 13, 15, 23, 29 and 35.

Examples of color pigments for cyan include C.I. Pigment Blue 2, 3, 15, 15:1, 15:2, 15:3, 15:4, 15:6, 16, 17 and 60; C.I. Vat Blue 6; C.I. Acid Blue 45, copper phthalocyanine pigments each having as substituent(s) one to five phthalimidemethyl groups on the phthalocyanine skeleton, Green 7 and Green 36.

Examples of color pigments for yellow include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154 and 180; C.I. Vat Yellow 1, 3 and 20, and Orange 36.

The amount of the colorant contained in the toner is preferably in the range of 1% by mass to 15% by mass, more preferably 3% by mass to 10% by mass. When the amount is less than 1% by mass, the coloring capability of the toner may decrease. When the amount is greater than 15% by mass, pigment(s) is/are poorly dispersed in the toner, possibly leading to a decrease in coloring capability and degradation of electrical properties of the toner.

The colorant may be compounded with a resin to form a masterbatch. The resin is not particularly limited and may be suitably selected from resins known in the art, according to the purpose. Examples thereof include polyesters, styrene polymers, polymers of substituted styrene, styrene copolymers, polymethyl methacrylate, polybutyl methacrylate, polyvinyl chloride, polyvinyl acetate, polyethylene, polypropylene, epoxy resins, epoxy polyol resins, polyurethanes, polyamides, polyvinyl butyral, polyacrylic acid resins, rosins, modified rosins, terpene resins, aliphatic hydrocarbon resins, alicyclic hydrocarbon resins, aromatic petroleum resins, chlorinated paraffins and paraffin waxes. Examples thereof also include the polyester resin (b1) having a polyhydroxycarboxylic acid skeleton, which is preferable in that compatibility between the resins improves and the plant matter content increases. These resins may be used individually or in combination.

The masterbatch can be produced by mixing or kneading the colorant and the resin for use in a masterbatch, with the application of high shearing force. In doing so, an organic solvent is preferably added to enhance interaction between the colorant and the resin. Also, use of the so-called flushing method is suitable in that wet cake of the colorant can be used as it is, without requiring drying. The flushing method is a method in which an aqueous paste containing a colorant and water is mixed or kneaded with a resin and an organic solvent and then the colorant is transferred to the resin to remove water and the organic solvent. For this mixing or kneading, a high shearing dispersing device such as a triple roll mill may be used.

<<Release Agent>>

The release agent usable in the toner of the present invention is not particularly limited and may be suitably selected according to the intended purpose. Suitable example thereof include waxes. Examples of these waxes include non-free-fatty-acid type carnauba wax, polyethylene wax, montan wax and oxidized rice wax, which may be used individually or in combination.

It is preferred that the carnauba wax be in fine crystalline form, have an acid value of 5 mgKOH/g or less, and have an particle diameter of 1 μm or less when dispersed in a toner binder.

The montan wax is generally a montan-based wax obtained by refining a mineral. It is preferred that the montan wax be in fine crystalline form as in the case of the carnauba wax, and have an acid value of 5 mgKOH/g to 14 mgKOH/g.

The oxidized rice wax is rice bran wax oxidized with air. The oxidized rice wax preferably has an acid value of 10 mgKOH/g to 30 mgKOH/g.

Any of these waxes can finely disperse into the binder resin of the toner of the present invention, so that the toner can be easily made superior in offset preventability, transfer capability and durability as described later. These waxes may be used individually or in combination.

Examples of other release agents include conventionally known release agents such as solid silicone waxes, higher fatty acid higher alcohols, montan-based ester waxes, polyethylene waxes and polypropylene waxes.

The glass transition temperature Tg of the release agent is not particularly limited and may be suitably selected according to the intended purpose. Nevertheless, it is preferably in the range of 70° C. to 90° C. When the glass transition temperature is lower than 70° C., the heat-resistant storage stability of the toner may degrade. When the glass transition temperature is higher than 90° C., separability of the toner at low temperatures is not sufficiently exhibited, so that there may be degradation of cold offset resistance, and paper may be wound around a fixing device.

The amount of the release agent is not particularly limited. Nevertheless, the amount of the release agent is preferably 1% by mass to 20% by mass, more preferably 3% by mass to 10% by mass, with respect to the resin components of the toner. When the amount is less than 1% by mass, offset may not be sufficiently prevented. When the amount is greater than 20% by mass, transfer capability and durability may degrade.

<<Fine Inorganic Particle>>

The toner of the present invention may include a fine inorganic particle as an external additive for giving fluidity, developing capability, chargeability, etc. to a toner particle.

The fine inorganic particle is not particularly limited and may be suitably selected according to the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide and silicon nitride. These may be used individually or in combination. The fine inorganic particle preferably has a primary particle diameter of 5 nm to 2 μm, more preferably 5 nm to 500 nm.

The fine inorganic particle preferably occupies 0.01% by mass to 5.0% by mass, more preferably 0.01% by mass to 2.0% by mass, of the toner. With this range, it is possible to improve the fluidity, developing capability and chargeability of the toner.

<<Fluidity Improver>>

The fluidity improver means a fluidity improver capable of performing surface treatment to improve hydrophobicity and preventing degradation of flow properties and charging properties even at high humidity. Examples thereof include silane coupling agents, silylation agents, silane coupling agents containing alkyl fluoride groups, organic titanate-based coupling agents, aluminum-based coupling agents, silicone oil and modified silicone oil. Silica and titanium oxide, in particular, are preferably surface-treated with such a fluidity improver and used as hydrophobic silica and hydrophobic titanium respectively.

<<Cleanability Improver>>

The cleanability improver is added to the toner to remove a developer remaining on a photoconductor and/or an primary transfer member after image transfer. Examples thereof include metal salts of fatty acids such as of stearic acid, e.g. zinc stearate and calcium stearate; and fine polymer particles produced by soap-free emulsion polymerization, e.g. fine particles of polymethyl methacrylate and polystyrene. As to the fine polymer particles, those which have a relatively narrow particle size distribution and which have a volume average particle diameter of 0.01 μm to 1 μm are favorable.

<Magnetic Material>

The magnetic material is not particularly limited and may be suitably selected from magnetic materials known in the art, according to the purpose. Examples thereof include iron powder, magnetite and ferrite. Among these, those which are white in color are preferable in terms of color tone.

(Developer)

A developer of the present invention includes the toner of the present invention, and suitably selected other component(s) such as a carrier. The developer of the present invention may be a one-component developer or a two-component developer. In the case where the developer is used, for example, in a high-speed printer, etc. adaptable to the present-day increase in information processing speed, it is preferred that the developer be a two-component developer in view of an increase in lifetime, etc.

<Carrier>

The carrier is not particularly limited and may be suitably selected according to the purpose. Nevertheless, preference is given to a carrier including a core material, and a resin layer that covers the core material.

The material for the core material is not particularly limited and may be suitably selected from materials known in the art. For example, manganese-strontium (Mn—Sr) materials (50 emu/g to 90 emu/g) and manganese-magnesium (Mn—Mg) materials (50 emu/g to 90 emu/g) are preferable. In terms of securing appropriate image density, highly magnetized materials such as iron powder (100 emu/g or greater) and magnetite (75 emu/g to 120 emu/g) are preferable. In terms of the fact that the contact force on a latent electrostatic image bearing member, where toner particles are disposed in an upright position, can be reduced and image quality can be advantageously improved, weakly magnetized materials such as copper-zinc (Cu—Zn) materials (30 emu/g to 80 emu/g) are preferable. These may be used individually or in combination.

The particle diameter of the core material as an average particle diameter (weight average particle diameter (D50)) is preferably in the range of 10 μm to 200 μm, more preferably 40 μm to 100 μm. When the average particle diameter (weight average particle diameter (D50)) is less than 10 μm, the amount of fine powder increases in the distribution of carrier particles, and this increase causes a decrease in magnetization per particle and thus possibly causes scattering of the carrier. When it is greater than 200 μm, the specific surface area of the carrier particles decreases, thereby possibly causing scattering of the toner, and possibly degrading reproduction of solid portions in the case of full-color images that contain plenty of solid portions.

The material for the resin layer is not particularly limited and may be suitably selected from resins known in the art, according to the purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers (fluorinated triple (multiple) copolymers) such as a terpolymer composed of tetrafluoroethylene, vinylidene fluoride and a nonfluorinated monomer, and silicone resins. These may be used individually or in combination. Among these, silicone resins are particularly preferable in that filming of the toner to the carrier can be effectively prevented.

The silicone resins usable to form the resin layer are not particularly limited and may be suitably selected from generally known silicone resins according to the purpose. Examples thereof include straight silicone resins which contain organo-siloxane bonds only; and silicone resins modified with alkyd resins, polyester resins, epoxy resins, acrylic resins, urethane resins, etc.

The silicone resins may be commercially available products. Examples thereof as straight silicone resins include KR271, KR255 and KR152, manufactured by Shin-Etsu Chemical Co., Ltd.; and SR2400, SR2406 and SR2410, manufactured by Dow Corning Toray Silicone Co., Ltd.

The modified silicone resins may be commercially available products. Examples thereof include KR206 (alkyd-modified resin), KR5208 (acrylic-modified resin), ES1001N (epoxy-modified resin) and KR305 (urethane-modified resin), manufactured by Shin-Etsu Chemical Co., Ltd.; and SR2115 (epoxy-modified resin) and SR2110 (alkyd-modified resin), manufactured by Dow Corning Toray Silicone Co., Ltd.

These silicone resins may be used solely or in combination with components subject to cross-linking reaction, components for adjusting the charge amount, etc.

If necessary, the resin layer that covers the core material may contain conductive powder, etc. Examples of the conductive powder include metal powder, carbon blacks, titanium oxide, tin oxide and zinc oxide. The average particle diameter of any of these conductive powders is preferably 1 μm or less. When the average particle diameter is greater than 1 μm, it may be difficult to control electric resistance.

The resin layer that covers the core material can, for example, be formed by dissolving a silicone resin, etc. in an organic solvent so as to prepare a coating solution, then uniformly applying the coating solution over the surface of the core material by a coating method known in the art, which is followed by drying, and subsequently firing the dried coating solution. Examples of the coating method include immersion, spraying, and coating with the use of a brush.

The organic solvent is not particularly limited and may be suitably selected according to the purpose. Examples thereof include toluene, xylene, methyl ethyl ketone, methyl isobutyl ketone, cellosolve and butyl acetate.

The firing of the resin layer is not particularly limited and may be based upon external heating or internal heating. For example, the firing may be carried out in accordance with a method using a stationary electric furnace, a fluid-type electric furnace, a rotary electric furnace, a burner furnace, etc., or a method using a microwave.

The amount of the resin layer contained in the carrier is preferably in the range of 0.01% by mass to 5.0% by mass. When the amount is less than 0.01% by mass, it may be impossible to uniformly form the resin layer over the surface of the core material. When the amount is greater than 5.0% by mass, the resin layer is so thick that granulation among carrier particles occurs, thereby possibly making it impossible to obtain uniform carrier particles.

In the case where the developer is a two-component developer, the amount of the carrier contained in the two-component developer is not particularly limited and may be suitably selected according to the purpose. As for the mixture proportion of the toner to the carrier in the two-component developer, the amount of the toner is 1 part by mass to 10.0 parts by mass with respect to 100 parts by mass of the carrier.

(Image Forming Method and Image Forming Apparatus)

An image forming method of the present invention includes a latent electrostatic image forming step, a developing step, a transfer step and a fixing step. If necessary, the image forming method may further include suitably selected other step(s) such as a charge eliminating step, a cleaning step, a recycling step and a controlling step.

An image forming apparatus of the present invention includes a Latent electrostatic image bearing member, a latent electrostatic image forming unit, a developing unit, a transfer unit and a fixing unit. If necessary, the image forming apparatus may further include suitably selected other unit(s) such as a charge eliminating unit, a cleaning unit, a recycling unit and a controlling unit.

<Latent Electrostatic Image Forming Step and Latent Electrostatic Image Forming Unit>

The latent electrostatic image forming step is a step of forming a Latent electrostatic image on a latent electrostatic image bearing member. The material, shape, structure, size, etc. of the latent electrostatic image bearing member (hereinafter referred to also as "electrophotographic photoconductor", "photoconductor" or "image bearing member") are not particularly limited and may be suitably selected from those known in the art. Suitable examples of the shape include drum-like shapes. As for the material, the photoconductor may, for example, be an inorganic photoconductor including amorphous silicon, selenium, etc. or an organic photoconductor (OPC) including polysilane, phthalopolymethine, etc. Among these materials, amorphous silicon and the like are preferable in that the lifetime of the photoconductor is long.

The latent electrostatic image can be formed, for example by uniformly charging the surface of the latent electrostatic image bearing member and then exposing the surface imagewise, which can be suitably performed by the latent electrostatic image forming unit. For example, the latent electrostatic image forming unit includes at least a charging device configured to charge the surface of the image bearing member uniformly, and an exposing device configured to expose the surface of the image bearing member imagewise.

The charging can be performed, for example by applying voltage to the surface of the latent electrostatic image bearing member, using a charging device. The charging device is not particularly limited and may be suitably selected according to the intended purpose. Preferred examples thereof include known contact-type charging devices provided with conductive or semiconductive rolls, brushes, films, rubber blades, etc. and non-contact-type charging devices utilizing corona discharge, such as corotron chargers and scorotron chargers. It is preferred that the charging device be placed in contact with or not in contact with the latent electrostatic image bearing member and charge the surface of the latent electrostatic image bearing member by applying DC and AC voltages in a superimposed manner. It is also preferred that the charging device be a charging roller placed close to the latent electrostatic image bearing member in a noncontact manner with a gap tape situated in between, and that the charging device charge the surface of the latent electrostatic image bearing member by applying DC and AC voltages to the charging roller in a superimposed manner.

The exposure can be performed, for example by exposing the surface of the latent electrostatic image bearing member imagewise, using an exposing device. The exposing device is not particularly limited as long as it can expose, in the intended imagewise manner, the surface of the image bearing member charged by the charging device, and the exposing device may be suitably selected according to the intended purpose. Examples thereof include exposing devices which employ a copying optical system, a rod lens array system, a laser optical system, a liquid crystal shutter optical system, etc. Parenthetically, in the present invention, a backlighting method may be employed in which imagewise exposure is performed from the back surface side of the image bearing member.

<Developing Step and Developing Unit>

The developing step is a step of developing the latent electrostatic image with the use of the toner or the developer according to the present invention so as to form a visible image. The visible image can be formed, for example by developing the latent electrostatic image with the use of the toner or the developer according to the present invention, which can be suitably performed by the developing unit. The developing unit is not particularly limited as long as it can develop the latent electrostatic image with the use of the toner or the developer, and it may be suitably selected from developing units known in the art. Preferred examples thereof include a developing unit incorporating at least a developing device which houses the toner or the developer according to the present invention and which is capable of providing the developer to the latent electrostatic image in a contact or non-contact manner.

The developing device may be of dry developing type or of wet developing type and may be a developing device for a single color or a developing device for multiple colors. Suitable examples thereof include a developing device incorporating a stirrer for stirring the developer with friction and thus charging it, and also incorporating a rotatable magnet roller.

In the developing device, for example, the toner and a carrier are mixed and stirred, the toner is charged by the friction generated upon the mixing and stirring, and toner particles are held in an upright position on the surface of the rotating magnet roller, thereby forming a magnetic brush. Since the magnet roller is placed in the vicinity of the latent electrostatic image bearing member (photoconductor), part of the toner constituting the magnetic brush formed on the surface of the magnet roller moves to the surface of the latent electrostatic image bearing member (photoconductor) by electrical suction. As a result, the latent electrostatic image is developed with the toner, and a visible image made of the toner is formed on the surface of the latent electrostatic image bearing member (photoconductor).

<Transfer Step and Transfer Unit>

The transfer step is a step of transferring the visible image to a recording medium. A preferred aspect of the transfer step is such that an intermediate transfer member is used, a visible image is primarily transferred onto the intermediate transfer member and then this visible image is secondarily transferred onto a recording medium. A more preferred aspect of the transfer step is such that toners of two or more colors, preferably full-color toners, are used, and there are provided a primary transfer step of transferring visible images onto an intermediate transfer member so as to form a compound transfer image thereon, and a secondary transfer step of transferring this compound transfer image onto a recording medium. The transfer can be performed, for example by charging the visible image on the latent electrostatic image bearing member (photoconductor), using a transfer charging device, which can be suitably performed by the transfer unit. A preferred aspect of the transfer unit is such that there are provided a primary transfer unit configured to transfer visible images onto an intermediate transfer member so as to form a compound transfer image thereon, and a secondary transfer unit configured to transfer this compound transfer image onto a recording medium. The intermediate transfer member is not particularly limited and may be suitably selected from transfer members known in the art, according to the intended purpose. Suitable examples thereof include transfer belts.

The transfer unit (primary transfer unit and secondary transfer unit) preferably includes at least a transfer device for charging and thus separating the visible image formed on the latent electrostatic image bearing member (photoconductor) toward the recording medium side. Regarding the transfer unit(s), one transfer unit, or two or more transfer units may be provided. Examples of the transfer device include corona transfer devices utilizing corona discharge, transfer belts, transfer rollers, pressure transfer rollers and adhesion transfer devices. The recording medium is not particularly limited and may be suitably selected from recording media (recording papers) known in the art.

<Fixing Step and Fixing Unit>

The fixing step is a step of fixing the transferred visible image to the recording medium, using the fixing unit. The fixing may be performed separately upon transfer of toners of each color to the recording medium, or may be performed at one time with toners of each color in a laminated state.

The fixing unit is not particularly limited and may be suitably selected according to the intended purpose. Nevertheless, the fixing unit is preferably a known heating and pressurizing unit. Examples of the heating and pressurizing unit include a combination of a heating roller and a pressurizing roller, and a combination of a heating roller, a pressurizing roller and an endless belt. It is preferred that the fixing unit include a heating member equipped with a heat-generating member, a film placed in contact with the heating member, and a pressurizing member pressed against the heating member with the film being situated in between, and that the fixing unit be a unit which passes between the film and the pressurizing member a recording medium with an unfixed image formed thereon. In general, the temperature at which heating is performed by the heating and pressurizing unit is preferably in the range of 80° C. to 200° C. In the present invention, an optical fixing device known in the art may, for example, be used together with or instead of the fixing step and the fixing unit.

<Other Step(s) and Other Unit(s)>

<<Charge Eliminating Step and Charge Eliminating Unit>>

The charge eliminating step is a step of eliminating charge by applying a charge eliminating bias to the latent electrostatic image bearing member, which can be suitably performed by the charge eliminating unit. The charge eliminating unit is not particularly limited as long as it can apply a charge eliminating bias to the latent electrostatic image bearing member, and it may be suitably selected from charge eliminating devices known in the art. Suitable examples thereof include charge eliminating lamps.

<<Cleaning Step and Cleaning Unit>>

The cleaning step is a step of removing the toner remaining on the latent electrostatic image bearing member, which can be suitably performed by the cleaning unit. The cleaning unit is not particularly limited as long as it can remove the toner remaining on the latent electrostatic image bearing member, and it may be suitably selected from cleaners known in the art. Suitable examples thereof include magnetic brush cleaners, electrostatic brush cleaners, magnetic roller cleaners, blade cleaners, brush cleaners and web cleaners.

<<Recycling Step and Recycling Unit>>

The recycling step is a step of returning the toner removed by the cleaning step to the developing unit, which can be suitably performed by the recycling unit. The recycling unit is not particularly limited. Examples thereof include conveyance units known in the art.

<<Control Step and Control Unit>>

The control step is a step of controlling the above-mentioned steps of the image forming method of the present invention, which can be suitably performed by the control unit. The control unit is not particularly limited as long as it can control operations of the above-mentioned units of the image forming apparatus of the present invention, and it may be suitably selected according to the intended purpose. Examples thereof include apparatuses such as sequencers and computers.

One embodiment of the image forming method of the present invention put into practice by the image forming apparatus of the present invention will be described with reference to FIG. 1. An image forming apparatus 100 shown in FIG. 1 includes a photoconductor drum 10 (hereinafter referred to as "photoconductor 1C") as the latent electrostatic image bearing member, a charging roller 20 as the charging unit, an exposing device 30 as the exposing unit, a developing unit 45 as the developing unit, an intermediate transfer member 50, a cleaning device 60 as the cleaning unit having a cleaning blade, and a charge eliminating lamp 70 as the charge eliminating unit.

The intermediate transfer member 50 is an endless belt and is designed so as to move in the direction shown by the arrow in FIG. 1 by means of three rollers 51 which is placed on its inside and supports it. At least one of the three rollers 51 functions also as a transfer bias roller capable of applying a certain transfer bias (primary transfer bias) to the intermediate transfer member 50. A cleaning device 90 such as an intermediate transfer member cleaning blade is placed close to the intermediate transfer member 50. Facing the intermediate transfer member 50, a transfer roller 80 as the transfer unit capable of applying a transfer bias for transferring (secondarily transferring) a visible image (toner image) to a recording medium 95 such as transfer paper. A corona charger 58 for applying a charge to a visible image on the intermediate transfer member 50 is placed around the intermediate transfer member 50. The corona charger 58 is placed between the portion where the photoconductor 10 is in contact with the intermediate transfer member 50 and the portion where the intermediate transfer member 50 is in contact with the recording medium 95, with respect to the rotational direction of the intermediate transfer member 50.

The developing device 45 includes a black developing unit 45K, a yellow developing unit 45Y, a magenta developing unit 45M and a cyan developing unit 45C. The black developing unit 45K includes a developer container 42K, a developer supplying roller 43K and a developing roller 44K. The yellow developing unit 45Y includes a developer container 42Y, a developer supplying roller 43Y and a developing roller 44Y. The magenta developing unit 45M includes a developer container 42M, a developer supplying roller 43M and a developing roller 44M. The cyan developing unit 45C includes a developer container 42C, a developer supplying roller 43C and a developing roller 44C.

In the image forming apparatus 100 shown in FIG. 1, the photoconductor 10 is uniformly charged by, for example, the charging roller 20. The exposing device 30 then performs imagewise exposure over the photoconductor 10 so as to form a latent electrostatic image on the photoconductor 10. The latent electrostatic image formed on the photoconductor 10 is provided with a toner from the developing device 45 to develop the latent electrostatic image and thereby form a visible image (toner image). This visible image (toner image) is transferred (primarily transferred) onto the intermediate transfer member 50 by a voltage applied by the rollers 51 and then transferred (secondarily transferred) onto the recording medium 95 such as transfer paper. As a result, a transferred image is formed on the recording medium 95 such as transfer paper. Parenthetically, residual toner remaining on the photoconductor 10 is removed by the cleaning device 60, and the charge on the photoconductor 10 is removed by the charge eliminating lamp 70 on a temporary basis.

Figure 2:
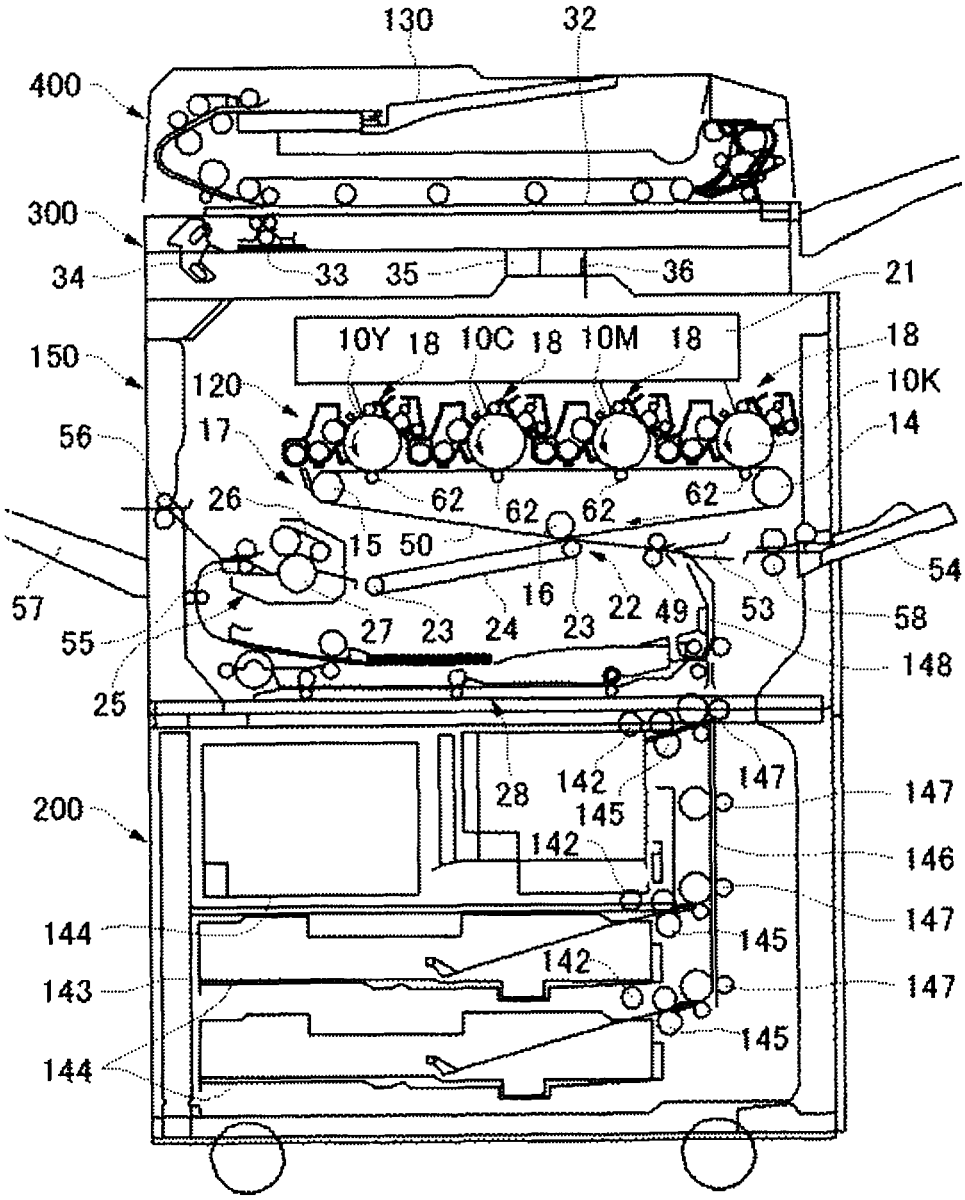
FIG. 2 is a schematic explanatory drawing showing an example of a tandem-type color image forming apparatus used in an image forming method of the present invention.

Here, another embodiment of the image forming method of the present invention put into practice by the image forming apparatus is described referring to FIG. 2. The tandem image forming apparatus shown in FIG. 2 is a tandem-type color image forming apparatus. This tandem image forming apparatus includes a copier main body 150, a paper feed table 200, a scanner 300 and an automatic document feeder (ADF) 400.

The copier main body 150 has at its center an intermediate transfer member 50 in the form of an endless belt. The intermediate transfer member 50 is supported by support rollers 14, 15 and 16 and enabled to rotate clockwise in FIG. 2. An intermediate transfer member cleaning unit 17 for removing residual toner remaining on the intermediate transfer member 50 is placed in the vicinity of the support roller 15. Over the intermediate transfer member 50 supported by the support rollers 14 and 15, there is placed a tandem-type developing device 120 in which four image-forming units 18 for yellow, cyan, magenta and black are aligned in the conveyance direction of the intermediate transfer member 50. An exposing device 21 is placed close to the tandem-type developing device 120. A secondary device 22 is placed on the side of the intermediate transfer member 50 opposite to the side where the tandem-type developing device 120 is placed. The secondary transfer device 22 includes a secondary transfer belt 24 (which is an endless belt), and a pair of rollers 23 supporting the secondary transfer belt 24. Contact between the intermediate transfer member 50 and a recording medium (transfer paper) conveyed on the secondary transfer belt 24 is enabled. A fixing device 25 is placed in the vicinity of the secondary transfer device 22. The fixing device 25 includes a fixing belt 26 which is an endless belt, and a pressurizing roller 27 which is pressed by the fixing belt 26. In the tandem image forming apparatus, a sheet reverser 28 for turning over transfer paper to form images on both sides of the transfer paper is placed close to the secondary transfer device 22 and the fixing device 25.

Next, full-color image formation (color copying) using the tandem-type developing device 120 will be explained. First of all, a document is set on a document tray 130 of the automatic document feeder (ADF) 400. Alternatively, the automatic document feeder 400 is opened, the document is placed on a contact glass 32 of the scanner 300, and the automatic document feeder 400 is closed.

When a start switch (not shown) is pushed, the scanner 300 is driven after the document is conveyed and moved onto the contact glass 32, in the case where the document is set on the document tray of the automatic document feeder 400, or the scanner 300 is immediately driven in the case where the document is set on the contact glass 32. Thus, a first carriage 33 and a second carriage 34 move. Light coming from a light source is applied to the document by means of the first carriage 33, and the light reflected from the document surface is further reflected by a mirror of the second carriage 34. The reflected light passes through an image forming lens 35 and then is received by a reading sensor 36, and a color document (color image) is read, thereby producing image information of black, yellow, magenta and cyan.

Figure 3:
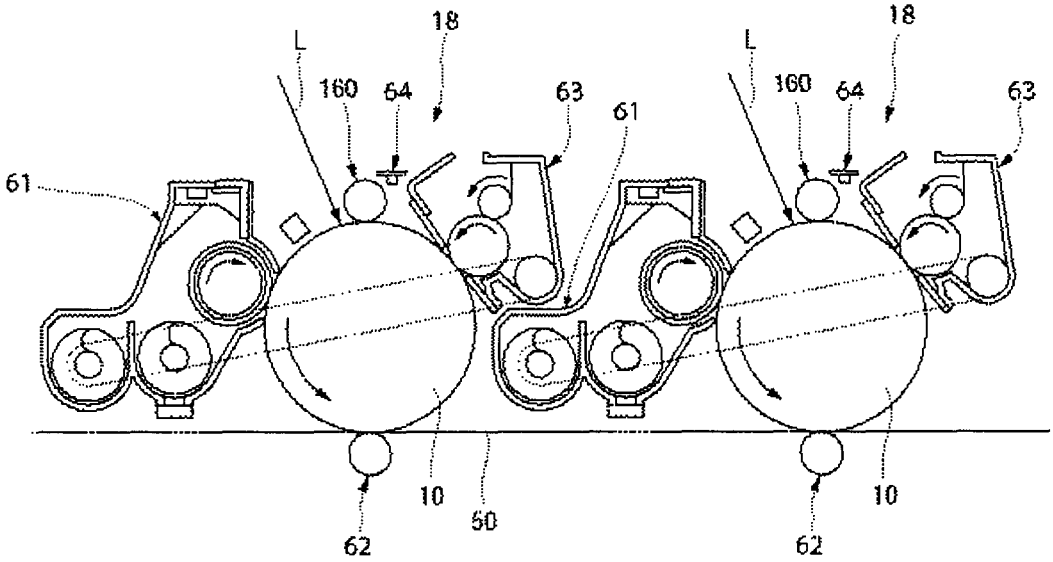
FIG. 3 is a partially enlarged schematic explanatory drawing of the image forming apparatus shown in FIG. 2.

Pieces of image information of black, yellow, magenta and cyan are transmitted to the image forming units 18 (the image forming unit for black, the image forming unit for yellow, the image forming unit for magenta and the image forming unit for cyan) in the tandem-type developing device 120, and toner images of black, yellow, magenta and cyan are formed in the image forming units. As shown in FIG. 3, each of the image forming units 18 (the image forming unit for black, the image forming unit for yellow, the image forming unit for magenta and the image forming unit for cyan) in the tandem developing unit 120 includes: a photoconductor 10 (a black photoconductor 10K, a yellow photoconductor 10Y, a magenta photoconductor 10M or a cyan photoconductor 10C); a charging device 160 which uniformly charges the photoconductor 10; an exposing device which exposes the photoconductor in an imagewise manner corresponding to each color image based on each piece of color image information (as shown by the arrow L in FIG. 3) so as to form on the photoconductor a latent electrostatic image corresponding to each color image; a developing device 61 which develops the latent electrostatic image with the use of each color toner (black toner, yellow toner, magenta toner and cyan toner) so as to form a toner image of each color; a transfer charger 62 for transferring the toner image onto the intermediate transfer member 50; a cleaning device 63; and a charge eliminating unit 64. Thus, images of each single color (a black image, a yellow image, a magenta image and a cyan image) can be formed based on the pieces of image information of each color. The black image, the yellow image, the magenta image and the cyan image thus formed on the black photoconductor 10K, the yellow photoconductor 10Y, the magenta photoconductor 10M and the cyan photoconductor 10C respectively are sequentially transferred (primarily transferred) onto the intermediate transfer member 50 rotationally moved by the support rollers 14, 15 and 16. The black image, the yellow image, the magenta image and the cyan image are superimposed on the intermediate transfer member 50 to form a composite color image (color transfer image).

Meanwhile, in the paper feed table 200, one of paper feed rollers 142 is selectively rotated, whereby sheets (recording paper) are ejected from one of multiple paper feed cassettes 144 in a paper bank 143, then separated one by one by a separation roller 145 and sent to a paper feed path 146. The sheets (recording paper) are then conveyed by a conveyance roller 147 to a paper feed path 148 inside the copier main body 150 and bumped against a resist roller 49 to stop. Alternatively, sheets (recording paper) placed on a manual feed tray 54 are ejected by rotating another one of the paper feed rollers 142, separated one by one by the separation roller 145, fed through a manual paper feed path 53, and similarly, bumped against the resist roller 49 to stop. Noted that the resist roller 49 is generally grounded, and it may be used while a bias is applied so as to remove paper powder on the sheets. The resist roller 49 is rotated synchronously with the movement of the composite color image (color transfer image) on the intermediate transfer member 50 to send a sheet (recording paper) between the intermediate transfer member 50 and the secondary transfer device 22, and the composite color image (color transfer image) is transferred (secondarily transferred) onto the sheet (recording paper) by the secondary transfer device 22. By doing so, the color image is formed on the sheet (recording paper). Note that residual toner remaining on the intermediate transfer member 50 after the image transfer is cleaned by the cleaning unit 17.

The sheet (recording paper) on which the transferred color image is formed is conveyed by the secondary transfer device 22 to the image fixing device 25, where the composite color image (color transfer image) is fixed onto the sheet (recording paper) by means of heat and pressure. Thereafter, the sheet (recording paper) is changed in direction by the action of a switch claw 55, discharged by a discharge roller 56 and laid over a discharge tray 57. Alternatively, the sheet (recording paper) is changed in direction by the action of the switch claw 55, turned over by the sheet reverser 28 and then transferred back to the image transfer position where an image is recorded on the opposite side of the sheet. Thereafter, the sheet is discharged by the ejecting roller 56 and laid over the discharge tray 57.

EXAMPLES

The following explains Examples of the present invention. It should, however, be noted that the scope of the present invention is not confined to these Examples.

Production Example 1

Production of Resin (b-1)

The raw materials shown in relation to "polyester diol (b11-1)" in Table 1 were heated and melted at 120° C. for 20 minutes in an autoclave reactor equipped with a thermometer, a stirrer and a nitrogen introducing pipe. Thereafter, 2 parts by mass of tin octylate was added, the ingredients were subjected to ring-opening polymerization reaction for 3 hours at normal pressure and 160° C., and further, the ingredients were subjected to the reaction for 1 hour at normal pressure and 130° C. The produced resin was taken out, cooled to room temperature and then formed into pulverized particles, and a polyester diol (b11-1) having a polyhydroxycarboxylic acid skeleton was thus obtained.

The polyester diol (b11-1) had a number average molecular weight (Mn) of 3,000 and a weight average molecular weight (Mw) of 5,000.

Subsequently, the polyester diol (b1'-1) obtained as described above, and a polyester diol (b12) later obtained by subjecting to dehydration condensation the raw materials shown in relation to "polyester diol (b12)" in Table 1 were dissolved in methyl ethyl ketone. Then isophorone diisocyanate (IPDI) as an elongating agent was added so as to effect elongation reaction at 50° C. for 6 hours, residual lactide and the solvent were distilled away at reduced pressure, and a resin (b-1) of Production Example 1 was thus obtained. The resin (b-1) had a number average molecular weight (Mn) of 2,900 and a weight average molecular weight (Mw) of 13,000.

TABLE 1

| | | Resin (b) | | | | |
|---|---|---|---|---|---|---|
| | | | | | Polyester diol (b12) | |
| | | Polyester diol (b11-1) | | | EO (2 mol) adduct of | Terephthalic |
| | | 1,3-propanediol | L-lactide | D-lactide | bisphenol A | acid |
| Production Example 1 | Resin (b-1) | 2 | 54 | 14 | 15 | 15 |

(In Table 1, the numerical values are based upon parts by mass.)

Production Example 2

Production of Resin (b-2)

The raw materials shown in relation to "polyester diol (b11-2)" in Table 2 were heated and melted at 120° C. for 20 minutes in an autoclave reactor equipped with a thermometer, a stirrer and a nitrogen introducing pipe. Thereafter, 2 parts by mass of tin octylate was added, the ingredients were subjected to ring-opening polymerization reaction for 10 hours at normal pressure and 160° C., and further, the ingredients were subjected to the reaction for 1 hour at normal pressure and 130° C. After that, residual lactide was distilled away at reduced pressure, and a resin (b-2) of Production Example 2 was thus obtained. The resin (b-2) had a number average molecular weight (Mn) of 8,900 and a weight average molecular weight (Mw) of 35,000.

TABLE 2

| | | Resin (b) Polyester diol (b11-2) | | |
|---|---|---|---|---|
| | | 1,3-propanediol | L-lactide | D-lactide |
| Production Example 2 | Resin (b-2) | 2 | 54 | 14 |

(In Table 2, the numerical values are based upon parts by mass.)

Production Example 3

Production of Resin (b-3)

The raw materials shown in Table 3 were poured into a four-necked flask and then heated and melted at 120° C. for 20 minutes in a nitrogen atmosphere. Thereafter, 1 part by mass of tin octylate was added, and the ingredients were heated and melted at 190° C. for 3 hours. After that, residual lactide and caprolactone were distilled away at reduced pressure, and a resin (b-3) of Production Example 3 was thus obtained. The resin (b-3) had a number average molecular weight (Mn) of 9,000 and a weight average molecular weight (Mw) of 40,000.

TABLE 3

| | Resin (b) | | |
|---|---|---|---|
| | L-lactide | D-lactide | ϵ-caprolactone |
| Production Example 3 Resin (b-3) | 80 | 20 | 10 |

(In Table 3, the numerical values are based upon parts by mass.)

Production Example 4

Production of Resin (b-4)

The raw materials shown in Table 4, and 2 parts by mass of dibutyltin oxide were poured into an autoclave reactor equipped with a thermometer, a condenser tube, a stirrer and a nitrogen introducing pipe. The ingredients were subjected to reaction for 8 hours at normal pressure and 230° C., and further, the ingredients were subjected to the reaction for 5 hours at a reduced pressure of 10 mmHg to 15 mmHg. After that, 44 parts by mass of trimellitic anhydride was poured into the reactor, the ingredients were subjected to reaction for 2 hours at normal pressure and 180° C., and a resin (b-4) of Production Example 4 was thus obtained. The resin (b-4) had a number average molecular weight (Mn) of 2,500 and a weight average molecular weight (Mw) of 6,700.

TABLE 4

| | Resin (b) | | | |
|---|---|---|---|---|
| | EO (2 mol) adduct of bisphenol A | PO (3 mol) adduct of bisphenol A | Terephthalic acid | Adipic acid |
| Production Example 4 Resin (b-4) | 229 | 529 | 208 | 46 |

(In Table 4, the numerical values are based upon parts by mass.)

Production Example 5

Synthesis of Polyester Prepolymer

The ingredients shown below were poured into a reaction container equipped with a condenser tube, a stirrer and a nitrogen introducing pipe, and the ingredients were subjected to reaction for 8 hours at normal pressure and 230° C. Thereafter, the ingredients were subjected to the reaction for 7 hours at a reduced pressure of 10 mmHg to 15 mmHg, and an intermediate polyester resin was thus synthesized.

| | |
|---|---|
| Ethylene oxide (2 mol) adduct of bisphenol A | 720 parts by mass |
| Propylene oxide (2 mol) adduct of bisphenol A | 90 parts by mass |
| Terephthalic acid | 290 parts by mass |
| Trimellitic anhydride | 25 parts by mass |
| Dibutyltin oxide | 2 parts by mass |

The obtained intermediate polyester resin had a number average molecular weight (Mn) of 2,500, a weight average molecular weight (Mw) of 10,700, a peak molecular weight of 3,400, a glass transition temperature (Tg) of 57° C., an acid value of 0.4 mgKOH/g and a hydroxyl value of 49 mgKOH/g.

Next, the ingredients shown below were poured into a reaction container equipped with a condenser tube, a stirrer and a nitrogen introducing pipe, and the ingredients were subjected to reaction for 8 hours at normal pressure and 100° C. so as to synthesize a polyester prepolymer.

| | |
|---|---|
| Intermediate polyester resin | 400 parts by mass |
| Isophorone diisocyanate | 95 parts by mass |
| Ethyl acetate | 580 parts by mass |

The obtained polyester prepolymer had a free isocyanate content of 1.42% by mass.

Production Example 6

Synthesis of Ketimine Compound

Thirty parts by mass of isophoronediamine and 70 parts by mass of methyl ethyl ketone were placed in a reaction container equipped with a stirring rod and a thermometer, and subjected to reaction at 50° C. for 5 hours so as to synthesize a ketimine compound. The obtained ketimine compound had an amine value of 423 mgKOH/g.

Production Example 7

Production of Masterbatch

The ingredients shown below were mixed using a Henschel

| Mixer (manufactured by Mitsui Mining Co., Ltd.). | |
|---|---|
| Water | 1,000 parts by mass |
| Carbon black (PRINTEX 35, manufactured by Degussa GmbH) (DBP oil absorption: 42 mL/100 g, pH: 9.5) | 530 parts by mass |
| Resin (*) | 1,200 parts by mass |

Note that the resin (*) varied depending upon which of the after-mentioned resin solutions (1) to (4) was used. The following shows the resins corresponding to the resin solutions.
When a resin solution (1) was used, the resin (b-1) was used as the resin (*).
When a resin solution (2) was used, the resin (b-2) was used as the resin (*).
When a resin solution (3) was used, the resin (b-3) was used as the resin (*).
When a resin solution (4) was used, the resin (b-4) was used as the resin (*).

The obtained mixture was kneaded at 150° C. for 30 minutes wing a double roll mill, then subjected to rolling and cooling, and pulverized using a pulverizer (manufactured by Hosokawa Micron Corporation) so as to produce a masterbatch.

~Production of Fine Resin Particle (A1)~

Production Example 8

Production of Fine Particle Dispersion Liquid (w-1) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 11 parts by mass |
| Styrene | 80 parts by mass |
| Methacrylic acid | 73 parts by mass |
| Butyl acrylate | 120 parts by mass |
| Butyl thioglycolate | 15 parts by mass |
| Ammonium persulfate | 1 part by mass |

This emulsion was heated until the temperature in the system reacted 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-1) was thus obtained. Particles of this fine particle dispersion liquid (w-1) had a volume average particle diameter (Dv) of 105 nm. The resin content of this fine particle dispersion liquid (w-1) had a weight average molecular weight (Mw) of 10,000 and a glass transition temperature (Tg) of 40° C.

Production Example 9

Production of Fine Particle Dispersion Liquid (w-2) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 4 parts by mass |
| Styrene | 68 parts by mass |
| Methacrylic acid | 105 parts by mass |
| Butyl acrylate | 100 parts by mass |
| Ammonium persulfate | 1 part by mass |

This emulsion was heated until the temperature in the system reached 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-2) was thus obtained. Particles of this fine particle dispersion liquid (w-2) had a volume average particle diameter (Dv) of 700 nm. The resin content of this fine particle dispersion liquid (w-2) had a weight average molecular weight (Mw) of 230,000 and a glass transition temperature (Tg) of 70° C.

Production Example 10

Production of Fine Particle Dispersion Liquid (w-3) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 10 parts by mass |
| Styrene | 83 parts by mass |
| Methacrylic acid | 65 parts by mass |
| Butyl acrylate | 125 parts by mass |
| Butyl thioglycolate | 17 parts by mass |
| Ammonium persulfate | 1 part by mass |

This emulsion was heated until the temperature in the system reacted 75° C., and subjected to reaction for 5 hours. Further, 30 parts by mass of 1% ammonium persulfate aqueous solution was added, then the mixture was aged at 75° C. for 5 hours, and a fine particle dispersion liquid (w-3) was thus obtained. Particles of this fine particle dispersion liquid (w-3) had a volume average particle diameter (Dv) of 150 nm. The resin content of this fine particle dispersion liquid (w-3) had a weight average molecular weight (Mw) of 8,000 and a glass transition temperature (Tg) of 30° C.

Production Example 11

Production of Fine Particle Dispersion Liquid (w-4) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 6 parts by mass |
| Styrene | 80 parts by mass |
| Methacrylic acid | 83 parts by mass |
| Butyl acrylate | 110 parts by mass |
| Butyl thioglycolate | 8 parts by mass |
| Ammonium persulfate | 1 part by mass |

This emulsion was heated until the temperature in the system reacted 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-4) was thus obtained. Particles of this fine particle dispersion liquid (w-4) had a volume average particle diameter (Dv) of 500 nm. The resin content of this fine particle dispersion liquid (w-4) had a weight average molecular weight (Mw) of 80,000 and a glass transition temperature (Tg) of 45° C.

Production Example 12

Production of Fine Particle Dispersion Liquid (w-5) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 18 parts by mass |
| Styrene | 83 parts by mass |
| Methacrylic acid | 85 parts by mass |
| Butyl acrylate | 105 parts by mass |
| Butyl thioglycolate | 8 parts by mass |
| Ammonium persulfate | 1 part by mass |

This emulsion was heated until the temperature in the system reacted 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-5) was thus obtained. Particles of this fine particle dispersion liquid (w-5) had a volume average particle diameter (Dv) of 30 nm. The resin content of this fine particle dispersion liquid (w-5) had a weight average molecular weight (Mw) of 75,000 and a glass transition temperature (Tg) of 50° C.

Production Example 13

Production of Fine Particle Dispersion Liquid (w-6) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 16 parts by mass |
| Styrene | 68 parts by mass |
| Methacrylic acid | 102 parts by mass |
| Butyl acrylate | 103 parts by mass |
| Butyl thioglycolate | 6 parts by mass |
| Ammonium persulfate | 1 part by mass |

This emulsion was heated until the temperature in the system reached 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-6) was thus obtained. Particles of this fine particle dispersion liquid (w-6) had a volume average particle diameter (Dv) of 50 nm. The resin content of this fine particle dispersion liquid (w-6) had a weight average molecular weight (Mw) of 100,000 and a glass transition temperature (Tg) of 62° C.

Production Example 14

Production of Fine Particle Dispersion Liquid (w-7) (Styrene-acrylic Resin)

The ingredients shown below were placed in a reaction container equipped with a stirring rod and a thermometer, and then stirred at a rotational speed of 400 rpm for 15 minutes. Thus, a white emulsion was obtained.

| | |
|---|---|
| Water | 683 parts by mass |
| Sodium salt of methacrylic acid ethylene oxide adduct sulfate ester (ELEMINOL RS-30, manufactured by Sanyo Chemical Industries, Ltd.) | 8 parts by mass |
| Styrene | 81 parts by mass |
| Methacrylic acid | 87 parts by mass |
| Butyl acrylate | 105 parts by mass |
| Butyl thioglycolate | 12 parts by mass |
| Ammonium persulfate | 1 part by mass |

This emulsion was heated until the temperature in the system reached 75° C., and subjected to reaction for 5 hours. Further, 30 parts by mass of 1% (by mass) ammonium persulfate aqueous solution was added, then the mixture was aged at 75° C. for 5 hours, and a fine particle dispersion liquid (w-7) was thus obtained. Particles of this fine particle dispersion liquid (w-7) had a volume average particle diameter (Dv) of 230 nm. The resin content of this fine particle dispersion liquid (w-7) had a weight average molecular weight (Mw) of 50,000 and a glass transition temperature (Tg) of 53° C.

Production Example 15

Production of Fine Particle Dispersion Liquid (w-8) (Polyester Resin)

In an autoclave, a mixture composed of 1,163 parts by mass of terephthalic acid, 165 parts by mass of isophthalic acid, 25 parts by mass of phthalic acid, 216 parts by mass of adipic acid, 375 parts by mass of ethylene glycol and 730 parts by mass of neopentyl glycol was heated at 260° C. for 2.5 hours and subjected to esterification reaction. Subsequently, 0.262 parts by mass of germanium dioxide as a catalyst was added, the temperature of the system was increased to 280° C. in 30 minutes, and the pressure of the system was gradually lowered such that it became 0.1 Torr after 1 hour. Under these conditions, polycondensation reaction was further continued. After 1.5 hours, the pressure of the system was changed to normal pressure using nitrogen gas, the temperature of the system was lowered, and when it became 260° C., 99 parts by mass of isophthalic acid was added. The ingredients were stirred at 255° C. for 30 minutes and then taken out in the form of a sheet, and subsequently the sheet was cooled to room temperature, then pulverized with a crusher, and sieved so as to obtain a polyester resin corresponding to a sieve mesh size of 1 mm to 6 mm.

Further, into a 2 L glass container with a jacket, the following were poured: 200 parts by mass of the polyester resin synthesized; 45 parts by mass of ethylene glycol mono-n-butyl ether; 470 parts by mass of polyvinyl alcohol ("UNITIKA POVAL" 050G, manufactured by UNITIKA LTD.) 0.5% (by mass) aqueous solution (hereinafter referred to as "PVA-1"); and an amount of N,N-dimethylethanolamine (hereinafter referred to also as "DMEA") equivalent to 1.2 times the amount of all carboxyl groups contained in the polyester resin. When these ingredients were stirred in an open system at 6,000 rpm using desktop HOMO DISPER (T.K. ROBOMIX, manufactured by Tokushu Kika Kogyo Co., Ltd.), it was confirmed that matter in the form of resin particles was not settling at the bottom of the container but was in a completely suspended state. This state was maintained, and 10 minutes after, hot water was passed into the jacket to carry out heating. When the temperature in the container reached 68° C., the rotational speed at which the stirring was carried out was changed to 7,000 rpm. The temperature in the container was kept in the range of 6° C. to 70° C. and the stirring was carried out for a further 20 minutes to thereby obtain a uniform aqueous dispersion which was milky white in color. Then cold water was passed into the jacket, with stirring carried out at 3,500 rpm, to cool the aqueous dispersion to room temperature, then the aqueous dispersion was filtered using a stainless steel filter (635 mesh, plain weave), and a fine particle dispersion liquid (w-8) was thus obtained. Particles of the obtained fine particle dispersion liquid (w-8) had a volume average particle diameter (Dv) of 110 nm. The resin content of this fine particle dispersion liquid (w-8) had a weight average molecular weight (Mw) of 19,000 and a glass transition temperature (Tg) of 50° C.

Production Example 16

Production of Fine Particle Dispersion Liquid (w-9) (Urethane-Acrylic Resin)

The ingredients shown below were poured into a 2 L four-necked flask equipped with a thermometer, a condenser tube, a stirrer and a nitrogen introducing pipe, then the temperature was increased to 90° C. while stirring the ingredients in a nitrogen atmosphere, and urethane-forming reaction was carried out at this temperature for 1 hour.

| | |
|---|---|
| Polycaprolactone | 70 parts by mass |
| Copolymerized polyester resin (*) | 80 parts by mass |
| Isophorone diisocyanate | 88.8 parts by mass |
| Dimethylolpropionic acid | 24 parts by mass |
| Ethyl acetate | 60 parts by mass |

(*) Copolymerized polyester resin composed of ethylene glycol (E), neopentyl glycol (N), terephthalic acid (T) and isophthalic acid (I) (copolymer composition: E/N · T/I = 50/50 · 50/50 (molar ratio))

Subsequently, 90 parts by mass of ethyl acetate was applied dropwise in 30 minutes, and the reaction was further continued at 90° C. for 1 hour. Thereafter, the temperature was lowered to 40° C., and an NCO-terminated prepolymer was thus obtained. To this prepolymer, 16 parts by mass of triethylamine was added so as to effect neutralization, and then 500 parts by mass of ion-exchange water was added. Subsequently, 12M parts by mass of adipic acid dihydrazide and 22.7 parts by mass of a dihydrazide compound (manufactured by AJINOMOTO CO., INC.) were added to the reaction system, stirring was continued at 50° C. for 1 hour, then the ethyl acetate was distilled away at reduced pressure, and a by drazide-terminated polyurethane aqueous dispersion liquid was thus obtained. The obtained aqueous resin had a solid content of 37.1% by mass.

One hundred and fifty parts by mass of ion-exchange water and 270 parts by mass of the polyurethane aqueous dispersion liquid synthesized as described above were poured into a 2 L four-necked flask equipped with a thermometer, a condenser tube, a stirrer, a nitrogen introducing pipe and a dripping funnel. Then the temperature was increased from room temperature to 80° C. in 30 minutes. From the dripping funnel, a mixture of 80 parts by mass of ethyl acrylate, 15 parts by mass of styrene, 5 parts by mass of diacetoneacrylamide, 2 parts by mass of hydrogen peroxide and 20 parts by mass of ion-exchange water was applied dropwise in 4 hours with stirring, and after the dropwise application of the mixture had finished, stirring was continued for 1 hour. Subsequently, 1 part by mass of hydrogen peroxide was added and stirring was continued at 80° C. for 2 hours to thereby complete a graft polymerization reaction. In this manner, a fine particle dispersion liquid (w-9) was obtained. Particles of the obtained fine particle dispersion liquid (w-9) had a volume average particle diameter (Dv) of 170 nm. The resin content of this fine particle dispersion liquid (w-9) had a weight average molecular weight (Mw) of 100,000 and a glass transition temperature (Tg) of 55° C.

The volume average particle diameters (Dv), the weight average molecular weights (Mw) and the glass transition temperatures (Tg) of the fine particle dispersion liquids (w-1) to (w-9) are shown together in Table 5.

TABLE 5

| | Type of resin | Volume average particle diameter Dv (nm) | Weight average molecular weight Mw | Glass transition temperature Tg (° C.) |
|---|---|---|---|---|
| Fine particle dispersion liquid (w-1) | Styrene-acrylic resin | 105 | 10,000 | 40 |
| Fine particle dispersion liquid (w-2) | Styrene-acrylic resin | 700 | 230,000 | 70 |
| Fine particle dispersion liquid (w-3) | Styrene-acrylic resin | 150 | 8,000 | 30 |
| Fine particle dispersion liquid (w-4) | Styrene-acrylic resin | 500 | 80,000 | 45 |
| Fine particle dispersion liquid (w-5) | Styrene-acrylic resin | 30 | 75,000 | 50 |
| Fine particle dispersion liquid (w-6) | Styrene-acrylic resin | 50 | 100,000 | 62 |
| Fine particle dispersion liquid (w-7) | Styrene-acrylic resin | 230 | 50,000 | 53 |
| Fine particle dispersion liquid (w-8) | Polyester resin | 110 | 19,000 | 50 |
| Fine particle dispersion liquid (w-9) | Urethane-acrylic resin | 170 | 100,000 | 55 |

~Production of Fine Resin Particles (A2)~

Production Example 17

Production of Fine Particle Dispersion Liquid (w-10)

Into a reaction container equipped with a condenser tube, a stirrer and a nitrogen introducing pipe, 0.3 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 174 parts by mass of styrene, 26 parts by mass of butyl acrylate and 1.9 parts by mass of 1-octanethiol was applied dropwise in 90 minutes. Then the temperature was kept at 80° C. for a further 60 minutes so as to subject the ingredients to polymerization reaction. Thereafter, cooling was carried out, and a fine particle dispersion liquid (w-10) was thus obtained. Particles of the obtained fine particle dispersion liquid (w-10) had a volume average particle diameter (Dv) of 450 nm. The resin content of this fine particle dispersion liquid (w-10) had a weight average molecular weight (Mw) of 70,000 and a glass transition temperature (Tg) of 65° C.

Production Example 18

Production of Fine Particle Dispersion Liquid (w-11)

Into a reaction container equipped with a condenser tube, a stirrer and a nitrogen introducing pipe, 1.6 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 180 parts by mass of styrene and 20 parts by mass of butyl acrylate was applied dropwise in 90 minutes. Then the temperature was kept at 80° C. for a further 60 minutes so as to subject the ingredients to polymerization reaction. Thereafter, cooling was carried out, and a fine particle dispersion liquid (w-11) was thus obtained. Particles of the obtained fine particle dispersion liquid (w-11) had a volume average particle diameter (Dv) of 70 nm. The resin content of this fine particle dispersion liquid (w-11) had a weight average molecular weight (Mw) of 220,000 and a glass transition temperature (Tg) of 85° C.

Production Example 19

Production of Fine Particle Dispersion Liquid (w-12)

Into a reaction container equipped with a condenser tube, a stirrer and a nitrogen introducing pipe, 0.5 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 160 parts by mass of styrene, 40 parts by mass of butyl acrylate and 5.4 parts by mass of 1-octanethiol was applied dropwise in 90 minutes.

Then the temperature was kept at 80° C. for a further 60 minutes so as to subject the ingredients to polymerization reaction. Thereafter, cooling was carried out, and a fine particle dispersion liquid (w-12) was thus obtained. Particles of the obtained fine particle dispersion liquid (w-12) had a volume average particle diameter (Dv) of 280 nm. The resin content of this fine particle dispersion liquid (w-12) had a weight average molecular weight (Mw) of 8,500 and a glass transition temperature (Tg) of 50° C.

Production Example 20

Production of Fine Particle Dispersion Liquid (w-13)

Into a reaction container equipped with a condenser tube, a stirrer and a nitrogen introducing pipe, 0.4 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 170 parts by mass of styrene, 30 parts by mass of butyl acrylate and 4.1 parts by mass of 1-octanethiol was applied dropwise in 90 minutes.

Then the temperature was kept at 80° C. for a further 60 minutes so as to subject the ingredients to polymerization reaction. Thereafter, cooling was carried out, and a fine particle dispersion liquid (w-13) was thus obtained. Particles of the obtained fine particle dispersion liquid (w-13) had a volume average particle diameter (Dv) of 350 nm. The resin content of this fine particle dispersion liquid (w-13) had a weight average molecular weight (Mw) of 15,000 and a glass transition temperature (Tg) of 58° C.

Production Example 21

Production of Fine Particle Dispersion Liquid (w-14)

Into a reaction container equipped with a condenser tube, a stirrer and a nitrogen introducing pipe, 2.1 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 174 parts by mass of styrene, 26 parts by mass of butyl acrylate and 1.9 parts by mass of 1-octanethiol was applied dropwise in 90 minutes. Then the temperature was kept at 80° C. for a further 60 minutes so as to subject the ingredients to polymerization reaction. Thereafter, cooling was carried out, and a fine particle dispersion liquid (w-14) was thus obtained. Particles of the obtained fine particle dispersion liquid (w-14) had a volume average particle diameter (Dv) of 35 nm. The resin content of this fine particle dispersion liquid (w-14) had a weight average molecular weight (Mw) of 85,000 and a glass transition temperature (Tg) of 65° C.

Production Example 20

Production of Fine Particle Dispersion Liquid (w-15)

Into a reaction container equipped with a condenser tube, a stirrer and a nitrogen introducing pipe, 0.1 parts by mass of sodium dodecyl sulfate and 486 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.8 parts by mass of potassium persulfate in 109 parts by mass of ion-exchange water was poured into this reaction container. Fifteen minutes after that, a mixed solution composed of 200 parts by mass of styrene and 0.6 parts by mass of 1-octanethiol was applied dropwise in 90 minutes. Then the temperature was kept at 80° C. for a further 60 minutes so as to subject the ingredients to polymerization reaction. Thereafter, cooling was carried out, and a fine particle dispersion liquid (w-15) was thus obtained. Particles of the obtained fine particle dispersion liquid (w-15) had a volume average particle diameter (Dv) of 650 nm. The resin content of this fine particle dispersion liquid (w-15) had a weight average molecular weight (Mw) of 150,000 and a glass transition temperature (Tg) of 102° C.

Production Example 21

Production of Fine Particle Dispersion Liquid (w-16)

Into a reaction container equipped with a condenser tube, a stirrer and a nitrogen introducing pipe, 2.1 parts by mass of sodium dodecyl sulfate and 505 parts by mass of ion-exchange water were poured. With stirring, heating was carried out such that the temperature reached 80° C., and the sodium dodecyl sulfate was thus dissolved in the ion-exchange water. Thereafter, a solution prepared by dissolving 2.3 parts by mass of potassium persulfate in 90 parts by mass of ion-exchange water was poured into this reaction container. Fifteen minutes after that, a mixed solution composed of 200 parts by mass of butyl acrylate and 0.2 parts by mass of 1-octanethiol was applied dropwise in 90 minutes. Then the temperature was kept at 80° C. for a further 60 minutes so as to subject the ingredients to polymerization reaction. Thereafter, cooling was carried out, and a fine particle dispersion liquid (w-16) was thus obtained. Particles of the obtained fine particle dispersion liquid (w-16) had a volume average particle diameter (Dv) of 35 nm. The resin content of this fine particle dispersion liquid (w-16) had a weight average molecular weight (Mw) of 180,000 and a glass transition temperature (Tg) of 105° C.

Production Example 22

Production of Fine Particle Dispersion Liquid (w-17) (Polyester Resin)

In an autoclave, a mixture composed of 1,125 parts by mass of terephthalic acid, 341 parts by mass of isophthalic acid, 336 parts by mass of ethylene glycol and 789 parts by mass of neopentyl glycol was heated at 260° C. for 2.5 hours and subjected to esterification reaction. Subsequently, 0.262 parts by mass of germanium dioxide as a catalyst was added, the temperature of the system was increased to 280° C. in 30 minutes, and the pressure of the system was gradually lowered such that it became 0.1 Torr after 1 hour. Under these conditions, the polycondensation reaction was further continued. After 1.5 hours, the pressure of the system was changed to normal pressure using nitrogen gas, the temperature of the system was lowered, and when it reached 260° C., 206 parts by mass of isophthalic acid and 40 parts by mass of trimellitic anhydride were added. The ingredients were stirred at 255° C. for 30 minutes and then taken out in the form of a sheet, and subsequently the sheet was cooled to room temperature, then pulverized with a crusher, and sieved so as to obtain a polyester resin corresponding to a sieve mesh size of 1 mm to 6 mm.

Further, into a 2 L glass container with a jacket, the following were poured: 200 parts by mass of the polyester resin synthesized; 37 parts by mass of ethylene glycol mono-n-butyl ether; 460 parts by mass of polyvinyl alcohol ("UNITIKA POVAL" 050G, manufactured by UNITIKA LTD.) 0.5% (by mass) aqueous solution (hereinafter referred to as "PVA-1"); and an amount of N,N-dimethylethanolamine (hereinafter referred to also as "DMEA") equivalent to 1.2 times the amount of all carboxyl groups contained in the polyester resin. When these ingredients were stirred in an open system at 6,000 rpm using desktop HOMO DISPER (T.K. ROBOMIX, manufactured by Tokushu Kika Kogyo Co., Ltd.), it was confirmed that matter in the form of resin particles was not settling at the bottom of the container but was in a completely suspended state. This state was maintained, and 10 minutes after, hot water was passed into the jacket to carry out heating. When the temperature in the container reached 68° C., the rotational speed at which the stirring was carried out was changed to 7,000 rpm. The temperature in the container was kept in the range of 68° C. to 70° C. and the stirring was carried out for a further 20 minutes to thereby obtain a uniform aqueous dispersion which was milky white in color. Then cold water was passed into the jacket, with stirring carried out at 3,500 rpm, to cool the aqueous dispersion to room temperature, the aqueous dispersion was filtered using a stainless steel filter (635 mesh, plain weave), and a fine particle dispersion liquid (w-17) was thus obtained. Particles of the obtained fine particle dispersion liquid (w-17) had a volume average particle diameter (Dv) of 120 nm. The resin content of this fine particle dispersion liquid (w-17) had a weight average molecular weight (Mw) of 13,500 and a glass transition temperature (Tg) of 63° C.

Production Example 23

Production of Fine Particle Dispersion Liquid (w-18) (Urethane-acrylic Resin)

The ingredients shown below were poured into a 2 L four-necked flask equipped with a thermometer, a condenser tube, a stirrer and a nitrogen introducing pipe, then the temperature was increased to 90° C. while stirring the ingredients in a nitrogen atmosphere, and urethane-forming reaction was carried out at this temperature for 1 hour.

| | |
|---|---|
| Polycaprolactone | 70 parts by mass |
| Copolymerized polyester resin (*) | 80 parts by mass |
| Isophorone diisocyanate | 88.8 parts by mass |
| Dimethylolpropionic acid | 24 parts by mass |
| Ethyl acetate | 60 parts by mass |

(*) Copolymerized polyester resin composed of ethylene glycol (E), neopentyl glycol (N), terephthalic acid (T) and isophthalic acid (I) (copolymer composition: E/N · T/I = 50/50 · 50/50 (molar ratio))

Subsequently, 90 parts by mass of ethyl acetate was applied dropwise in 30 minutes, and the reaction was further continued at 90° C. for 1 hour. Thereafter, the temperature was lowered to 40° C., and an NCO-terminated prepolymer was thus obtained. To this prepolymer, 16 parts by mass of triethylamine was added so as to effect neutralization, and then 500 parts by mass of ion-exchange water was added. Subsequently, 12.6 parts by mass of adipic acid dihydrazide and 22.7 parts by mass of a dihydrazide compound (manufactured by AJINOMOTO CO., INC.) were added to the reaction system, stirring was continued at 50° C. for 1 hour, then the ethyl acetate was distilled away at reduced pressure, and a hydrazide-terminated polyurethane aqueous dispersion liquid was thus obtained. This aqueous resin had a solid content of 37.1% by mass.

One hundred and fifty parts by mass of ion-exchange water and 16 parts by mass of the polyurethane aqueous dispersion liquid synthesized as described above were poured into a 2 L four-necked flask equipped with a thermometer, a condenser tube, a stirrer, a nitrogen introducing pipe and a dripping funnel. Then the temperature was increased from room temperature to 80° C. in 30 minutes. From the dripping funnel, a mixture of 112 parts by mass of ethyl acrylate, 21 parts by mass of styrene, 7 parts by mass of diacetoneacrylamide, 2 parts by mass of hydrogen peroxide and 20 parts by mass of ion-exchange water was applied dropwise in 4 hours, and after the dropwise application of the mixture had finished, stirring was continued for 1 hour. Subsequently, 1 part by mass of hydrogen peroxide was added and stirring was continued at 80° C. for 2 hours to thereby complete a graft polymerization reaction. In this manner, a fire particle dispersion liquid (w-18) was obtained. Particles of the obtained fine particle dispersion liquid (w-18) had a volume average particle diameter (Dv) of 150 nm. The resin content of this fine particle dispersion liquid (w-18) had a weight average molecular weight (Mw) of 140,000 and a glass transition temperature (Tg) of 76° C.

The volume average particle diameters, the weight average molecular weights and the glass transition temperatures of the fine particle dispersion liquids (w-10) to (w-18) are shown together in Table 6.

TABLE 6

| | Type of resin | Volume average particle diameter Dv (nm) | Weight average molecular weight Mw | Glass transition temperature Tg (° C.) |
|---|---|---|---|---|
| Fine particle dispersion liquid (w-10) | Styrene-acrylic resin | 450 | 70,000 | 65 |
| Fine particle dispersion liquid (w-11) | Styrene-acrylic resin | 70 | 220,000 | 85 |
| Fine particle dispersion liquid (w-12) | Styrene-acrylic resin | 280 | 8,500 | 50 |
| Fine particle dispersion liquid (w-13) | Styrene-acrylic resin | 350 | 15,000 | 58 |
| Fine particle dispersion liquid (w-14) | Styrene-acrylic resin | 35 | 85,000 | 65 |
| Fine particle dispersion liquid (w-15) | Styrene-acrylic resin | 650 | 150,000 | 102 |
| Fine particle dispersion liquid (w-16) | Styrene-acrylic resin | 35 | 180,000 | 105 |
| Fine particle dispersion liquid (w-17) | Polyester resin | 120 | 13,500 | 63 |
| Fine particle dispersion liquid (w-18) | Urethane-acrylic resin | 150 | 140,000 | 76 |

Production Examples 24 to 32

Preparation of Aqueous Medium

Three hundred parts by mass of ion-exchange water, 300 parts by mass of each of the fine particle dispersion liquids (w-1) to (w-9) produced in Production Examples 8 to 16, and 0.2 parts by mass of sodium dodecylbenzenesulfonate were mixed and stirred so as to obtain a uniform solution. In this manner, aqueous medium phases (1) to (9) were prepared. The aqueous medium phases (1) to (9) correspond to the fine particle dispersion liquids (w-1) to (w-9).

Preparation Examples 33 to 36

Preparation of Resin Solution

Each of the resins (b-1) to (b-4) obtained in Production Examples 1 to 4, the polyester prepolymer, and 80 parts by mass of ethyl acetate were poured into a reaction container, such that the numbers of parts by mass of the resin and the polyester prepolymer were as shown in Table 7. In this manner, resin solutions (1) to (4) were prepared. The resin solutions (1) to (4) correspond to the resins (b-1) to (b-4).

TABLE 7

| | Resin (b) | | Polyester prepolymer |
|---|---|---|---|
| Resin solution (1) | Resin (b-1) | 85 | 15 |
| Resin solution (2) | Resin (b-2) | 100 | 0 |
| Resin solution (3) | Resin (b-3) | 100 | 0 |
| Resin solution (4) | Resin (b-4) | 85 | 15 |

(In Table 7, the numerical values are based upon parts by mass.)

Production Examples 37 to 40

Preparation of Oil Phase

Next, 5 parts by mass of carnauba wax (molecular weight: 1,800, acid value: 2.7 mgKOH/g, penetration: 1.7 mm (at 40° C.)) and 5 parts by mass of the masterbatch were placed in 400 parts by mass of each of the resin solutions (1) to (4) obtained in Production Examples 33 to 36. The mixture was passed three times through ULTRA VISCO MILL (a bead mill, manufactured by AIMEX Corporation) under the following conditions: the solution-sending speed was 1 kg/h, the disc circumferential speed was 6 m/sec, and zirconia beads (0.5 mm in particle diameter) were supplied so as to occupy 80% by volume. In this manner, oil phases (1) to (4) were obtained. Note that the oil phases (1) and (4) were each dissolved in 2.5 parts by mass of the ketimine compound so as to yield intended oil phases. The oil phases (1) to (4) correspond to the resin solutions (1) to (4).

Production Example 41

Preparation of Toner Base Material

Next, 150 parts by mass each of the aqueous medium phases (1) to (9) obtained in Production Examples 24 to 32 were poured into other respective containers. While stirring each aqueous medium phase at 12,000 rpm using T.K. HOMO MIXER (manufactured by Tokushu Kika Kogyo Co., Ltd.), 100 parts by mass of each of the oil phases (1) to (4) obtained in Production Examples 37 to 40 was added in accordance with Tables 8-1 to 8-4, which was followed by mixing for 10 minutes. Thereafter, while stirring the mixture at 300 rpm to 500 rpm using T.K. HOMO MIXER, 5 parts by mass of each of the fine particle dispersion liquids (w-10) to (w-18) obtained in Production Examples 17 to 23 was applied dropwise in accordance with Tables 8-1 to 8-4. Ten minutes after its dropwise application had finished, the mixture was diluted 1.4-fold with ion-exchange water so as to obtain an emulsified slurry. Further, 100 parts by mass of the emulsified slurry was placed in a flask equipped with a stirrer and a thermometer. While stirring the emulsified slurry at a stirring circumferential speed of 20 m/min, solvent removal was carried out at 30° C. for 10 hours so as to obtain a dispersed slurry.

Next, 100 parts by mass of the dispersed slurry was filtered at reduced pressure, then 100 parts by mass of ion-exchange water was added to the obtained filter cake, and these were mixed at 12,000 rpm for 10 minutes using T.K. HOMO MIXER and then filtered. Three hundred parts by mass of ion-exchange water was added to the obtained filter cake, these were mixed at 12,000 rpm for 10 minutes using T.K. HOMO MIXER and then filtered twice. Twenty parts by mass of 10% (by mass) sodium hydroxide aqueous solution was added to the obtained filter cake, these were mixed at 12,000 rpm for 30 minutes using T.K. HOMO MIXER and then filtered at reduced pressure. Three hundred parts by mass of ion-exchange water was added to the obtained filter cake, these were mixed at 12,000 rpm for 10 minutes using T.K. HOMO MIXER and then filtered. Three hundred parts by mass of ion-exchange water was added to the obtained filter cake, these were mixed at 12,000 rpm for 10 minutes using T.K. HOMO MIXER and then filtered twice. Twenty parts by mass of 10% (by mass) hydrochloric acid was added to the obtained filter cake, these were mixed at 12,000 rpm for 10 minutes using T.K. HOMO MIXER, then FTERGENT F-310 (manufactured by NEOS COMPANY LIMITED) as a fluorine quaternary ammonium salt compound was added in a 5% (by mass) methanol solution to the mixture such that the amount of the fluorine quaternary ammonium salt was 0.1 parts by mass with respect to 100 parts by mass of the solid content of a toner. Stirring was carried out for 10 minutes, and then the mixture was filtered. Three hundred parts by mass of ion-exchange water was added to the obtained filter cake, these were mixed at 12,000 rpm for 10 minutes using T.K. HOMO MIXER and then filtered twice, and a filter cake was thus obtained. The obtained filter cake was dried at 40° C. for 36 hours using a circulation wind dryer and then sieved with a mesh whose sieve mesh size was 75 μm, and a toner base material was thus produced.

Toner base materials 1 to 43 produced as described in Production Example 41 are shown together in Tables 8-1 to 8-4. Note that toner base materials 40 to 42 were produced in the same manner as in Production Example 41, except that the fine particle dispersion liquids (w-10) to (w-18) (5 parts by mass each) were not added.

TABLE 8-1

| | | Oil phase | Resin (b) | | Polyester prepolymer | Aqueous medium phase | Fine resin particles (A1) | Fine resin particles (A2) |
|---|---|---|---|---|---|---|---|---|
| Ex. 1 | Toner base material 1 | Oil phase (1) | Resin (b-1) | 85 | 15 | Aqueous medium phase (1) | Fine particle dispersion liquid (w-1) | Fine particle dispersion liquid (w-10) |
| Ex. 2 | Toner base material 2 | Oil phase (1) | Resin (b-1) | 85 | 15 | Aqueous medium phase (2) | Fine particle dispersion liquid (w-2) | Fine particle dispersion liquid (w-11) |
| Ex. 3 | Toner base material 3 | Oil phase (1) | Resin (b-1) | 85 | 15 | Aqueous medium phase (3) | Fine particle dispersion liquid (w-3) | Fine particle dispersion liquid (w-12) |
| Ex. 4 | Toner base material 4 | Oil phase (1) | Resin (b-1) | 85 | 15 | Aqueous medium phase (4) | Fine particle dispersion liquid (w-4) | Fine particle dispersion liquid (w-13) |
| Ex. 5 | Toner base material 5 | Oil phase (1) | Resin (b-1) | 85 | 15 | Aqueous medium phase (5) | Fine particle dispersion liquid (w-5) | Fine particle dispersion liquid (w-14) |
| Ex. 6 | Toner base material 6 | Oil phase (1) | Resin (b-1) | 85 | 15 | Aqueous medium phase (6) | Fine particle dispersion liquid (w-6) | Fine particle dispersion liquid (w-15) |
| Ex. 7 | Toner base material 7 | Oil phase (1) | Resin (b-1) | 85 | 15 | Aqueous medium phase (7) | Fine particle dispersion liquid (w-7) | Fine particle dispersion liquid (w-16) |
| Ex. 8 | Toner base material 8 | Oil phase (1) | Resin (b-1) | 85 | 15 | Aqueous medium phase (1) | Fine particle dispersion liquid (w-1) | Fine particle dispersion liquid (w-17) |
| Ex. 9 | Toner base material 9 | Oil phase (1) | Resin (b-1) | 85 | 15 | Aqueous medium phase (8) | Fine particle dispersion liquid (w-8) | Fine particle dispersion liquid (w-14) |
| Ex. 10 | Toner base material 10 | Oil phase (1) | Resin (b-1) | 85 | 15 | Aqueous medium phase (8) | Fine particle dispersion liquid (w-8) | Fine particle dispersion liquid (w-17) |
| Ex. 11 | Toner base material 11 | Oil phase (1) | Resin (b-1) | 85 | 15 | Aqueous medium phase (1) | Fine particle dispersion liquid (w-1) | Fine particle dispersion liquid (w-18) |
| Ex. 12 | Toner base material 12 | Oil phase (1) | Resin (b-1) | 85 | 15 | Aqueous medium phase (9) | Fine particle dispersion liquid (w-9) | Fine particle dispersion liquid (w-11) |
| Ex. 13 | Toner base material 13 | Oil phase (1) | Resin (b-1) | 85 | 15 | Aqueous medium phase (9) | Fine particle dispersion liquid (w-9) | Fine particle dispersion liquid (w-18) |

TABLE 8-2

| | | Oil phase | Resin (b) | | Polyester prepolymer | Aqueous medium phase | Fine resin particles (A1) | Fine resin particles (A2) |
|---|---|---|---|---|---|---|---|---|
| Ex. 14 | Toner base material 14 | Oil phase (2) | Resin (b-2) | 100 | 0 | Aqueous medium phase (1) | Fine particle dispersion liquid (w-1) | Fine particle dispersion liquid (w-10) |
| Ex. 15 | Toner base material 15 | Oil phase (2) | Resin (b-2) | 100 | 0 | Aqueous medium phase (2) | Fine particle dispersion liquid (w-2) | Fine particle dispersion liquid (w-11) |
| Ex. 16 | Toner base material 16 | Oil phase (2) | Resin (b-2) | 100 | 0 | Aqueous medium phase (3) | Fine particle dispersion liquid (w-3) | Fine particle dispersion liquid (w-12) |
| Ex. 17 | Toner base material 17 | Oil phase (2) | Resin (b-2) | 100 | 0 | Aqueous medium phase (4) | Fine particle dispersion liquid (w-4) | Fine particle dispersion liquid (w-13) |
| Ex. 18 | Toner base material 18 | Oil phase (2) | Resin (b-2) | 100 | 0 | Aqueous medium phase (5) | Fine particle dispersion liquid (w-5) | Fine particle dispersion liquid (w-14) |
| Ex. 19 | Toner base material 19 | Oil phase (2) | Resin (b-2) | 100 | 0 | Aqueous medium phase (6) | Fine particle dispersion liquid (w-6) | Fine particle dispersion liquid (w-15) |
| Ex. 20 | Toner base material 20 | Oil phase (2) | Resin (b-2) | 100 | 0 | Aqueous medium phase (7) | Fine particle dispersion liquid (w-7) | Fine particle dispersion liquid (w-16) |
| Ex. 21 | Toner base material 21 | Oil phase (2) | Resin (b-2) | 100 | 0 | Aqueous medium phase (1) | Fine particle dispersion liquid (w-1) | Fine particle dispersion liquid (w-17) |
| Ex. 22 | Toner base material 22 | Oil phase (2) | Resin (b-2) | 100 | 0 | Aqueous medium phase (8) | Fine particle dispersion liquid (w-8) | Fine particle dispersion liquid (w-14) |
| Ex. 23 | Toner base material 23 | Oil phase (2) | Resin (b-2) | 100 | 0 | Aqueous medium phase (8) | Fine particle dispersion liquid (w-8) | Fine particle dispersion liquid (w-17) |
| Ex. 24 | Toner base material 24 | Oil phase (2) | Resin (b-2) | 100 | 0 | Aqueous medium phase (1) | Fine particle dispersion liquid (w-1) | Fine particle dispersion liquid (w-18) |
| Ex. 25 | Toner base material 25 | Oil phase (2) | Resin (b-2) | 100 | 0 | Aqueous medium phase (9) | Fine particle dispersion liquid (w-9) | Fine particle dispersion liquid (w-11) |
| Ex. 26 | Toner base material 26 | Oil phase (2) | Resin (b-2) | 100 | 0 | Aqueous medium phase (9) | Fine particle dispersion liquid (w-9) | Fine particle dispersion liquid (w-18) |

TABLE 8-3

| | | Oil phase | Resin (b) | | Polyester prepolymer | Aqueous medium phase | Fine resin particles (A1) | Fine resin particles (A2) |
|---|---|---|---|---|---|---|---|---|
| Ex. 27 | Toner base material 27 | Oil phase (3) | Resin (b-3) | 100 | 0 | Aqueous medium phase (1) | Fine particle dispersion liquid (w-1) | Fine particle dispersion liquid (w-10) |
| Ex. 28 | Toner base material 28 | Oil phase (3) | Resin (b-3) | 100 | 0 | Aqueous medium phase (2) | Fine particle dispersion liquid (w-2) | Fine particle dispersion liquid (w-11) |
| Ex. 29 | Toner base material 29 | Oil phase (3) | Resin (b-3) | 100 | 0 | Aqueous medium phase (3) | Fine particle dispersion liquid (w-3) | Fine particle dispersion liquid (w-12) |

TABLE 8-3-continued

| | | Oil phase | Resin (b) | | Polyester prepolymer | Aqueous medium phase | Fine resin particles (A1) | Fine resin particles (A2) |
|---|---|---|---|---|---|---|---|---|
| Ex. 30 | Toner base material 30 | Oil phase (3) | Resin (b-3) | 100 | 0 | Aqueous medium phase (4) | Fine particle dispersion liquid (w-4) | Fine particle dispersion liquid (w-13) |
| Ex. 31 | Toner base material 31 | Oil phase (3) | Resin (b-3) | 100 | 0 | Aqueous medium phase (5) | Fine particle dispersion liquid (w-5) | Fine particle dispersion liquid (w-14) |
| Ex. 32 | Toner base material 32 | Oil phase (3) | Resin (b-3) | 100 | 0 | Aqueous medium phase (6) | Fine particle dispersion liquid (w-6) | Fine particle dispersion liquid (w-15) |
| Ex. 33 | Toner base material 33 | Oil phase (3) | Resin (b-3) | 100 | 0 | Aqueous medium phase (7) | Fine particle dispersion liquid (w-7) | Fine particle dispersion liquid (w-16) |
| Ex. 34 | Toner base material 34 | Oil phase (3) | Resin (b-3) | 100 | 0 | Aqueous medium phase (1) | Fine particle dispersion liquid (w-1) | Fine particle dispersion liquid (w-17) |
| Ex. 35 | Toner base material 35 | Oil phase (3) | Resin (b-3) | 100 | 0 | Aqueous medium phase (8) | Fine particle dispersion liquid (w-8) | Fine particle dispersion liquid (w-14) |
| Ex. 36 | Toner base material 36 | Oil phase (3) | Resin (b-3) | 100 | 0 | Aqueous medium phase (8) | Fine particle dispersion liquid (w-8) | Fine particle dispersion liquid (w-17) |
| Ex. 37 | Toner base material 37 | Oil phase (3) | Resin (b-3) | 100 | 0 | Aqueous medium phase (1) | Fine particle dispersion liquid (w-1) | Fine particle dispersion liquid (w-18) |
| Ex. 38 | Toner base material 38 | Oil phase (3) | Resin (b-3) | 100 | 0 | Aqueous medium phase (9) | Fine particle dispersion liquid (w-9) | Fine particle dispersion liquid (w-11) |
| Ex. 39 | Toner base material 39 | Oil phase (3) | Resin (b-3) | 100 | 0 | Aqueous medium phase (9) | Fine particle dispersion liquid (w-9) | Fine particle dispersion liquid (w-18) |

TABLE 8-4

| | | Oil phase | Resin (b) | | Polyester prepolymer | Aqueous medium phase | Fine resin particles (A1) | Fine resin particles (A2) |
|---|---|---|---|---|---|---|---|---|
| Comp. Ex. 1 | Toner base material 40 | Oil phase (1) | Resin (b-1) | 85 | 15 | Aqueous medium phase (2) | Fine particle dispersion liquid (w-2) | — |
| Comp. Ex. 2 | Toner base material 41 | Oil phase (2) | Resin (b-2) | 100 | 0 | Aqueous medium phase (6) | Fine particle dispersion liquid (w-5) | — |
| Comp. Ex. 3 | Toner base material 42 | Oil phase (3) | Resin (b-3) | 100 | 0 | Aqueous medium phase (7) | Fine particle dispersion liquid (w-7) | — |
| Comp. Ex. 4 | Toner base material 43 | Oil phase (4) | Resin (b-4) | 85 | 15 | Aqueous medium phase (1) | Fine particle dispersion liquid (w-1) | Fine particle dispersion liquid (w-10) |

(In Tables 8-1 to 8-4, the numerical values are based upon parts by mass.)

Production Example 42

Production of Toner

One hundred parts by mass of each of the toner base materials 1 to 43 and 1.0 part by mass of hydrophobic silica (H2000, manufactured by Clariant (Japan) K.K.) as an external additive were mixed at a circumferential speed of 30 m/sec for 30 seconds using a Henschel Mixer (manufactured by Mitsui Mining Co., Ltd.), and then there was a pause for 1 minute. This process including the mixing and the pause was repeated five times, then the mixture was sieved with a mesh whose sieve mesh size was 35 μm, and a toner was thus obtained. In this manner, toners 1 to 43 were produced.

Production Example 43

Production of Carrier

The ingredients shown below were added to 100 parts by mass of toluene, then a dispersing process was carried out for 20 minutes using a homo mixer, and a resin layer coating solution was thus prepared.

| | |
|---|---|
| Silicone resin (organo straight silicone) | 100 parts by mass |
| γ-(2-aminoethyl)aminopropyltrimethoxysilane | 5 parts by mass |
| Carbon black | 10 parts by mass |

The resin layer coating solution was applied onto the surface of 1,000 parts by mass of spherical magnetite of 50 μm in volume average particle diameter, using a fluidized-bed coating device, so as to produce a carrier.

Production Example 44

Production of Developer

Five parts by mass of each of the toners 1 to 39 and the toners 40 to 43 was mixed with 95 parts by mass of the carrier so as to produce developers of Examples 1 to 39 and Comparative Examples 1 to 4.

Next, evaluations concerning volume average particle diameter (Dv), number average particle diameter (Dn), ratio (Dv/Dn), fixation property, image density, haze value, heat-resistant storage stability, variation depending upon environment, and fluidity were carried out as follows using the obtained toners and developers. The results are shown in Tables 9-1 and 9-2.

<Evaluation Method>

<<Measurement of Volume Average Particle Diameter (Dv), Number Average Particle Diameter (Dn), and Ratio (Dv/Dn)>>

The particle size distributions of the toners (toner base particles) were measured using COULTER MULTISIZER. Specifically, COULTER MULTISIZER III (manufactured by Coulter Corporation) was used as a measuring apparatus, a personal computer and an interface (manufactured by Nikkaki Co., LTD.) for outputting a number distribution and a volume distribution were connected to the measuring apparatus, and a 1% (by mass) NaCl aqueous solution was prepared as an electrolytic solution, using primary sodium chloride. As for the measuring method, into 100 mL to 150 mL of this aqueous solution as an electrolytic solution, 0.1 mL to 5 mL of a surfactant (alkylbenzene sulfonate) as a dispersant was added, and also 2 mg to 20 mg of a measurement sample was added, then a dispersing process was carried out for 1 minute to 3 minutes using an ultrasonic dispersing device. Further, 100 mL to 200 mL of an electrolytic aqueous solution was poured into a beaker, then the dispersion liquid of the sample was added so as to have a predetermined concentration, and the volume average particle diameter (Dv) and the number average particle diameter (Dn) were calculated by averaging the particle diameters of 50,000 particles, using COULTER MULTISIZER III with an aperture of 100 μm. Based upon the volume average particle diameter (Dv) and the number average particle diameter (Dn) obtained, the ratio (Dv/Dn) was calculated.

<<Fixation Property>>

Using an apparatus made by modifying a fixing unit of an electrophotographic copier (MF-200, manufactured by Ricoh Company, Ltd.) with a TEFLON (registered trademark) roller as a fixing roller, solid images were formed on TYPE 6200, which is plain paper used as transfer paper, (manufactured by Ricoh Company, Ltd.) and on <135>, which is thick paper used as copying/printing paper, (manufactured by NBS Ricoh Co., Ltd.), with changes in the temperature of a fixing belt, such that the amount of the toner attached for each solid image was 0.85 mg/cm$^2$±0.1 mg/cm$^2$. Here, the upper limit temperature at which hot offset did not arise on the plain paper was defined as the fixation upper limit temperature. Also, the lower limit temperature at which the residual ratio of the image density, after a pad had been rubbed against each solid image, was 70% or more was defined as the fixation lower limit temperature. The fixation upper limit temperature and the fixation lower limit temperature thus obtained were evaluated in accordance with the following evaluation criteria.

[Evaluation Criteria for Fixation Upper Limit Temperature]

A: The fixation upper limit temperature is 190° C. or higher.

B: The fixation upper limit temperature is 180° C. or higher, but lower than 190° C.

C: The fixation upper limit temperature is 170° C. or higher, but lower than 180° C.

D: The fixation upper limit temperature is lower than 170° C.

[Evaluation Criteria for Fixation Lower Limit Temperature]

AA: The fixation lower limit temperature is lower than 125° C.

A: The fixation lower limit temperature is 125° C. or higher, but lower than 135° C.

B: The fixation lower limit temperature is 135° C. or higher, but lower than 145° C.

C: The fixation lower limit temperature is 145° C. or higher, but lower than 155° C.

D: The fixation lower limit temperature is 155° C. or higher.

<<Image Density>>

Using a tandem-type color image forming apparatus (IMAGIO NEO 450, manufactured by Ricoh Company, Ltd.), with the surface temperature of a fixing roller set at 160° C.±2° C., a solid image was formed on TYPE 6000 <70W> (manufactured by Ricoh Company, Ltd.) such that the amount of the toner attached was 1.00 mg/cm$^2$±0.05 mg/cm$^2$. The image density was measured at arbitrarily selected six places on the obtained solid image, using a spectrometer (938 SPECTRODENSITOMETER, manufactured by X-Rite, Inc.), then the image density (average value) was calculated, and the image density (average value) was evaluated in accordance with the following evaluation criteria.

[Evaluation Criteria]

A: The image density was 2.0 or greater.

B: The image density was 1.70 or greater, but less than 2.0.

C: The image density was less than 1.70.

<<Haze Value>>

A single-color image sample (a solid image formed on an OHP sheet such that the amount of the toner attached was 0.85 $mg/cm^2 \pm 0.01\ mg/cm^2$) as an image sample used for evaluating fixation properties was developed on TYPE PPC-DX (manufactured by Ricoh Company, Ltd.) as an OHP sheet, with the temperature of a fixing belt set at 160° C. The haze value of the sample on the sheet was measured using a direct-reading haze value computer (HGM-2DP, manufactured by Suga Test Instruments Co., Ltd.). The obtained haze value was evaluated in accordance with the following evaluation criteria. The haze value is a measure showing the transparency of the toner; the lower this value is, the higher the transparency is, and the better color-generating properties are when an OHP sheet is used.

[Evaluation Criteria]

A: The haze value was less than 20%.

B: The haze value was 20% or higher, but less than 30%.

C: The haze value was 30% or more.

<<Heat-Resistant Storage Stability (Penetration)>>

Each toner was supplied into a 50 mL glass container, then the toner in the glass container was left to stand for 24 hours in a constant-temperature bath set at 50° C. This toner was cooled to 24° C., then the penetration (mm) thereof was measured in accordance with the penetration test (JIS K2235-1991), and the penetration was evaluated in accordance with the following criteria. Here, the greater the penetration is, the better the heat-resistant storage stability is. When the penetration is less than 5 mm, it is highly likely that problems will arise in practical use.

[E valuation Criteria]

A: The penetration was 25 mm or greater.

B: The penetration was 15 mm or greater, but less than 25 mm.

C: The penetration was 5 mm or greater, but less than 15 mm.

D: The penetration was less than 5 mm.

<<Variation Depending Upon Environment>>

In an environment in which the temperature was 23° C. and the relative humidity was 50% (M/M environment), each developer was stirred for 5 minutes using a ball mill. Thereafter, 1.0 g of the developer was taken out and subjected to a nitrogen blow treatment for 1 minute using a blow-off charge amount measuring apparatus (TB-200, manufactured by KYOCERA Chemical Corporation), then the charge amount of the developer was measured, and the obtained charge amount was employed as the charge amount. Also, this measurement was carried out in two conditions, i.e. an environment in which the temperature was 40° C. and the relative humidity was 90% (H/H environment) and an environment in which the temperature was 10° C. and the relative humidity was 30% environment), and the charge amount of each developer was thus evaluated in the two conditions. The rate of variability depending upon environment was calculated by means of the following equation, using the charge amounts thus obtained. The rate of variability depending upon environment was evaluated in accordance with the following evaluation criteria. The lower the rate of variability depending upon environment is, the more stable chargeability the developer has.

$$\text{Rate of variability depending upon environment} = 2 \times \frac{([L/L] - [H/H])}{([L/L] + [H/H])} \times 100\,(\%) \qquad \text{Equation (1)}$$

In Equation (1), [L/L] denotes the charge amount in the L/L environment, and [H/H] denotes the charge amount in the H/H environment.

[Evaluation Criteria]

A: The rate of variability depending upon environment is less than 40%.

B: The rate of variability depending upon environment is 40% or more, but less than 50%.

C: The rate of variability depending upon environment is 50% or more, but less than 60%.

D: The rate of variability depending upon environment is 60% or more.

<<Fluidity>>

The bulk density of each toner was measured using a powder tester (manufactured by Hosokawa Micron Group), and evaluated in accordance with the following criteria. Here, the greater the bulk density is, the more favorable the fluidity is.

[Evaluation Criteria]

A: 0.35 or greater

B: 0.30 or greater, but less than 0.35

C: 0.25 or greater, but less than 0.30

D: Less than 0.25

TABLE 9-1

| | | | | | Fixation property | | | | | | |
|---|---|---|---|---|---|---|---|---|---|---|---|
| | | Dv (μm) | Dn (μm) | Dv/Dn | Fixation lower limit temperature | Fixation upper limit temperature | Image density | Haze value | Heat-resistant storage stability | Variation depending upon environment | Fluidity |
| Ex. 1 | Toner 1 | 5.8 | 4.8 | 1.21 | A | A | A | A | A | A | A |
| Ex. 2 | Toner 2 | 6.1 | 5.0 | 1.22 | B | A | A | A | A | A | B |
| Ex. 3 | Toner 3 | 5.5 | 4.5 | 1.22 | A | A | B | A | B | B | A |
| Ex. 4 | Toner 4 | 6.5 | 5.4 | 1.20 | B | A | A | A | A | A | A |
| Ex. 5 | Toner 5 | 5.3 | 4.4 | 1.20 | A | A | B | A | B | B | A |
| Ex. 6 | Toner 6 | 6.0 | 5.1 | 1.18 | B | A | A | A | A | A | B |
| Ex. 7 | Toner 7 | 5.6 | 4.7 | 1.19 | B | A | A | A | A | A | A |
| Ex. 8 | Toner 8 | 5.5 | 4.7 | 1.17 | AA | A | A | A | A | A | A |
| Ex. 9 | Toner 9 | 5.7 | 4.8 | 1.19 | A | A | A | A | A | A | A |
| Ex. 10 | Toner 10 | 5.9 | 5.1 | 1.16 | A | A | B | A | B | B | A |
| Ex. 11 | Toner 11 | 5.0 | 4.2 | 1.19 | A | A | B | A | A | B | A |
| Ex. 12 | Toner 12 | 5.4 | 4.5 | 1.20 | B | A | A | A | A | A | A |
| Ex. 13 | Toner 13 | 5.5 | 4.7 | 1.17 | A | A | B | A | A | B | A |

TABLE 9-1-continued

| | | Dv (μm) | Dn (μm) | Dv/Dn | Fixation property: Fixation lower limit temperature | Fixation upper limit temperature | Image density | Haze value | Heat-resistant storage stability | Variation depending upon environment | Fluidity |
|---|---|---|---|---|---|---|---|---|---|---|---|
| Ex. 14 | Toner 14 | 5.7 | 4.7 | 1.21 | A | A | A | A | A | A | A |
| Ex. 15 | Toner 15 | 6.2 | 5.1 | 1.22 | B | A | A | A | A | A | B |
| Ex. 16 | Toner 16 | 5.6 | 4.7 | 1.19 | A | A | B | A | B | B | A |
| Ex. 17 | Toner 17 | 6.4 | 5.4 | 1.19 | B | A | A | A | A | A | A |
| Ex. 18 | Toner 18 | 5.2 | 4.3 | 1.21 | A | A | B | A | B | B | A |
| Ex. 19 | Toner 19 | 5.9 | 5.0 | 1.18 | B | A | A | A | A | A | B |
| Ex. 20 | Toner 20 | 5.5 | 4.6 | 1.20 | B | A | A | A | A | A | A |
| Ex. 21 | Toner 21 | 5.5 | 4.6 | 1.20 | AA | A | A | A | A | A | A |
| Ex. 22 | Toner 22 | 5.4 | 4.8 | 1.13 | A | A | A | A | A | A | A |

TABLE 9-2

| | | Dv (μm) | Dn (μm) | Dv/Dn | Fixation property: Fixation lower limit temperature | Fixation upper limit temperature | Image density | Haze value | Heat-resistant storage stability | Variation depending upon environment | Fluidity |
|---|---|---|---|---|---|---|---|---|---|---|---|
| Ex. 23 | Toner 23 | 5.7 | 4.8 | 1.19 | A | A | B | A | B | B | A |
| Ex. 24 | Toner 24 | 5.9 | 5.1 | 1.16 | A | A | B | A | A | B | A |
| Ex. 25 | Toner 25 | 5.1 | 4.4 | 1.16 | B | A | A | A | A | A | A |
| Ex. 26 | Toner 26 | 5.3 | 4.2 | 1.26 | A | A | B | A | A | B | A |
| Ex. 27 | Toner 27 | 5.9 | 5.0 | 1.18 | A | A | A | A | A | A | A |
| Ex. 28 | Toner 28 | 6.3 | 5.3 | 1.19 | B | A | A | A | A | A | B |
| Ex. 29 | Toner 29 | 5.6 | 4.8 | 1.17 | A | A | B | A | B | B | A |
| Ex. 30 | Toner 30 | 6.6 | 5.5 | 1.20 | B | A | A | A | A | A | A |
| Ex. 31 | Toner 31 | 5.1 | 4.2 | 1.21 | A | A | B | A | B | B | A |
| Ex. 32 | Toner 32 | 5.9 | 4.9 | 1.20 | B | A | A | A | A | A | B |
| Ex. 33 | Toner 33 | 5.4 | 4.6 | 1.17 | B | A | A | A | A | A | A |
| Ex. 34 | Toner 34 | 5.3 | 4.4 | 1.20 | AA | A | A | A | A | A | A |
| Ex. 35 | Toner 35 | 5.5 | 4.8 | 1.15 | A | A | A | A | A | A | A |
| Ex. 36 | Toner 36 | 5.8 | 5.0 | 1.16 | A | A | B | A | B | B | A |
| Ex. 37 | Toner 37 | 6.0 | 5.2 | 1.15 | A | A | B | A | A | B | A |
| Ex. 38 | Toner 38 | 6.1 | 5.3 | 1.15 | B | A | A | A | A | A | A |
| Ex. 39 | Toner 39 | 5.7 | 4.8 | 1.19 | A | A | B | A | A | B | A |
| Comp. Ex. 1 | Toner 40 | 6.2 | 5.2 | 1.19 | A | A | C | A | C | C | B |
| Comp. Ex. 2 | Toner 41 | 5.0 | 4.2 | 1.19 | A | A | C | A | D | D | A |
| Comp. Ex. 3 | Toner 42 | 5.4 | 4.5 | 1.20 | A | A | C | A | D | C | A |
| Comp. Ex. 4 | Toner 43 | 5.8 | 4.7 | 1.23 | D | A | A | B | A | A | A |

The results shown in Tables 9-1 and 9-2 demonstrate that each of the toners of Examples 1 to 39, formed by attaching the first resin (a1) and the second resin (a2), which have mutually different glass transition temperatures, to the surface of the resin having an amorphous polyhydroxycarboxylic acid skeleton could secure a favorable balance between low-temperature fixation properties and heat-resistant storage stability and was favorable in image density, haze value, variation depending upon environment, and fluidity.

Meanwhile, each of the toners of Comparative Examples 1 to 3, in which there is only one type of resin particle present on the resin surface, experienced degradation of heat-resistant storage stability, image density, and variation depending upon environment.

The toner of Comparative Example 4, in which the binder resin did not have a polyhydroxycarboxylic acid skeleton, experienced degradation of low-temperature fixation properties, although there were two types of resin particles present on the resin surface.

Since a toner of the present invention makes it possible to secure a favorable balance between fixation properties and storage stability and obtain favorable image quality, it can be suitably used for high-quality electrophotographic image formation. A developer including the toner of the present invention can be widely used in a full-color copier, a full-color laser printer, a full-color facsimile for plain paper, etc. which employs an electrophotographic multicolor image developing method.

What is claimed is:

1. A toner comprising:

a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton which is a copolymer of C3-C6 hydroxycarboxylic acids and is optically active, and wherein the third resin (b) has an optical purity X (%), represented by Equation (1) below, of 80% or less, $$\text{Optical purity } X(\%) = |X(L\text{-form}) - X(D\text{-form})| \quad \text{Equation (1)}$$

where X (L-form) denotes the proportion (mol %) of an L-form contained in the third resin (b), expressed as an optically-active monomer equivalent, and X (D-form) denotes the proportion (mol %) of a D-form contained in the third resin (b), expressed as an optically-active monomer equivalent.

2. The toner according to claim 1, wherein the first resin (a1) and the second resin (a2) each contain any one selected from a styrene-acrylic resin, a polyester resin and a urethane-acrylic resin.

3. The toner according to claim 1, wherein the third resin (b) contains a polyester diol (b11) having a polyhydroxycarboxylic acid skeleton.

4. The toner according to claim 1, wherein the third resin (b) contains a straight-chain polyester resin (b1) obtained by reacting together a polyester diol (b11) having a polyhydroxycarboxylic acid skeleton, and a polyester diol (b12) other than the polyester diol (b11), along with an elongation agent.

5. The toner according to claim 4, wherein the mass ratio of the polyester diol (b11) having the polyhydroxycarboxylic acid skeleton to the polyester diol (b12) other than the polyester diol (b11), represented by b11:b12, is in the range of 31:69 to 90:10.

6. The toner according to claim 1, wherein the third resin (b) contains a straight-chain polyester resin (b1), and a resin (b2) obtained by reacting a precursor (b0).

7. The toner according to claim 1, wherein the first resin (a1) has a volume average particle diameter Dv (a1) of 5 nm to 1,000 nm, and the second resin (a2) has a volume average particle diameter Dv (a2) of 5 nm to 1,000 nm.

8. The toner according to claim 1, wherein a volume average particle diameter Dv (a1) of the first resin (a1) and a volume average particle diameter Dv (a2) of the second resin (a2) satisfy the relationship Dv (a1)<Dv (a2).

9. The toner according to claim 1, wherein the second resin (a2) has a glass transition temperature Tg (a2) of 55° C. to 100° C.

10. The toner according to claim 1, wherein the first resin (a1) has a weight average molecular weight Mw (a1) of 9,000 to 200,000, and the second resin (a2) has a weight average molecular weight Mw (a2) of 9,000 to 200,000.

11. A developer comprising:

a toner which comprises a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton which is a copolymer of C3-C6 hydroxycarboxylic acids and is optically active, and wherein the third resin (b) has an optical purity X (%), represented by Equation (1) below, of 80% or less, $$\text{Optical purity } X(\%)=|X(L\text{-form})-X(D\text{-form})| \qquad \text{Equation (1)}$$

where X (L-form) denotes the proportion (mol %) of an L-form contained in the third resin (b), expressed as an optically-active monomer equivalent, and X (D-form) denotes the proportion (mol %) of a D-form contained in the third resin (b), expressed as an optically-active monomer equivalent.

12. The developer according to claim 11, further comprising a carrier.

13. An image forming method comprising:

forming a latent electrostatic image on a latent electrostatic image bearing member;

developing the latent electrostatic image using a toner so as to form a visible image;

transferring the visible image to a recording medium; and fixing the transferred image to the recording medium, wherein the toner comprises a resin particle (C) containing a first resin (a1), a second resin (a2), and a resin particle (B) to a surface of which the first resin (a1) and the second resin (a2) are attached, wherein the first resin (a1) and the second resin (a2) have mutually different glass transition temperatures, and wherein the resin particle (B) contains a third resin (b) having an amorphous polyhydroxycarboxylic acid skeleton which is a copolymer of C3-C6 hydroxycarboxylic acids and is optically active, and wherein the third resin (b) has an optical purity X (%), represented by Equation (1) below, of 80% or less, $$\text{Optical purity } X(\%)=|X(L\text{-form})-X(D\text{-form})| \qquad \text{Equation (1)}$$

where X (L-form) denotes the proportion (mol %) of an L-form contained in the third resin (b), expressed as an optically-active monomer equivalent, and X (D-form) denotes the proportion (mol %) of a D-form contained in the third resin (b), expressed as an optically-active monomer equivalent.

14. The toner according to claim 4, wherein the polyester diol (b12) comprises a diol and a carboxylic acid.

15. The toner according to claim 4, wherein the elongation agent is selected from the group consisting of diisocyanate compounds and dicarboxylic acid compounds.

* * * * *